US005865228A

United States Patent [19]

Patterson

[11] Patent Number: 5,865,228

[45] Date of Patent: Feb. 2, 1999

[54] MULTI-FUNCTION WOODWORKING POWER TOOL

[76] Inventor: Lionel Patterson, 620 Sunset Beach Road, Richmond Hill, Ontario, Canada, L4E 3J6

[21] Appl. No.: 819,094

[22] Filed: Mar. 18, 1997

Related U.S. Application Data

[60] Provisional application No. 60/015,734 Mar. 28, 1996.

[51] Int. Cl.[6] ..... B27C 9/00; B25H 1/00

[52] U.S. Cl. ..... 144/1.1; 29/560; 83/486.1; 83/477.1; 144/48.4; 144/286.1; 144/286.5; 144/287; 144/253.1

[58] Field of Search ..... 29/26 R, 26 A, 29/27 C, 27 R, 560; 408/20; 83/485, 486, 486.1, 477.1; 144/1.1, 35.1, 48.4, 48.3, 286.1, 286.5, 287, 253.1

[56] References Cited

U.S. PATENT DOCUMENTS

| | | | |
|---|---|---|---|
| 1,834,684 | 12/1931 | Dannehower | 144/48.4 |
| 3,334,669 | 8/1967 | Berends et al. | 83/486.1 |
| 3,695,189 | 10/1972 | Felder, Jr. | 144/287 |
| 4,184,395 | 1/1980 | Blachly et al. | 83/486.1 |
| 4,201,254 | 5/1980 | Fehric | 144/1.1 |
| 4,318,432 | 3/1982 | Howey | 144/48.3 |
| 4,497,353 | 2/1985 | Sproat, Jr. | 144/1.1 |
| 5,009,255 | 4/1991 | Fournel | 144/287 |
| 5,431,206 | 7/1995 | McAllister | 144/1.1 |

*Primary Examiner*—W. Donald Bray
*Attorney, Agent, or Firm*—David W. Wong

[57] ABSTRACT

A woodworking power tool which may be used as a circular saw, overhead high-speed router, tilting-head bench and floor models drill press, bench shaper, tracer lathe, and band saw, or as a multiple functions tool combining all these six functions, with all six functions being accessible instantly. The tool is equipped with an optional horsepower motor which is detachable, to permit its immediate replacement with a spare motor and to eliminate lengthy down time while a failed motor is being serviced. The stand may be manufactured in portable, stationary, or custom sizes and it features a high degree of accuracy and freedom from alignment losses. Actuating devices and mechanism are provided on both sides of the tool which is convertible for left-hand or right-hand use. The tool features no large accessories requiring attachment to and detachment from the stand, thereby increasing productivity, eliminating the need for storage space and reducing workshop clutter.

18 Claims, 49 Drawing Sheets

MULTI-FUNCTION WOODWORKING POWER TOOL

This application is a provisional of 60/015,734 filed Mar. 28, 1996.

BACKGROUND OF THE INVENTION

This invention relates to a woodworking power tool which is operative to provide the functions of nine commonly used wood- working tools which have many design inadequacies as discussed below. The woodworking tool of the present invention provides the ease of use and high productivity associated hitherto with large and expensive industrial equipment which the majority of woodworkers cannot afford to purchase and have insufficient floor space to accommodate. For the majority of woodworkers, the present invention provides both a compact and affordable tool and improvement to the portable bench frame shown in U.S. Pat. No. 4,161,974 issued on Jul. 24, 1979 to the Applicant of the present application, which features ease of use and increased productivity, while providing also a neat and safe work environment.

The following power tools commonly used with a bench frame in wood working are problematic:

(1) Radial arm saws: They are prone to loss of alignment, and they require constant checking and, often, re-alignment during use in order to function properly. Such saws are equipped with bevel scales which are too small for accurate reading. The inaccurate reading is compounded by the location of a motor handle which is positioned in front of the bevel scale so that it obstructs the clear reading of the scale and increases the inaccuracy of the reading through parallax error. Both the motor handle and a yoke lock lever swivel with the yoke around the horizontal plane when the yoke is swiveled such that it denies the woodworker the use of the handle in three out of four yoke positions, and making it necessary to grope around the yoke for the yoke lock lever in such three out of four yoke positions. Furthermore, the motor handle tilts with the motor, when the motor is tilted clockwise or counter-clockwise for bevel sawing and other functions, rendering the handle an inconstant factor. Crosscutting wide materials cannot be done with most radial arm saws and mitering wide materials also cannot be done with any radial arm saw.

(2) Table saws: They, too, can suffer alignment loss, although to a much lesser degree. Crosscutting, spaced grooving and accurate mitering, especially compound mitering, of wide materials are difficult to do with a table saw. Changing saw blades, or replacing them with a dado blade or a disc sander is inconvenient.

(3) Miter saws: They are prone to a loss of alignment so that they must be checked constantly and, often, re-aligned in order to function properly. They are designed to crosscut and miter only narrow materials; and they cannot handle materials which are very short in length.

(4) Routers: Only the portable hand-held type routers are affordable by most woodworkers. Such routers are normally mounted in an upside-down manner below specially designed router tables so as to be used as stationary tools. However, when mounted in such manner, their performance is extremely poor because they are difficult to adjust accurately when they are in an inverted position.

(5) Drill presses: Both table top and floor models in general use have short throats and cannot drill holes in the center of wide work pieces.

(6) Lathes: Most lathes are designed for use with hand-held chisels which blunt very quickly and require frequent sharpening. Tracer attachments with more durable cutting bits for such lathes are expensive and can handle small diameter turnings only, rendering the much larger swing capacity of the lathe meaningless.

(7) Band saws: Their tables provide inadequate surface ahead and behind the blade for such work as sawing cabriole legs for tables and chairs. A larger, auxiliary table has to be made and attached over the one furnished with the tool. Although auxiliary tables are easy to make, they are difficult to attach to band saw tables.

(8) Fully-featured multi-purpose tools: Many of their functions necessitate the attachment and detachment of heavy accessories to and from a basic unit thereby entailing substantial physical effort to perform. Moreover, the various accessories require a considerable storage space.

With the exception of lathes, to which the subject does not apply, none of the tools aforementioned provides adequate support for large materials; and in order to use them with large materials, it is necessary to use additional, mostly free-standing, supports. Due to their instability and the problems in attaching them reliably to the frame of the tool, such additional supports affect the accuracy of the work; and they can be hazardous in use and clutter the work area when they are not in use. Additionally, most of the tools aforementioned do not feature easy servicing in the event of motor failure, resulting in a lengthy work stoppage while the motor is being serviced. The present invention reduces any such work stoppage to a few minutes by permitting the failed motor to be replaced very quickly and easily with an inexpensive spare motor.

Beyond the elimination of the aforesaid inadequacies, the design of the tool of the present invention permits it to be made in different sizes, including custom sizes, because, with a single exception, the tooling and components remain constant. The single exception lies in the length of raw material which has to be cut to size and, consequently, may be cut to suit the size of tool desired. That permits several size tools to be manufactured simultaneously to meet market demand, without necessitating additional tooling or increased material and component inventory.

OBJECTS OF THE INVENTION

The primary object of the present invention is to provide an affordable, compact, high precision and easy to use woodworking power tool designed to increase productivity in a safe and uncluttered environment.

Another object of the present invention is to provide a tool which is convertible for left-hand and right-hand use.

A further object of the present invention is to provide a tool which is able to perform a variety of different functions, with all the different functions being easy and quick to access.

SUMMARY OF THE INVENTION

This invention is directed broadly to a woodworking power tool devoid of the inadequacies inherent in the designs of radial arm, table and miter saws, routers, drill presses, bench shapers, lathes, band saws and fully featured multi-purpose tools, by providing the following improvements over them:

(1) It provides full support for large materials or work pieces through the use of horizontally movable outriggers which attach and detach quickly and easily and store compactly;

(2) Only simple and permanent alignment adjustments are required for extremely high accuracy;

(3) It is provided with a bevel index scale which is free from parallax error and featuring easy-to-see half degree markings;

(4) It includes a mitering system featuring easy-to-see half degree markings and permitting left-hand and right-hand mitering throughout 360 degrees, without changing settings or disturbing the 90 degrees crosscut position;

(5) Rests and locks are provided to support and anchor a long rip or guide fence securely;

(6) A table top model drill press with a deep throat as well as a floor model drill press are provided in one unit;

(7) It has a lathe which swivels into storage when not in use;

(8) It has a lathe tracer attachment with the capacity to handle turnings equal in diameter to the full swing of the lathe;

(9) A unique swivel arm renders possible the use of many standard two-wheel and three-wheel band saws;

(10) Quick and simple multiple functions changes may be accomplished without requiring physical exertion; and no storage space for large accessories is required.

(11) It is provided with easily removable, and interchangeable optional horsepower motors such that a spare motor may be stocked for immediate replacement, should the motor in use breaks down; and

(12) It is convertible for left-hand or right-hand use.

BRIEF DESCRIPTION OF THE DRAWINGS

Other objects and a better understanding of the present invention will become more apparent from the following descriptions, taken in conjunction with the accompanying drawings in which.

DETAILED DESCRIPTION OF A PREFERRED EMBODIMENT BY WAY OF EXAMPLE

Figure 6:
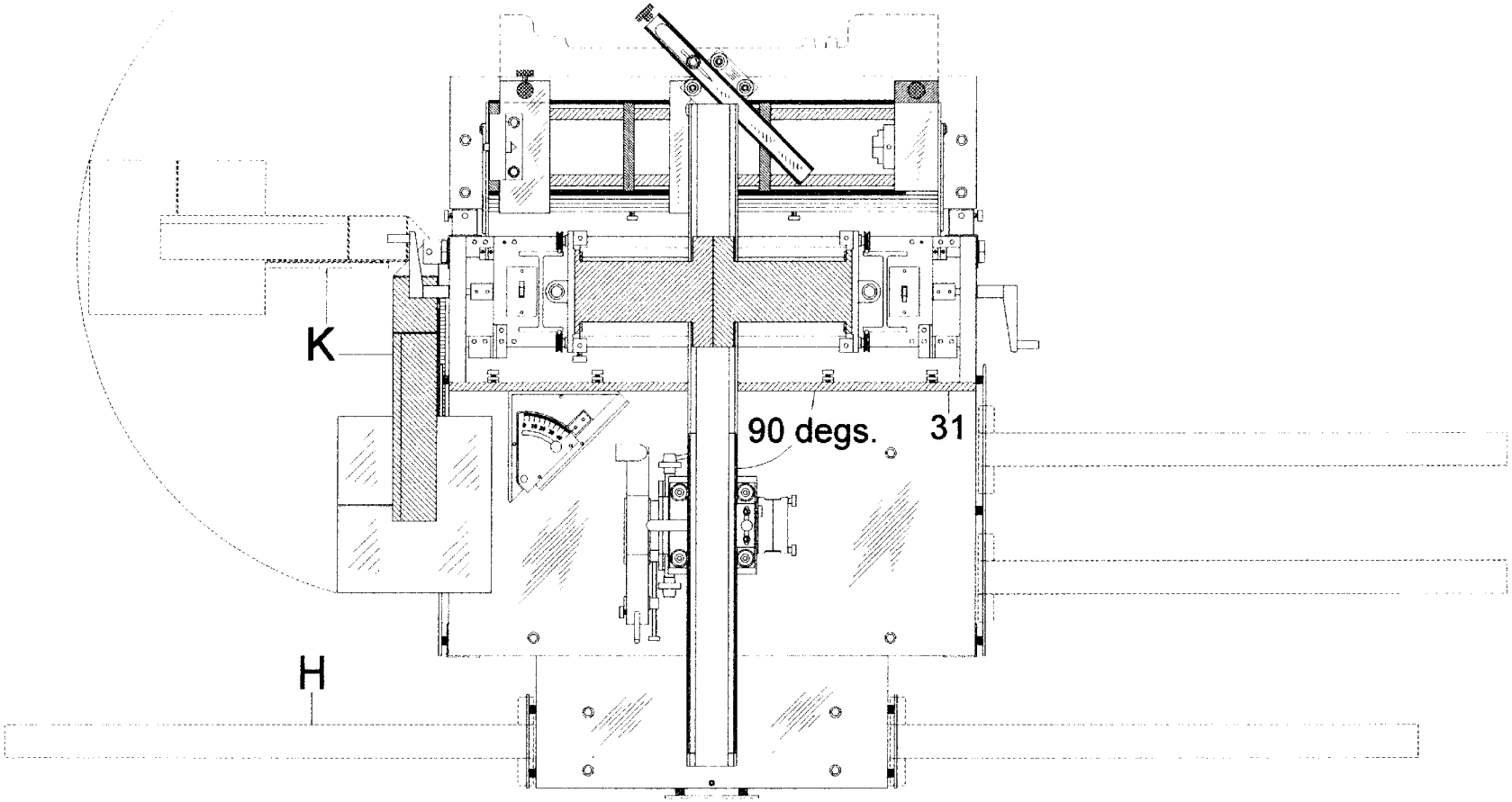
FIG. 6 is a top perspective elevation view of the tool, showing the outriggers outlined in one of many possible configurations and the band saw in two operative positions.
Figure 8:
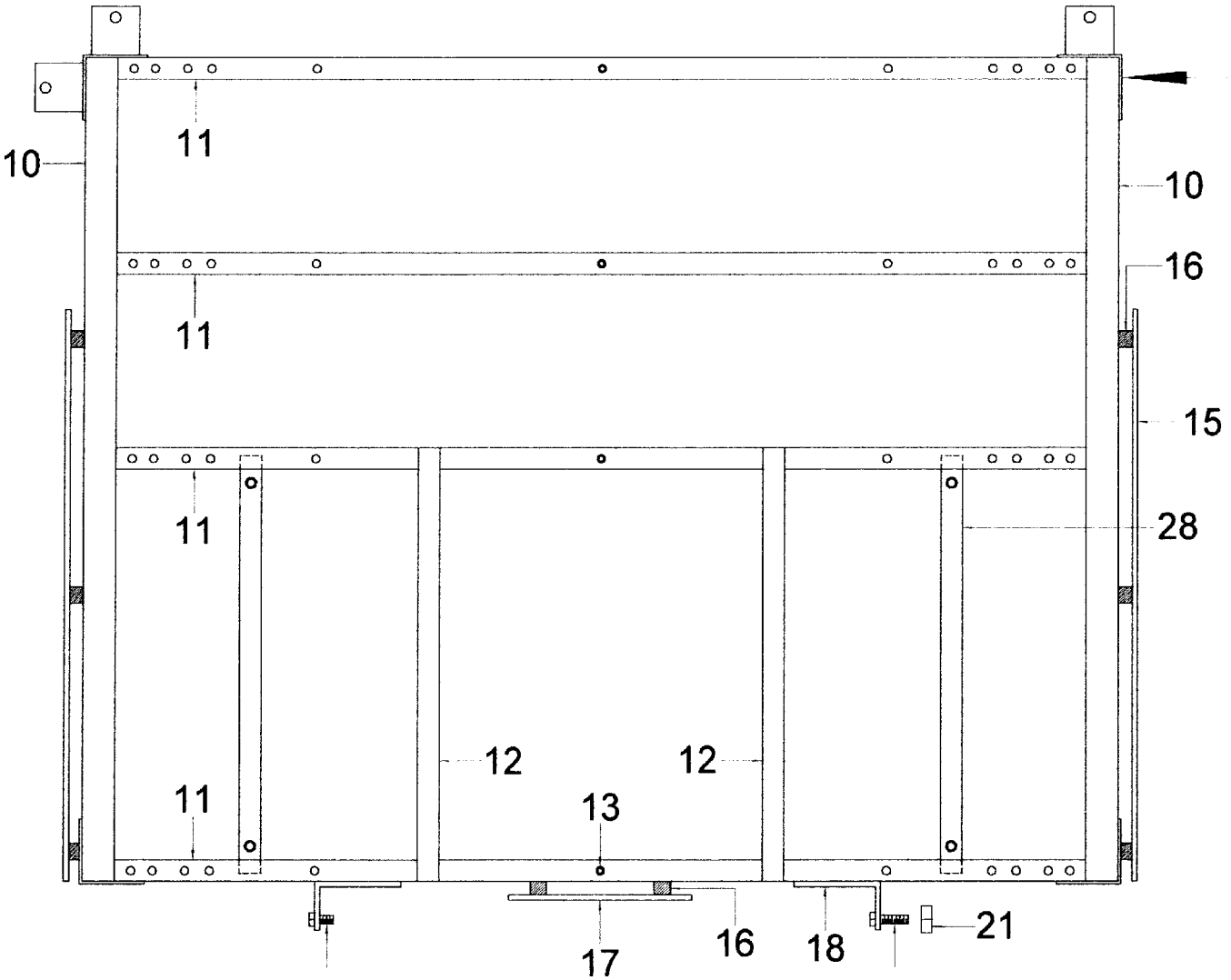
FIG. 8 is a top perspective elevation view of the stand frame.

With reference to the drawings wherein like reference numerals designate corresponding parts in the different views, the tool according to the present invention comprises primarily a unique stand A having a plurality of accessories provided therein. As shown in FIG. 8, the stand consists of a frame constructed from one each left-hand and right-hand channel bars 10, four identical channel bars 11 and two identical shims 12. The channel sides of the channel bars 10 and the outer channel bars 11 face inward. The channel sides of the inner channel bars 11 each face the channel sides of the outer channel bars 11. The channel bars 11 have identical central holes 13 located in their upper and lower sides, with the lower holes being of a smaller diameter than the upper ones, so as to prevent a drop-in/lift-out shoulder pivot 14, shown in FIG. 10, from falling through. Only one hole 13 serves a function. The other holes exist only for manufacturing economy. In conjunction with the drop-in/lift-out pivot 14, the hole 13 serves as a swivel point for aligning the table top at 90° with a cantilever arm along which the motor assembly D travels, as indicated in FIG. 6. The hole 13 and the pivot 14 serve also as pivot points for cutting and edge-shaping circles with an overhead router included in the tool.

As shown in FIG. 8, each channel bar 10 has a flat side bar 15 attached to it. Three spacers 16 are provided to spaced the flat side bar 15 a predetermined distance from the channel bar 10. The front channel bar 11 has a flat front bar 17 attached to it. Two additional spacers 16 are provided to space the flat front bar 17 a predetermined distance from the channel bar 11.

Figure 50:
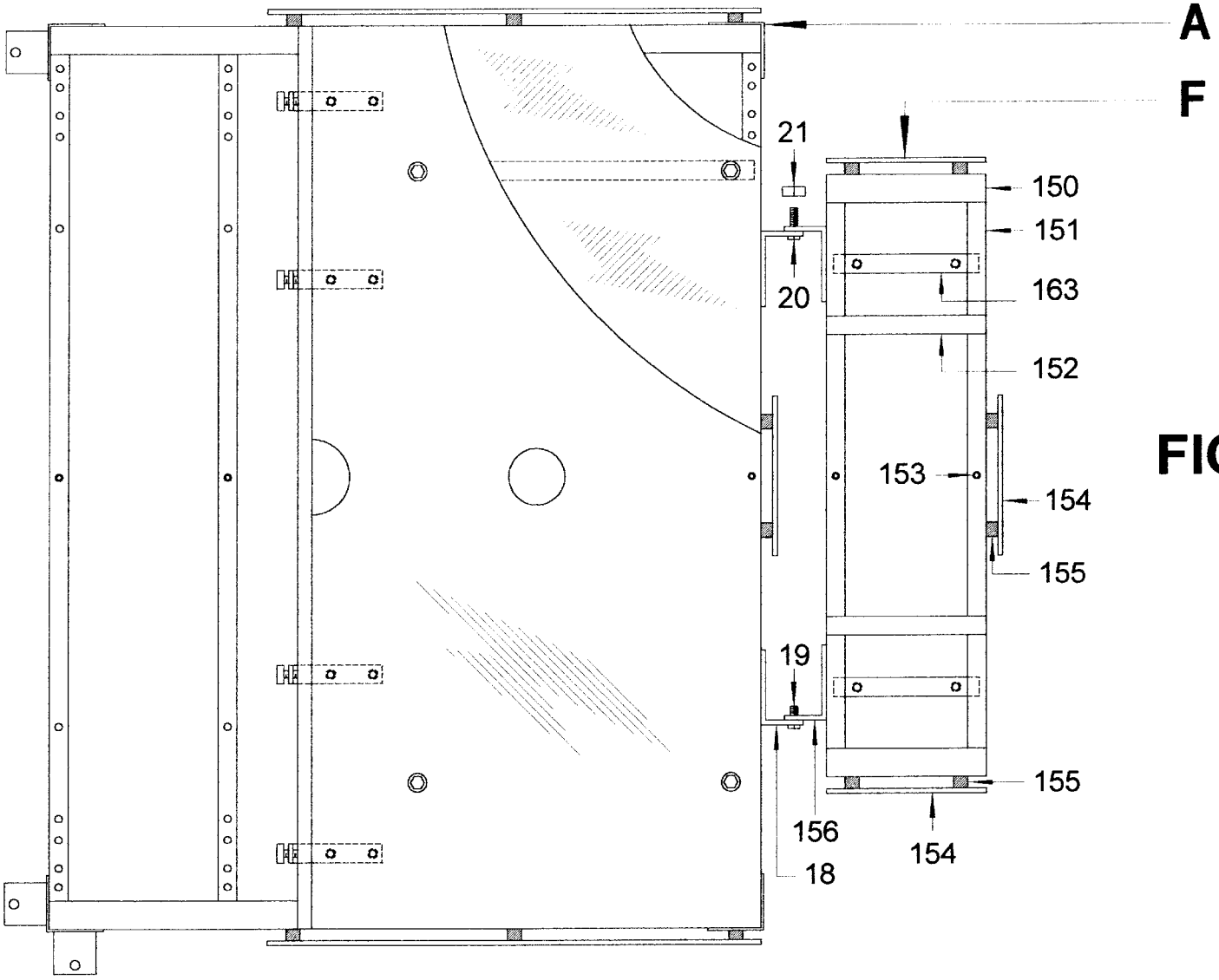
FIG. 50 is a top view of the drop-leaf frame showing its construction and how it is attached to the stand.

Two drop-leaf attachment brackets 18, with bolts 19 and 20 threaded through them, are attached to one channel bar 11. the bolt 20 is longer than the bolt 19, to permit quick and easy coupling between the drop-leaf F and the stand A, as shown in FIG. 50. A hand wheel nut 21 threads on to the longer bolt 20 to prevent accidental separation between the drop-leaf F and the stand A.

Figure 9:
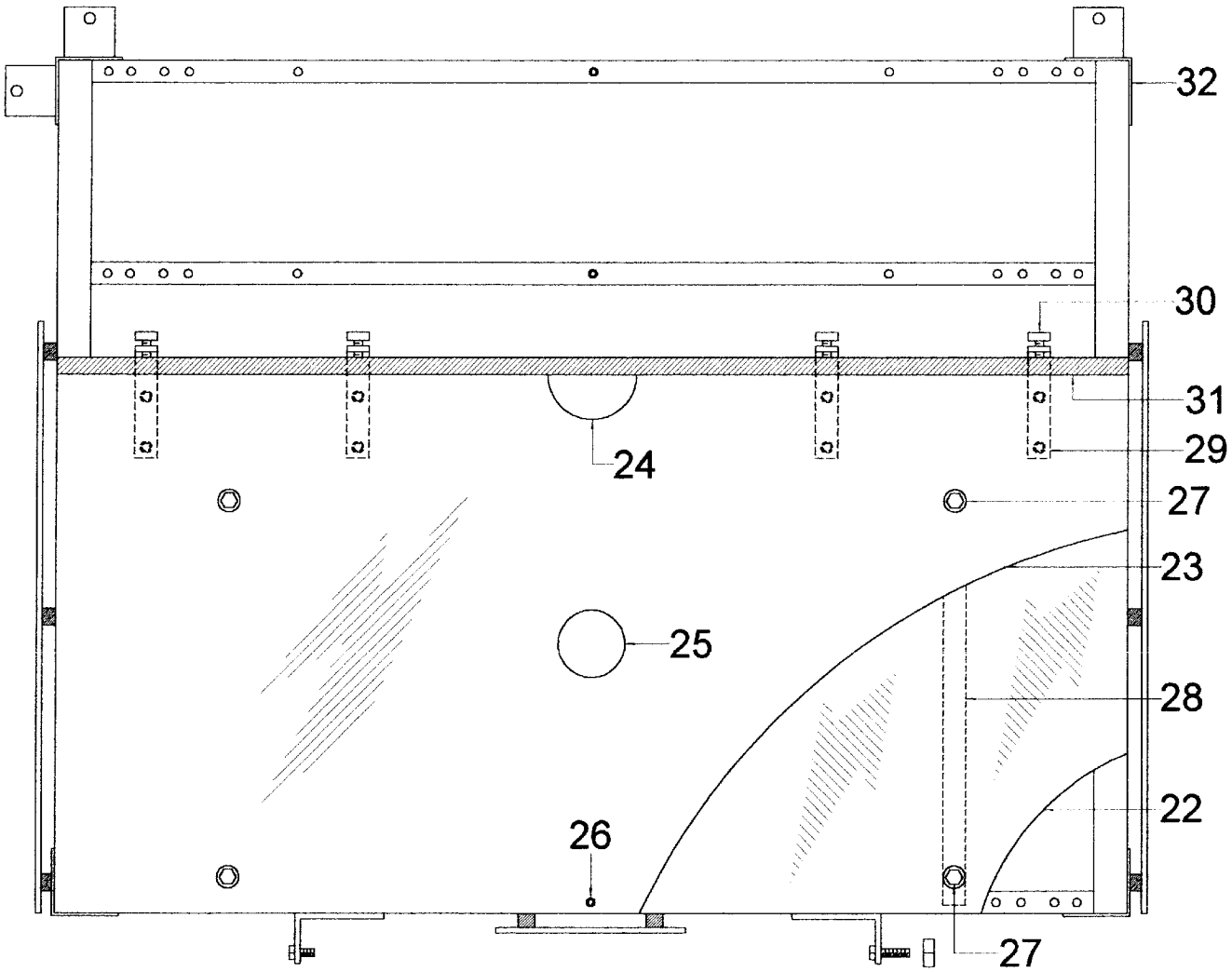
FIG. 9 is a top view showing the stand frame covered with a table top and a table top overlay.

As shown in FIG. 9, the frame of the stand A is covered by a table top 22 which is covered by an expendable and replaceable overlay 23, rubber cemented thereto. Both the table top 22 and the overlay 23 combined feature a semicircle cutout 24, a hole 25 and a hole 26 to accommodate a bench shaper cutter, a drum sander and the drop-in/lift-out pivot 14 respectively. To render table alignment swivel possible, the table top 22 and the overlay 23 combined are secured to the frame through the use of four bolts 27, countersunk in the table top 22 and the overlay 23 combined and threaded into two identical lock bars 28. Once the combined table top 22 and the overlay 23 are aligned at 90° with the cantilever arm along which the motor assembly D travels, the four bolts 27 are tightened, thereby tightening the lock bars 28 against the inner face of the upper lip of two channel bars 11.

Four angle brackets 29 are bolted on to the underside of the table 22. Four hand wheel screws 30, threaded through the brackets 29, serve to lock an expendable and replaceable fence 31 against the table top 22 and the overlay 23 combined.

Figure 10:
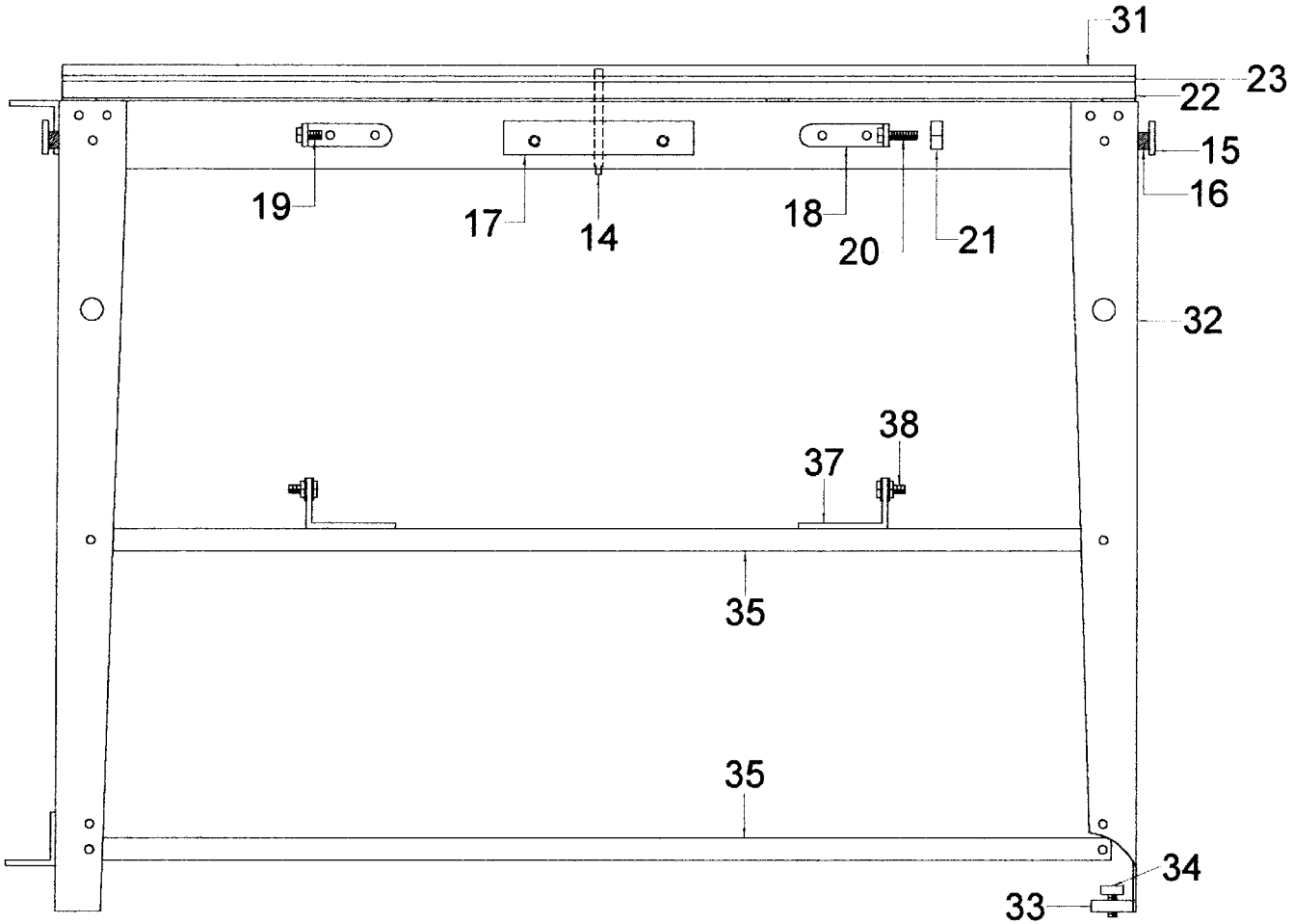
FIG. 10 is a front elevation view of the stand.

As shown in FIG. 10, four legs 32 are attached to the frame. Each leg 32 has a tapped foot pad 33, through any one of which may be threaded a hand wheel screw 34, to bridge any gap which may exist between any one leg and an uneven floor surface.

Figure 1:
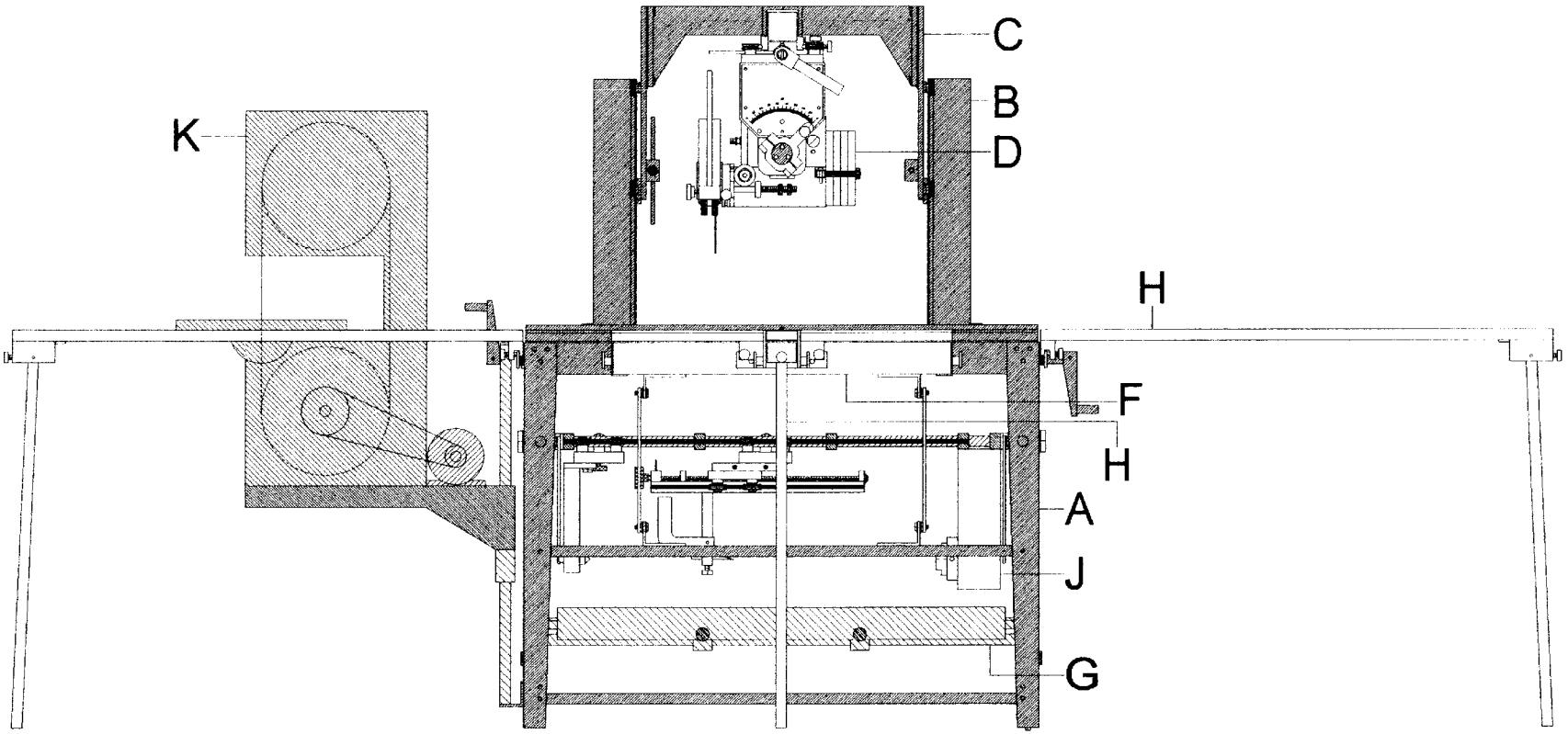
FIG. 1 is a front perspective elevation view of the tool according to the present invention, showing the lathe therein swiveled down into the stored position and the band saw swiveled away from the stand.
Figure 2:
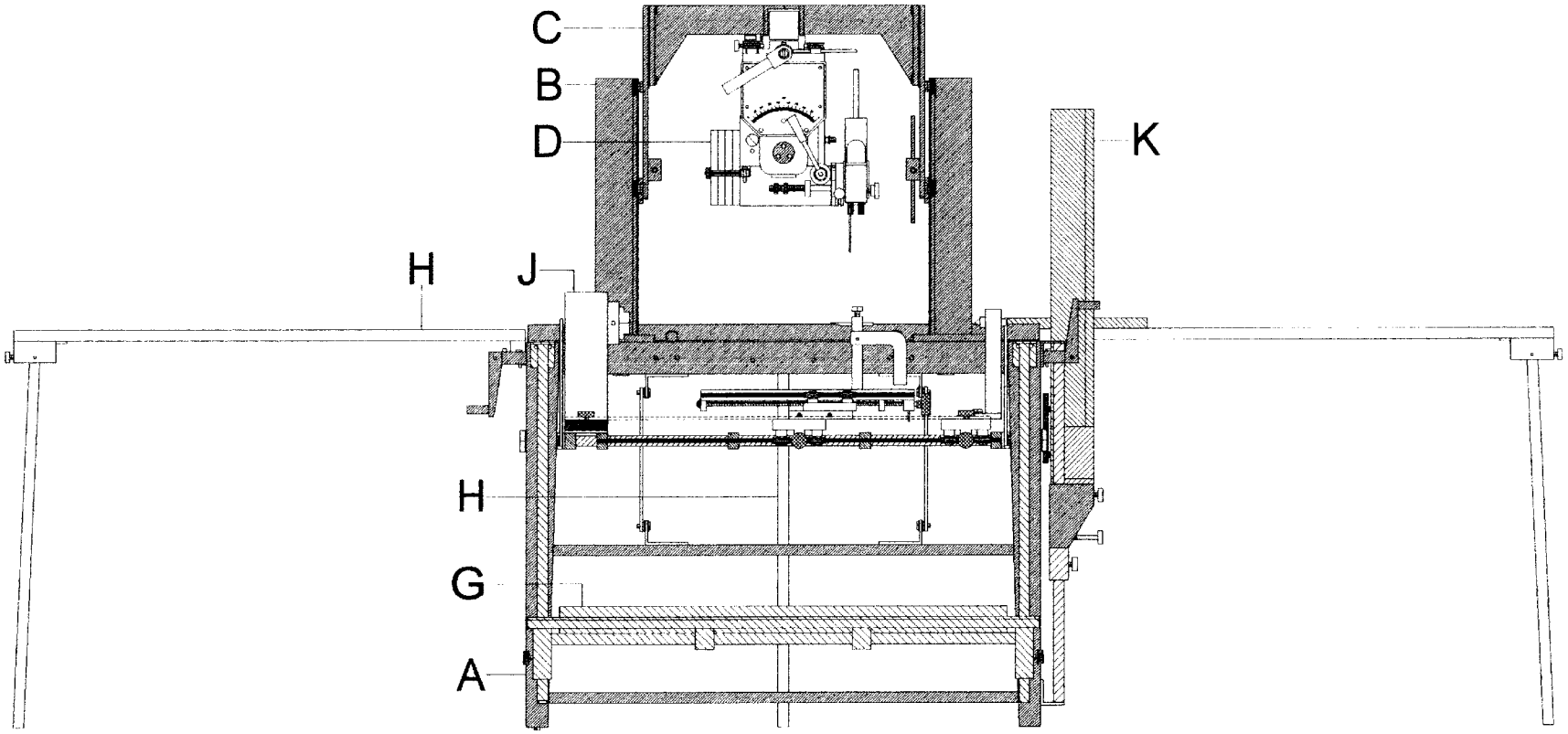
FIG. 2 is a rear perspective elevation view thereof showing the lathe therein swiveled up into the operative position and the band saw swiveled against the stand.
Figure 3:
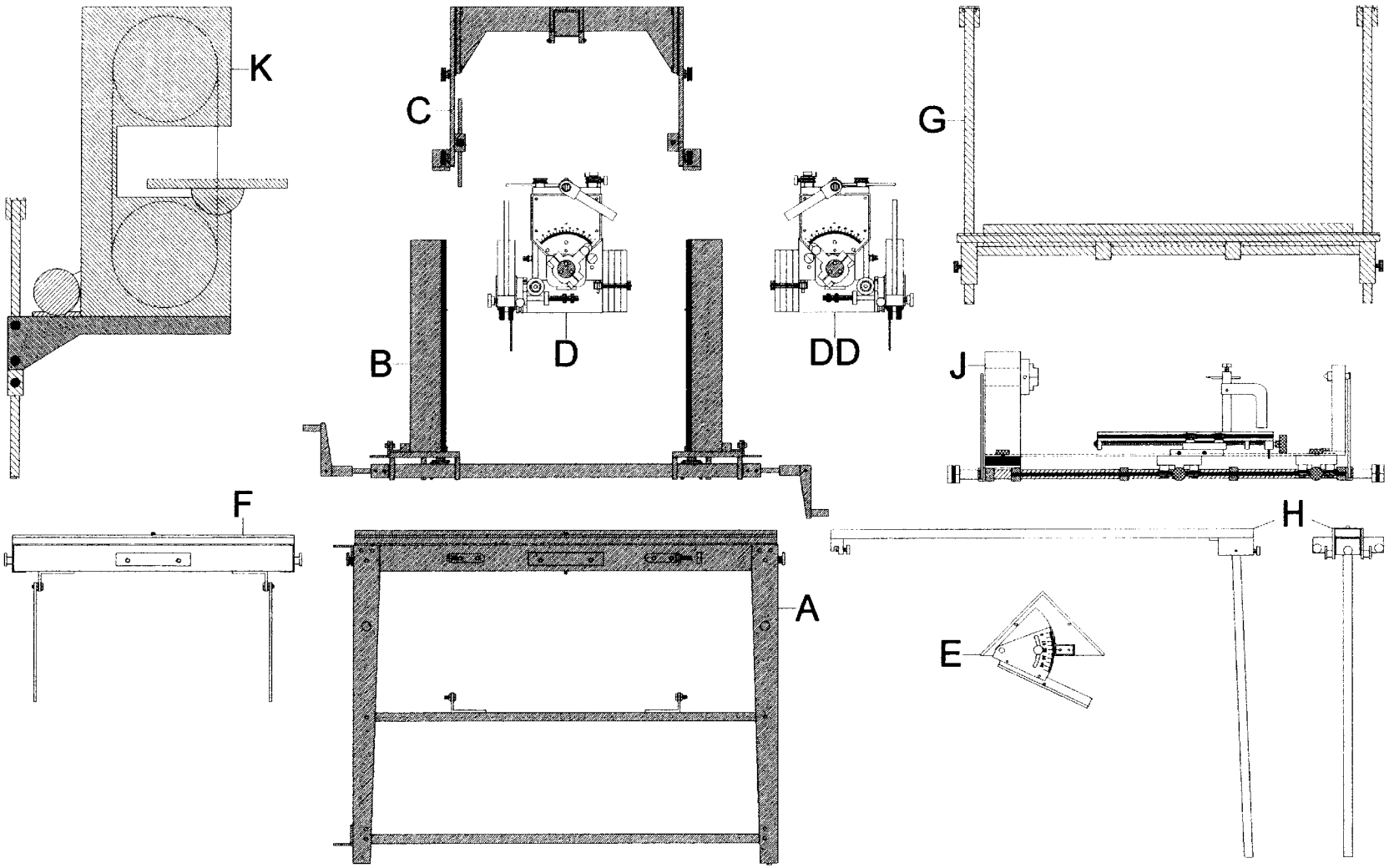
FIG. 3 is an exploded perspective elevation view showing the five major component parts therein, namely a stand, vertical tracks and crank assembly, an arm carriage assembly, a motor assembly and a miter gauge, and five major accessories, namely a drop-leaf, main work table front extension, an auxiliary rear table, outriggers, a lathe and a band saw, and the motor assembly reversed for left-hand use.
Figure 4:
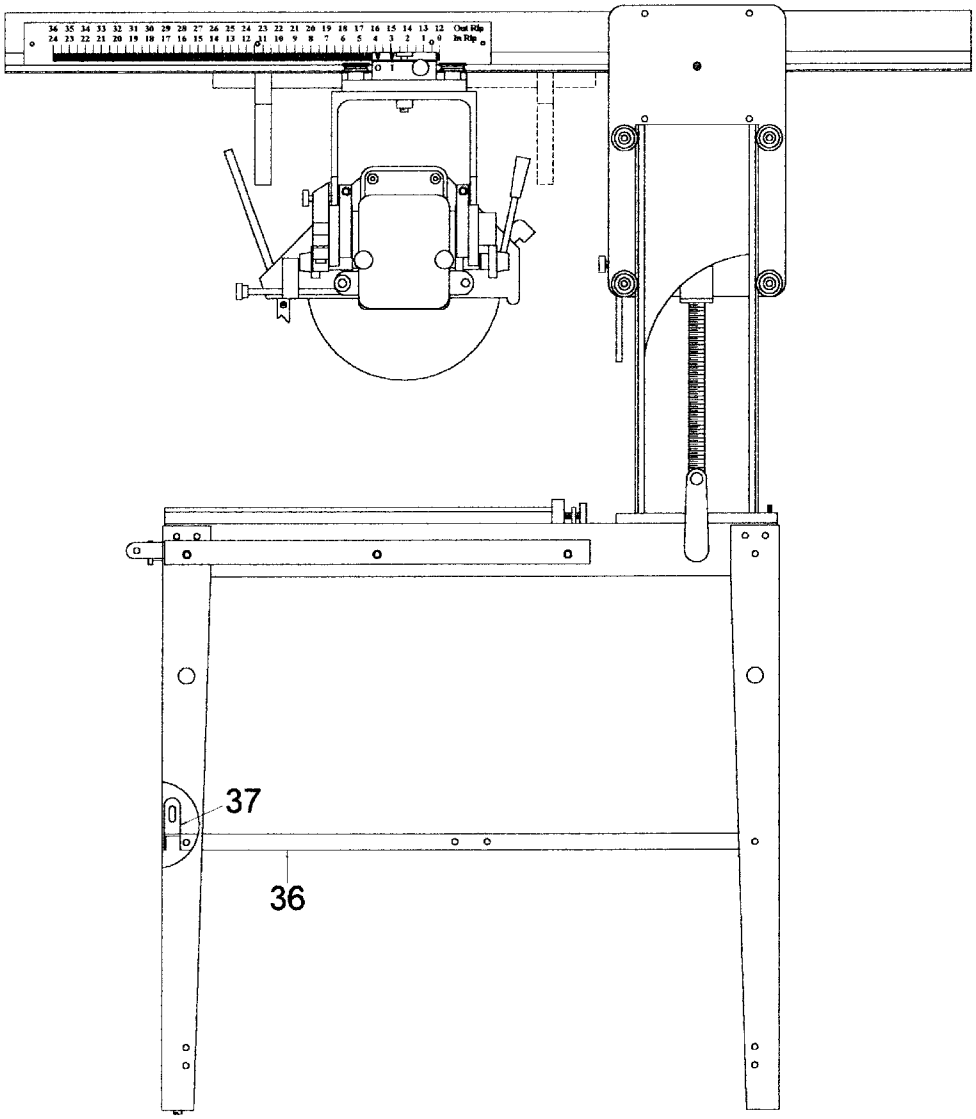
FIG. 4 is a right side perspective elevation view of the basic tool.
Figures 52, 53:
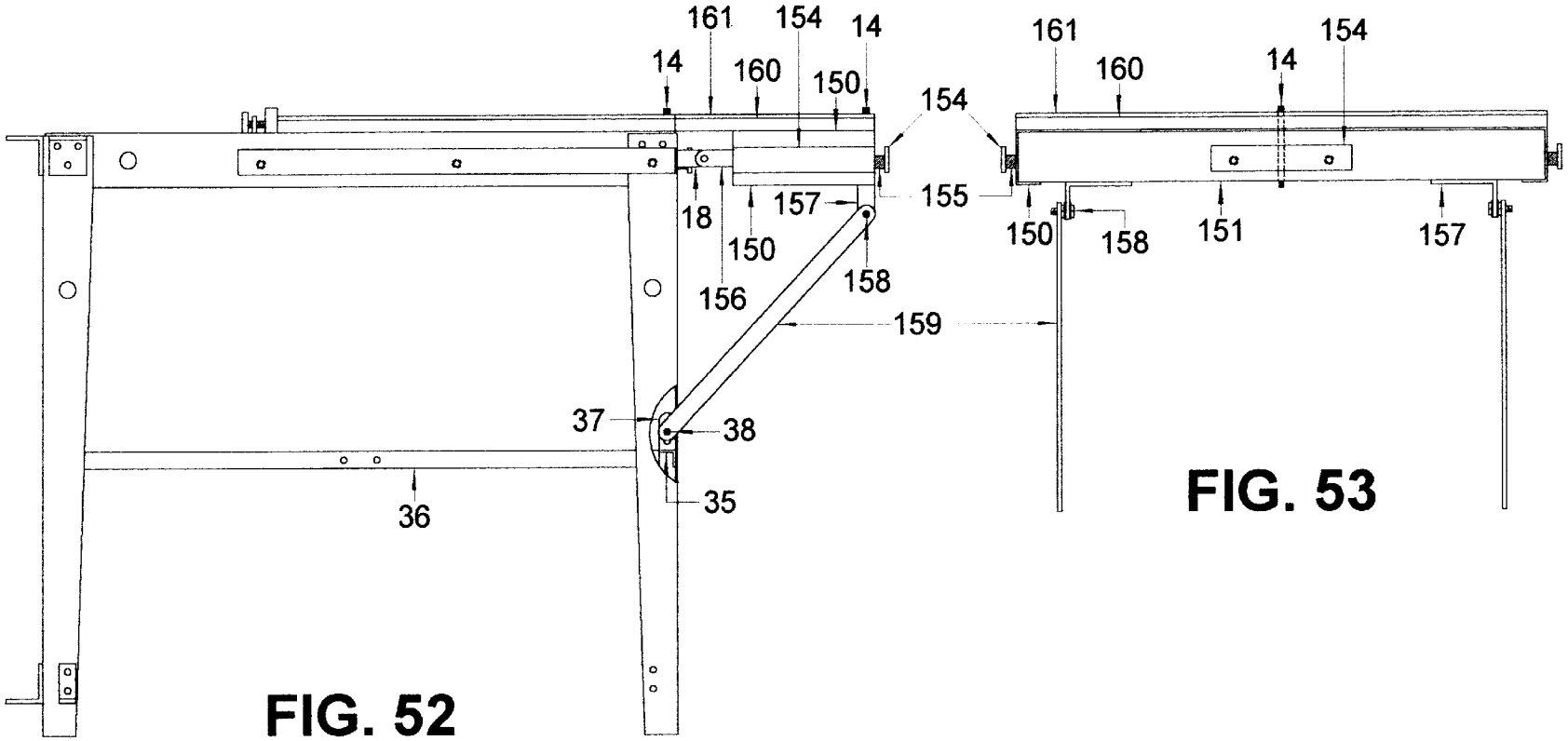
FIG. 52 is a side elevation view of the stand with the drop-leaf attached thereto.
FIG. 53 is a front elevation view of the drop-leaf with its support arms attached thereto.

Four braces reinforce the structure. The front and rear braces 35 are identical angle bars located at different heights, as shown in FIG. 10. The two identical, angle bar side braces 36 are shown in FIG. 4. Two brackets 37, each having a bolt 38 locked therein, are attached to the front brace 35, as shown FIG. 10. The bolts 38 serve as anchors for the arms of the drop-leaf F, as shown in FIG. 52. The two brackets 37 are slotted, as shown in FIG. 4, to permit the two bolts 38 to be adjusted vertically.

Figure 11:
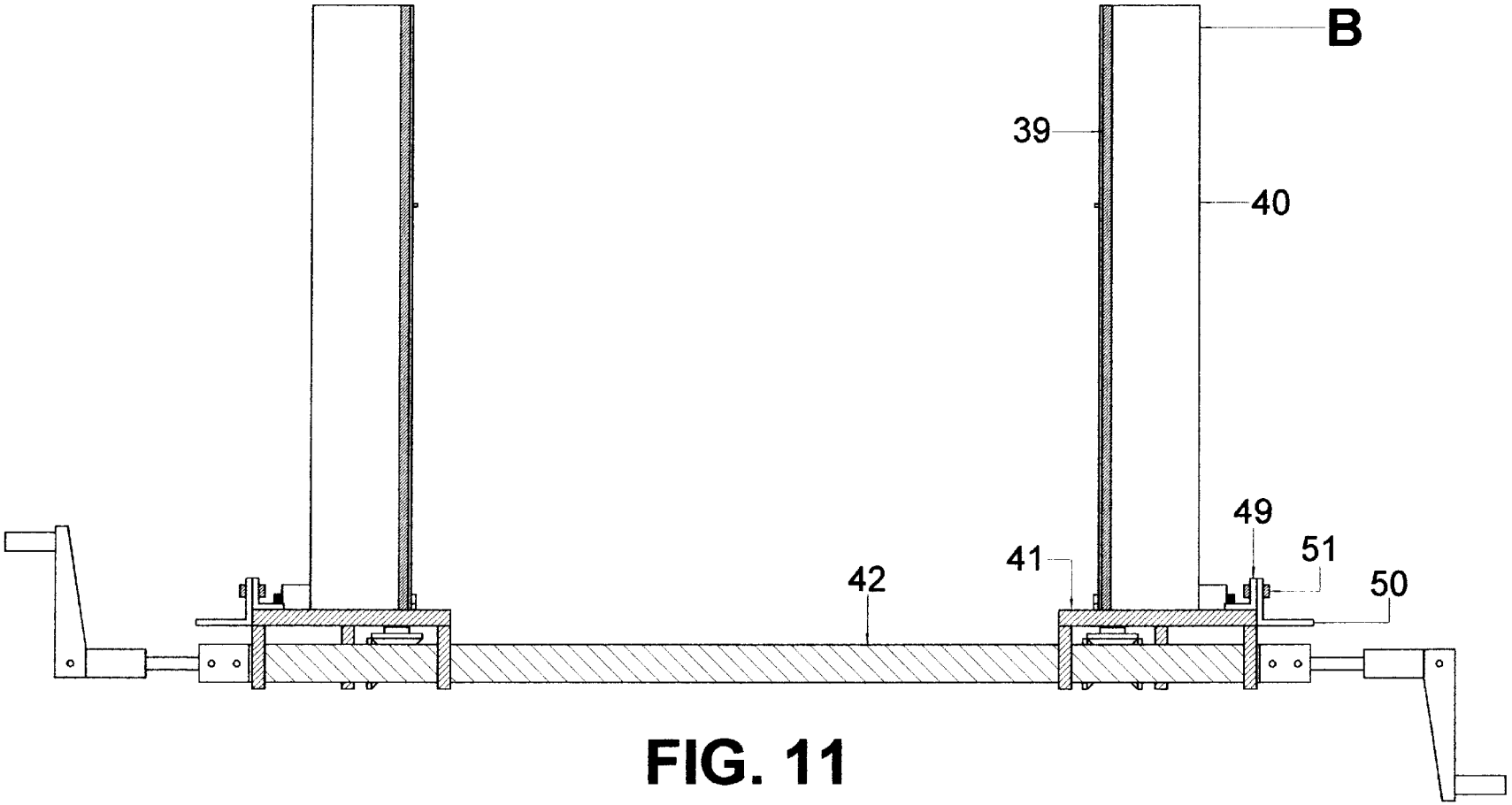
FIGS. 11 and 12 are front elevations of the vertical tracks and crank assembly.
Figure 12:
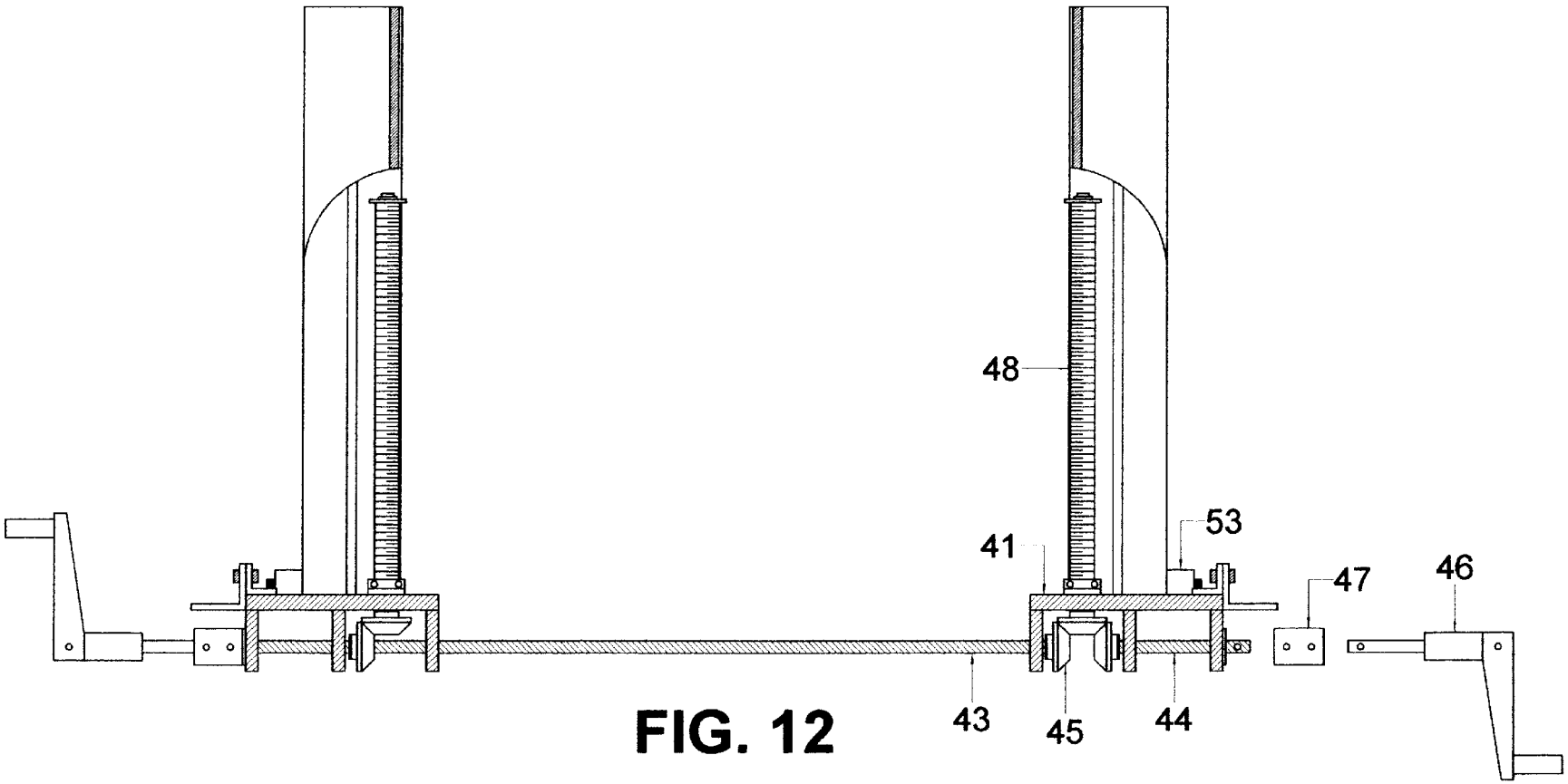
Figure 13:
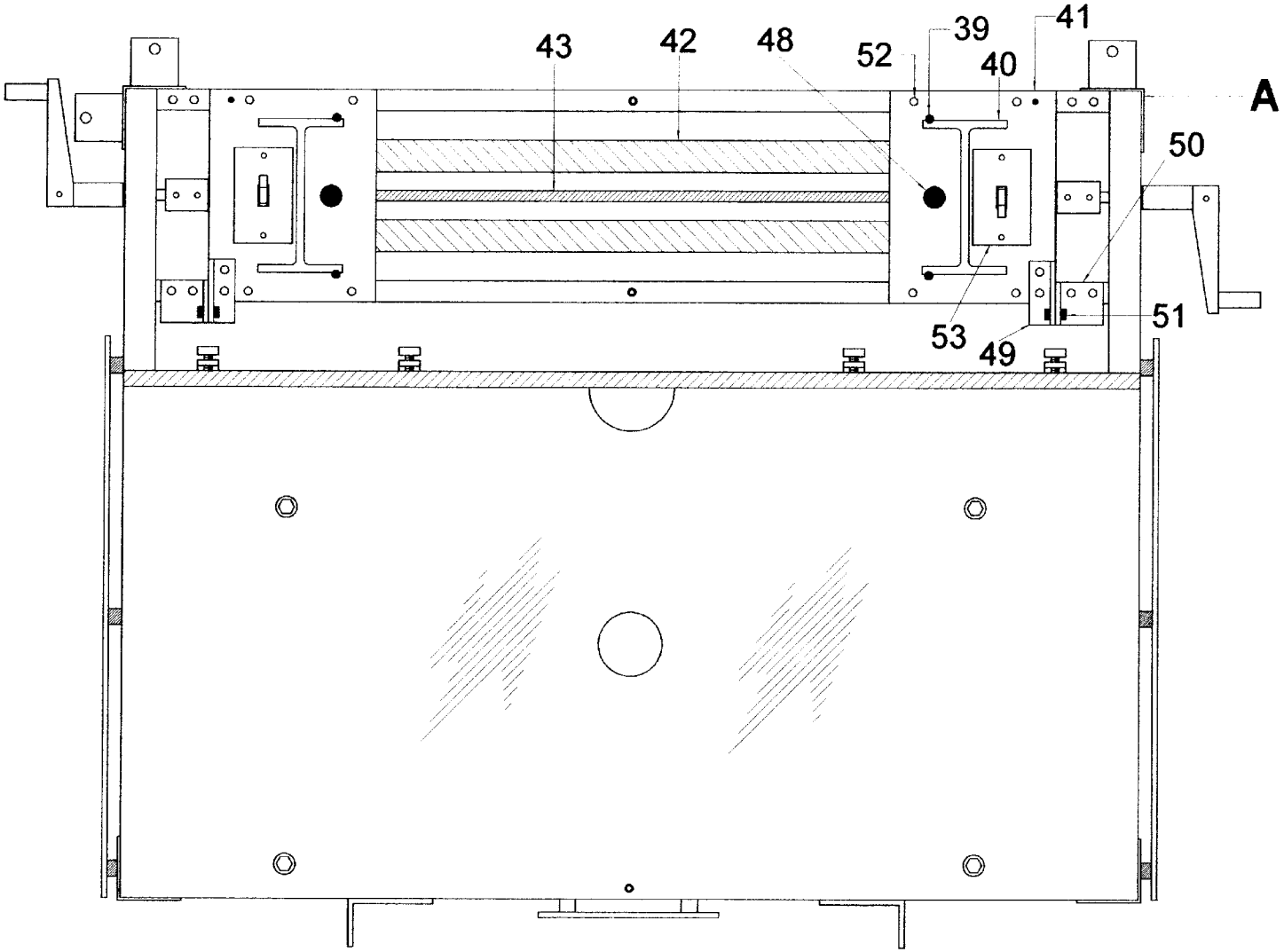
FIG. 13 is a top view showing the vertical tracks and crank assembly mounted on the stand.

As shown in FIGS. 11, 12 and 13, the vertical tracks and crank assembly B consists of four hardened track rods 39, connected to two I-shaped or H-shaped beams 40, mounted on a base composed of two M-shaped castings 41, connected by two rods or tubes 42, which pass through the two outer legs of each casting 41. Passing through all three legs of each casting 41 are a long crank rod 43 and a short crank rod 44. The long rod 43 has two identical bevel gears 45 attached thereto and the short rod has one identical gear 45. Two crank handles 46 are fastened to the long rod 43 and the short rod 44 by two set screws in each to two sleeves 47 which slide over the rods 43 and 44. Two additional bevel gears 45, connected one each to two identical elevating screws 48, mesh with the other three bevel gears 45, so that turning either of the two crank handles 46 rotates the two elevating screws 48 simultaneously.

Figure 5:
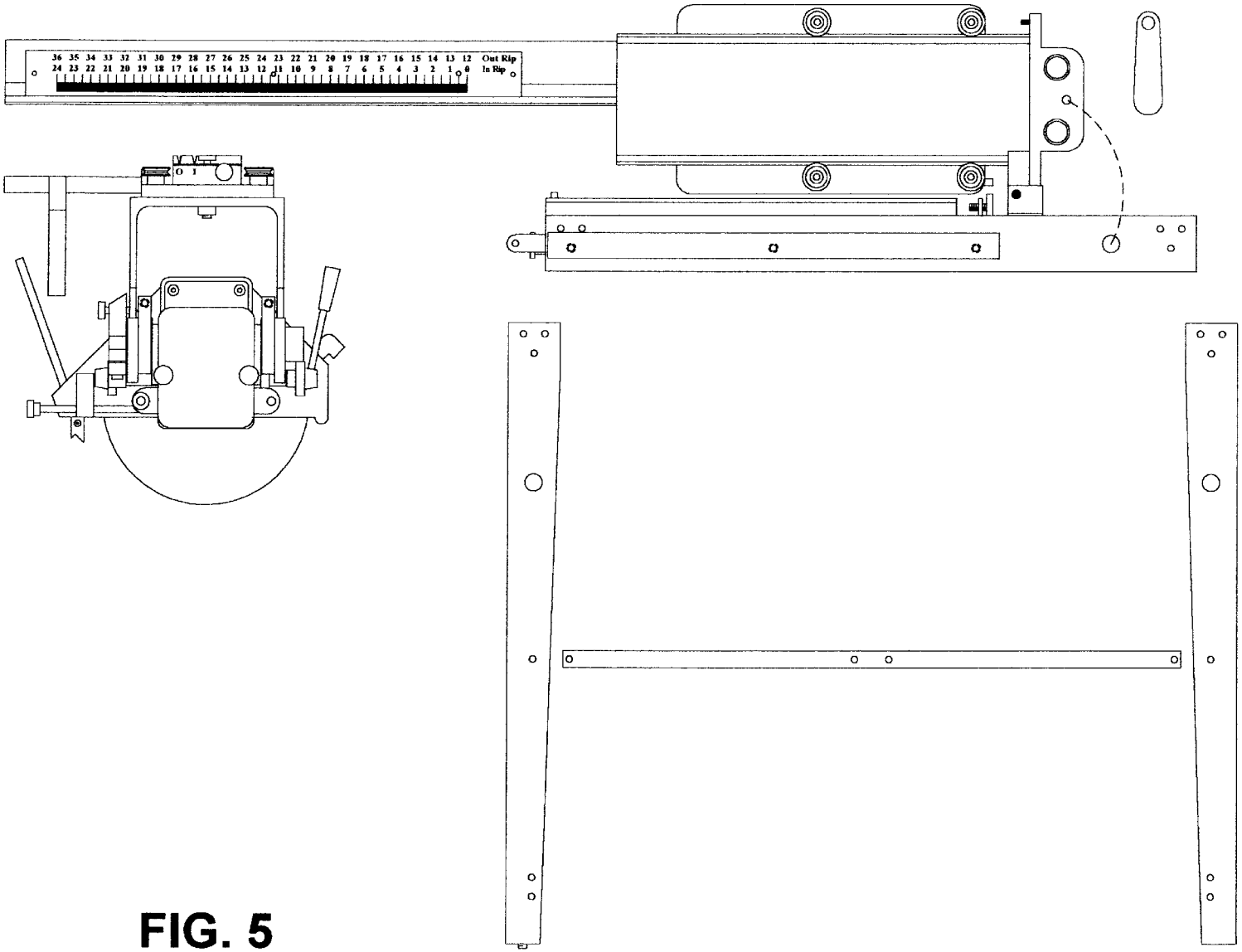
FIG. 5 is a right side perspective elevation view of the basic tool, showing it dismantled and folded for compact packaging and shipping purposes.

The vertical tracks and crank assembly B is attached to the stand A frame through two hinges, each composed of one angle bracket 49 and one angle bracket 50, connected through a pivot 51. The hinging permits the vertical tracks and crank assembly B to be folded, as shown in FIG. 5, for compact packaging and shipping purposes and it facilitates assembly once unpacked.

The vertical tracks and crank assembly is secured to the frame of the stand A through eight bolts inserted through the holes 52 in the M-shaped castings 41 and their matching holes in the frame of the stand A.

Two 3-way electrical switches 53, mounted one each on the faces of the two M-shaped castings 41, permit the tool to be activated or de-activated by the user standing at any position around the stand A.

Figure 14:
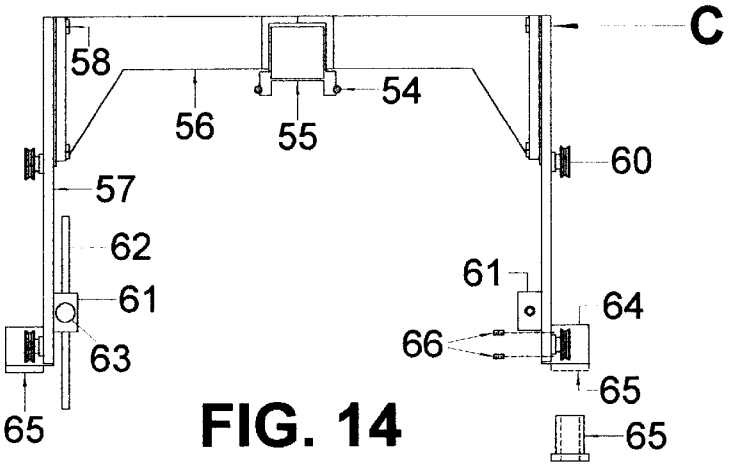
FIGS. 14 and 15 are front elevation views showing the arm carriages assembly positioned to engage with the vertical tracks and crank assembly.
Figure 16:
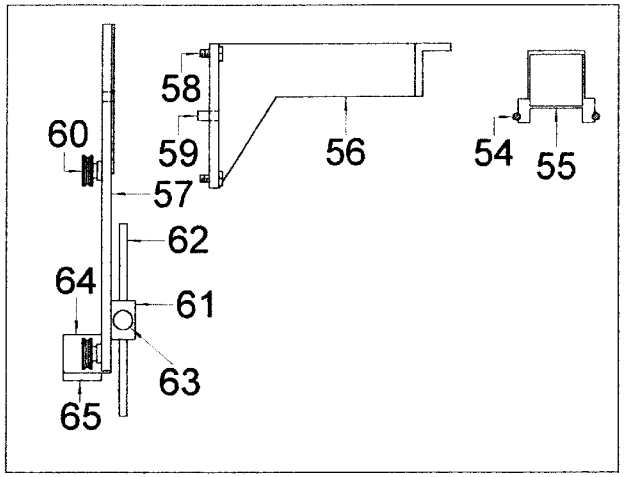
FIG. 16 is a partly exploded view of part of FIG. 14.
Figure 17:
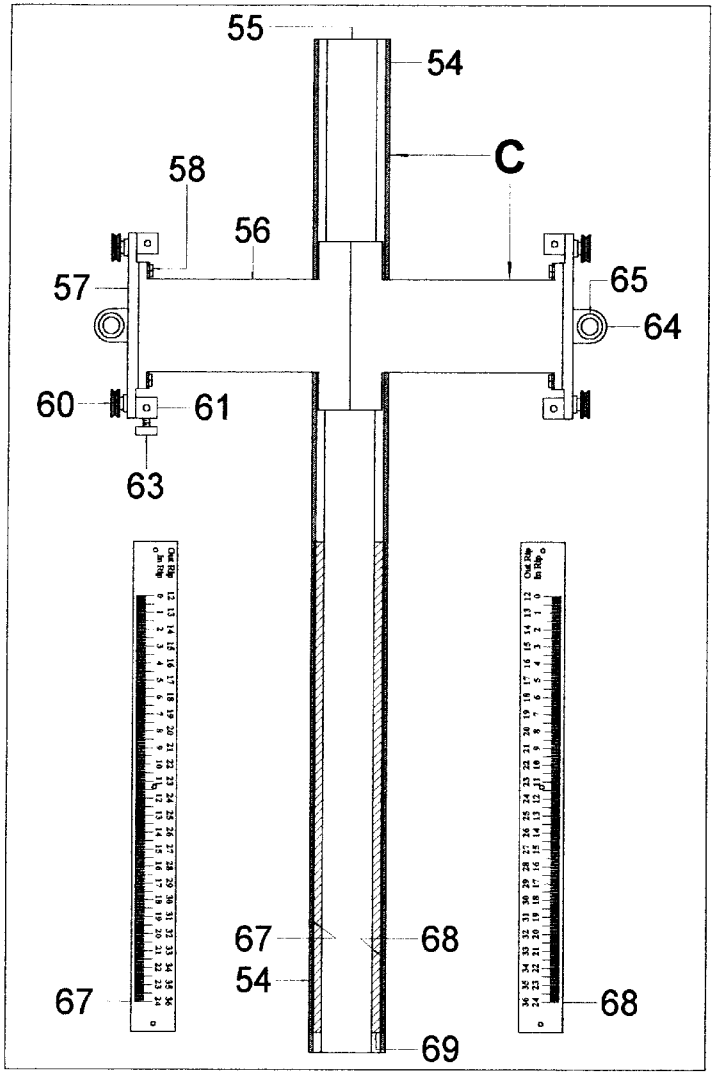
FIG. 17 is a top view of FIG. 14 showing also the left-hand and right-hand scales full face.

As shown in FIGS. 14, 16, and 17, the cantilever arm carriages assembly C consists of twin hardened track rods 54, fastened to a cantilever arm 55, which is attached to twin cantilevers 56, which are attached to twin carriages 57 by eight bolts 58, forming the cross shown in FIG. 17.

Two pivots 59, shown in FIG. 16, through the cantilevers 56 and the carriages 57 permit the cantilevers 56 and the arm 55 secured thereto to swivel on the carriages 57, with the minute amount of swivel necessary to align the arm being obtained by making the eight holes in the cantilevers for the eight bolts 58 slightly larger than necessary. Removing the eight bolts 58 permits the arm 55 to be swiveled upright and the combined B and C assemblies folded, as shown in FIG. 5.

Each carriage 57 has four Vee bearings 60 attached thereto. Two hubs 61 on each carriage 57 are bored to allow any one of them to accommodate a vertically movable stop rod 62, which is lockable at any desired vertical position in any selected hub 61 through a hand wheel screw 63, threaded into a tapped hole in each hub 61. Another hub 64 on each carriage 57 is bored to accommodate an internally threaded flanged bushing 65, which is secured in the hub 64 through two set screws 66.

Figure 15:
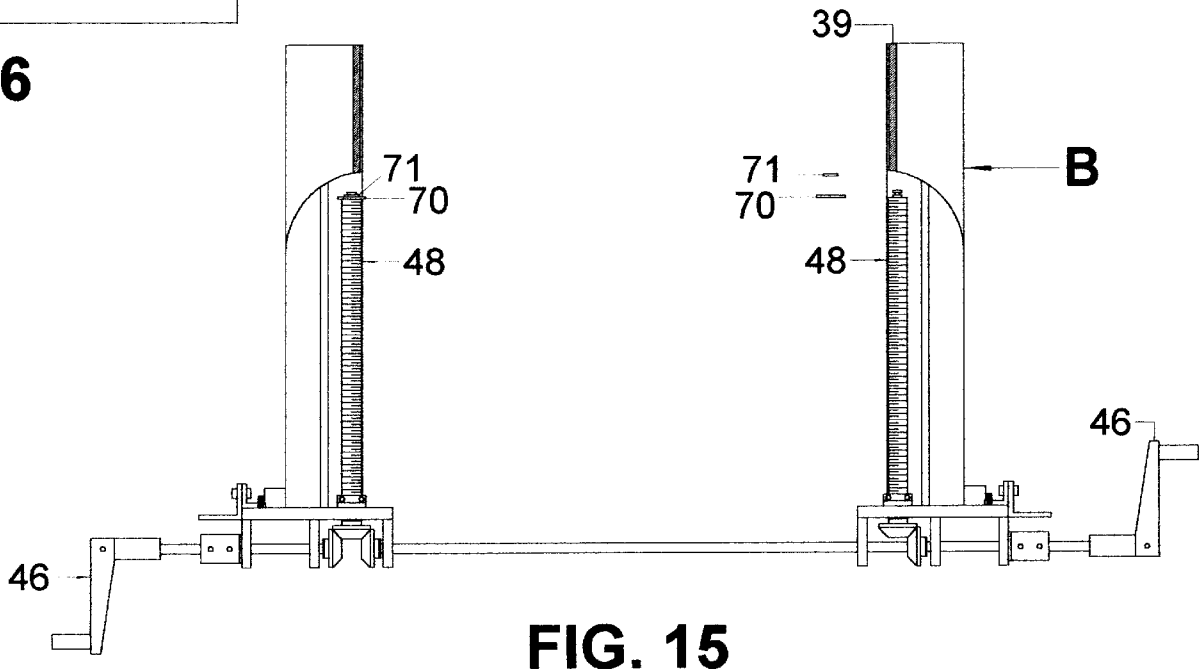

The arm carriages assembly C engages with the vertical tracks and crank assembly B shown in FIG. 15, by engaging the Vee bearings 60 with the track rods 39 and engaging the internally threaded flanged bushings 65 with the elevating screws 48. Turning either crank handle 46 rotates the elevating screws 48, thereby raising or lowering the arm carriages assembly C on the vertical tracks and crank assembly B. A washer 70 and a C-clip 71 on the end of each elevating screw 48 prevent the flanged bushings 65 from unthreading from the elevating screws 48.

Figure 18:
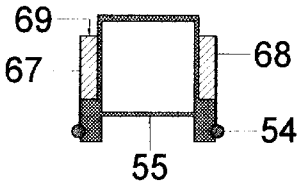
FIG. 18 is an end view of the arm showing the rip scales and fillers.

As shown in FIG. 18, the left-hand and right-hand rip scales 67 and 68, shown in FIG. 17, are secured to the sides of the arm 55, with fillers 69 between the arm and the scales, to eliminate dust-collecting channels. For the purpose of clarity, the scales 67 and 68 and the fillers 69 are not shown in FIGS. 14 and 16.

Figure 22:
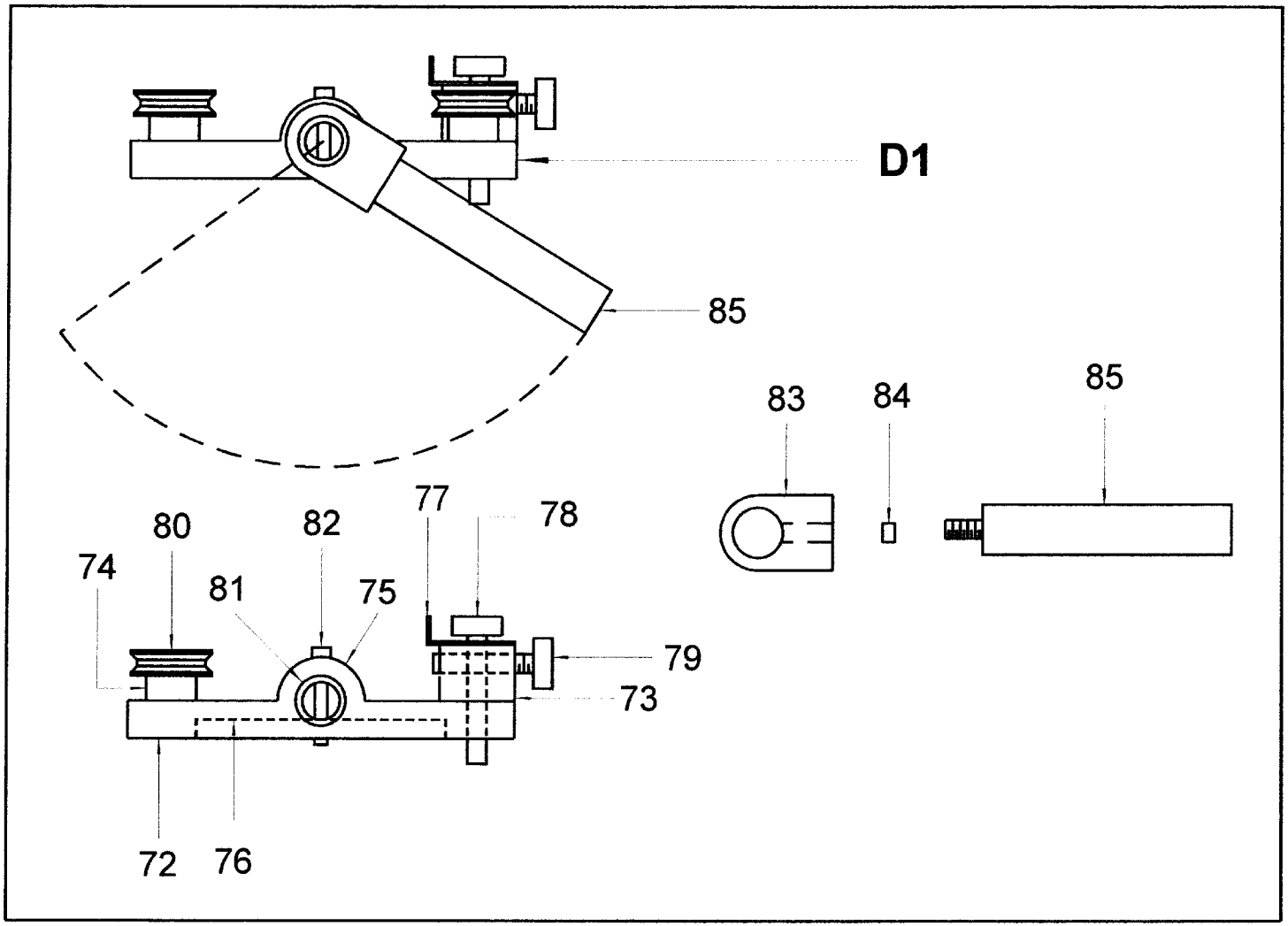
FIGS. 22 and 23 are front elevation views and top views respectively of the carriage part of the motor assembly.
Figure 23:
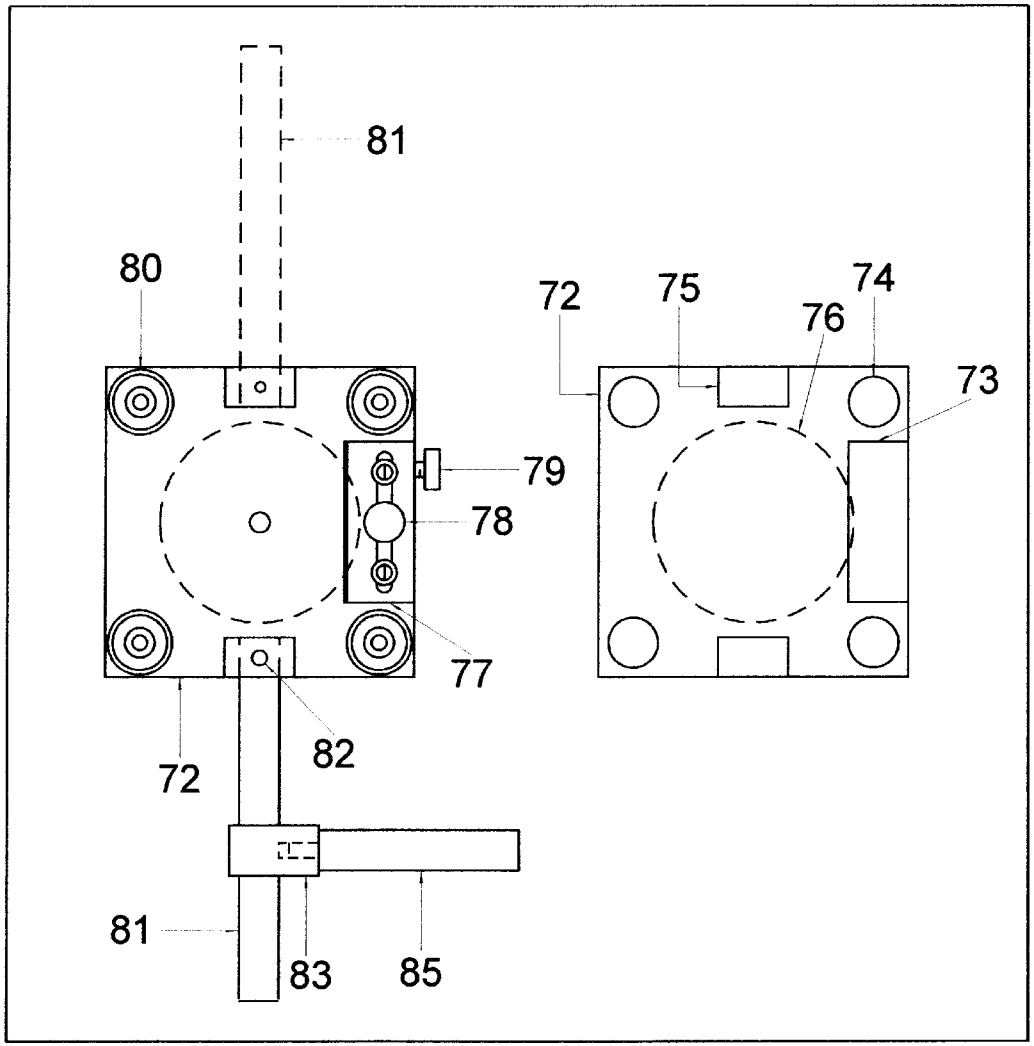

As shown in FIGS. 22 and 23, the carriage D1 of the motor assembly D, consists of a plate 72, with one hub 73, four identical hubs 74 and two identical hubs 75 on the upper surface and a circular recess 76 in the lower surface. In common with radial arm saws, the hub 73 has an adjustable rip scale index pointer 77 mounted thereon, a yoke engaging plunger 78 passing through it and a hand wheel lock screw 79 threaded into it. Also in common with radial arm saws, each of the hubs 74 has a Vee bearing 80 mounted thereon, the whole providing a motor carriage able to roll along the full length of an arm with tracks and be locked along the arm at any position desired.

The addition of the two hubs 75 by the present invention provides two sockets into either of which a motor assembly handle anchoring rod or tube 81 is inserted and secured with a drop-in/lift-out pin 82, with the choice of socket being governed by the left-hand or right-hand use of the tool.

The motor assembly D handle, which can swivel and slide laterally on the rod or tube 81, consists of a collar 83, a soft pad 84 and a grip 85 which threads into the collar 83. Tightening or loosening the grip 85 locks or releases the collar 83 on the rod or tube 81.

Unlike radial arm saws where the handle is attached to and swivels with the yoke, the handle of the present invention is attached to the carriage, which does not swivel, thereby keeping the handle in the same position constantly.

Figure 20:
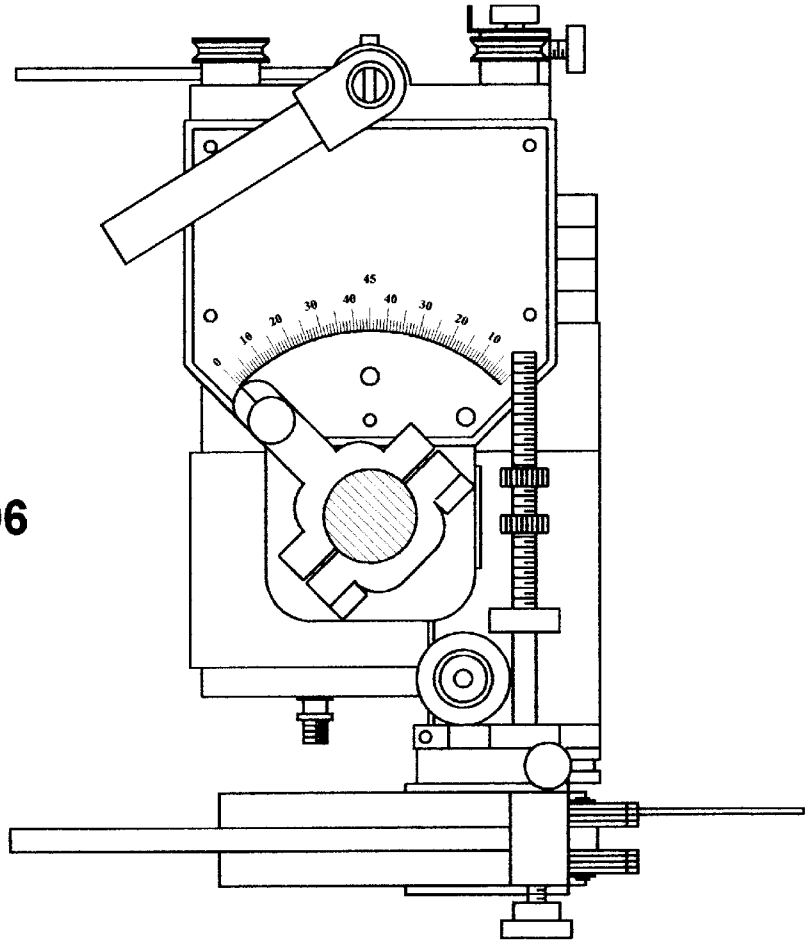
FIG. 20 is a side elevation view showing the motor assembly at the 0 degree vertical position.
Figure 19:
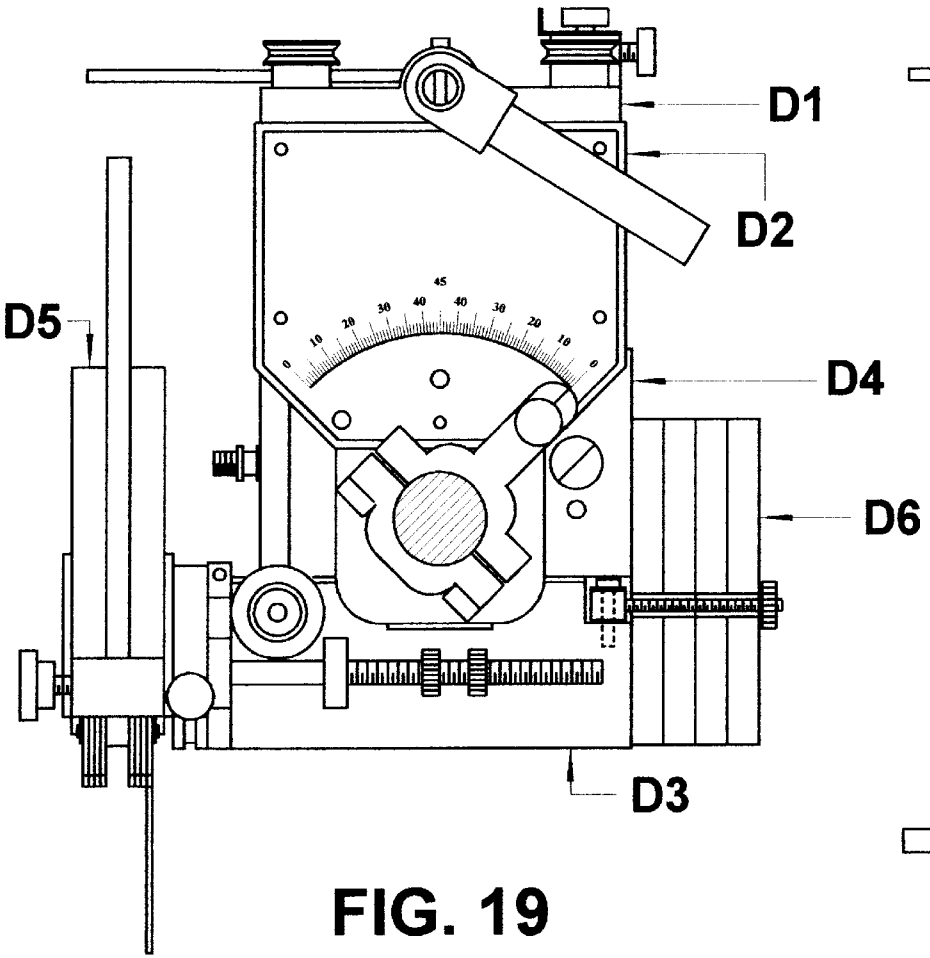
FIG. 19 is a side elevation view showing the motor assembly at the O degree horizontal position.
Figure 21:
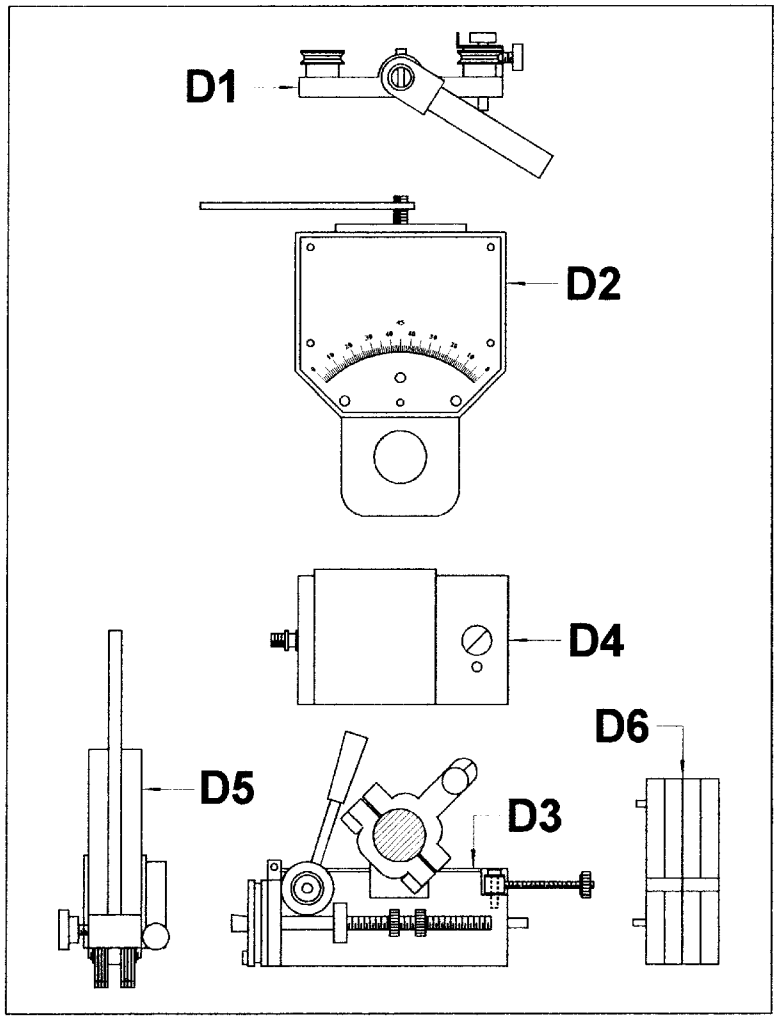
FIG. 21 is an exploded view of FIG. 19 showing the composition of the motor assembly.

As shown in FIGS. 19 and 20, swiveling the handle to the left or to the right provides a clear view of the bevel index scales located on both sides of the yoke D2.

Figure 24:
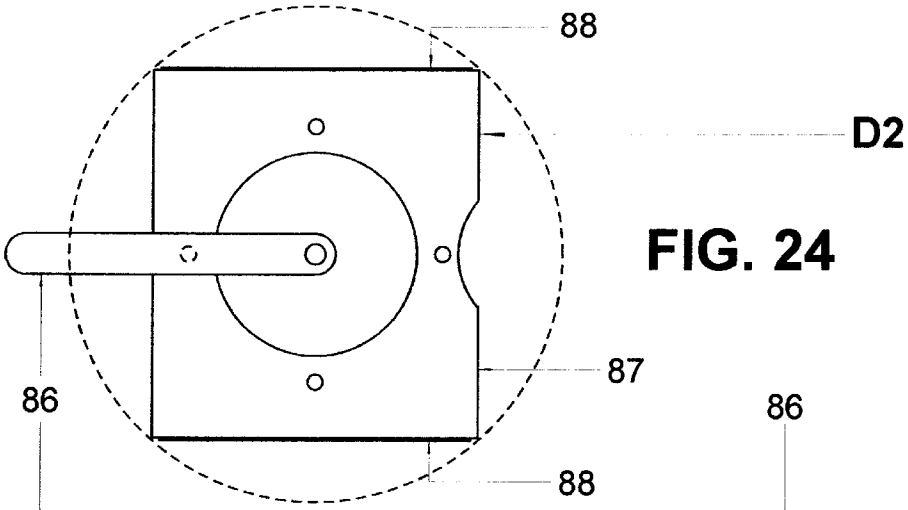
FIGS. 24, 25 and 26 are a top view, a side elevation view and a front elevation view respectively of the yoke part of the motor assembly.
Figure 26:
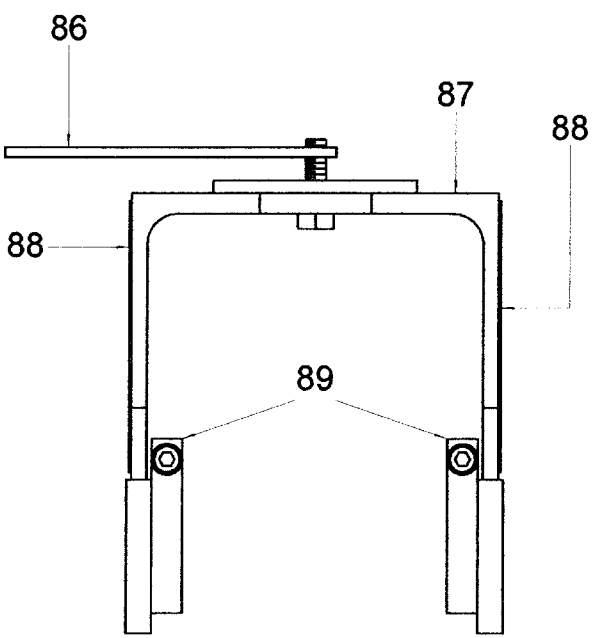
Figure 27:
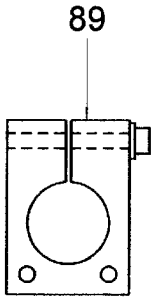
FIG. 27 is a front elevation view of the trunnion lock, two of which form part of the yoke.
Figure 25:
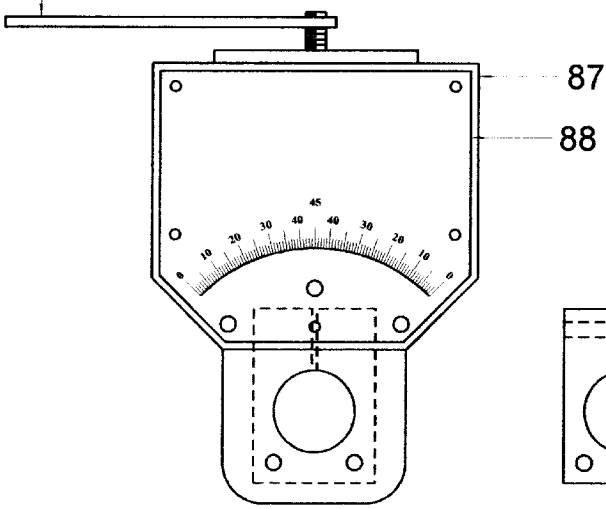

As shown in FIGS. 24, 25 and 26, the yoke D2 of the motor assembly D is typical of yokes common to radial arm saws. However, the present invention locates the yoke lock lever 86 outside the yoke 87, permitting the yoke 87 to swivel throughout 360° while the lock lever 86 remains in the same position.

Easy-to-read half degree markings on the bevel index scale 88 are rendered possible by the present invention by reducing to 90° the 180° scale common to redial arm saws and by locating the index scale at the widest part of the yoke, instead of at the narrowest part.

Two index scales 88 and two trunnion locks 89 are used instead of the single scale and single lock common to radial arm saws, because the motor assembly of the present invention is reversible for left-hand, or right-hand use.

Figure 28:
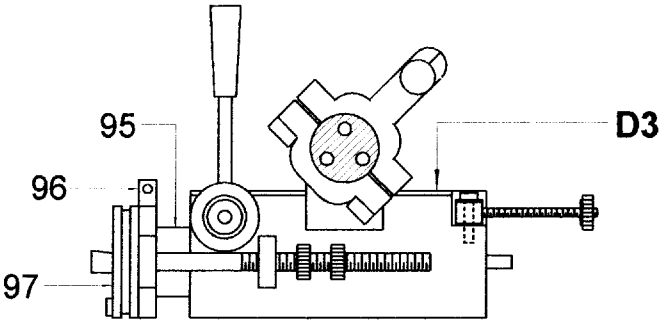
FIG. 28 is a side elevation view of the quill assembly part of the motor assembly.
Figure 29:
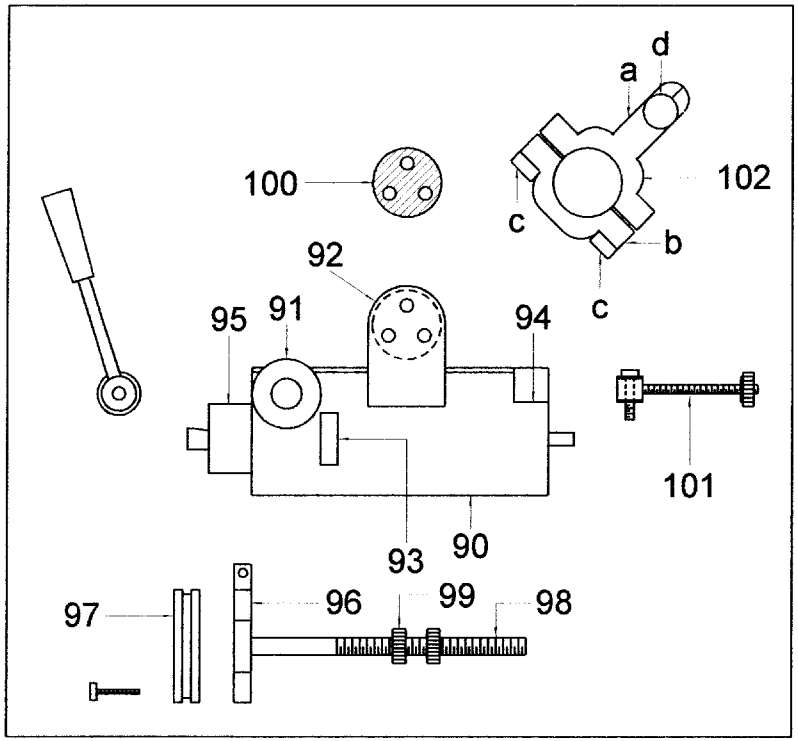
FIG. 29 is an exploded view of FIG. 28.
Figure 30:
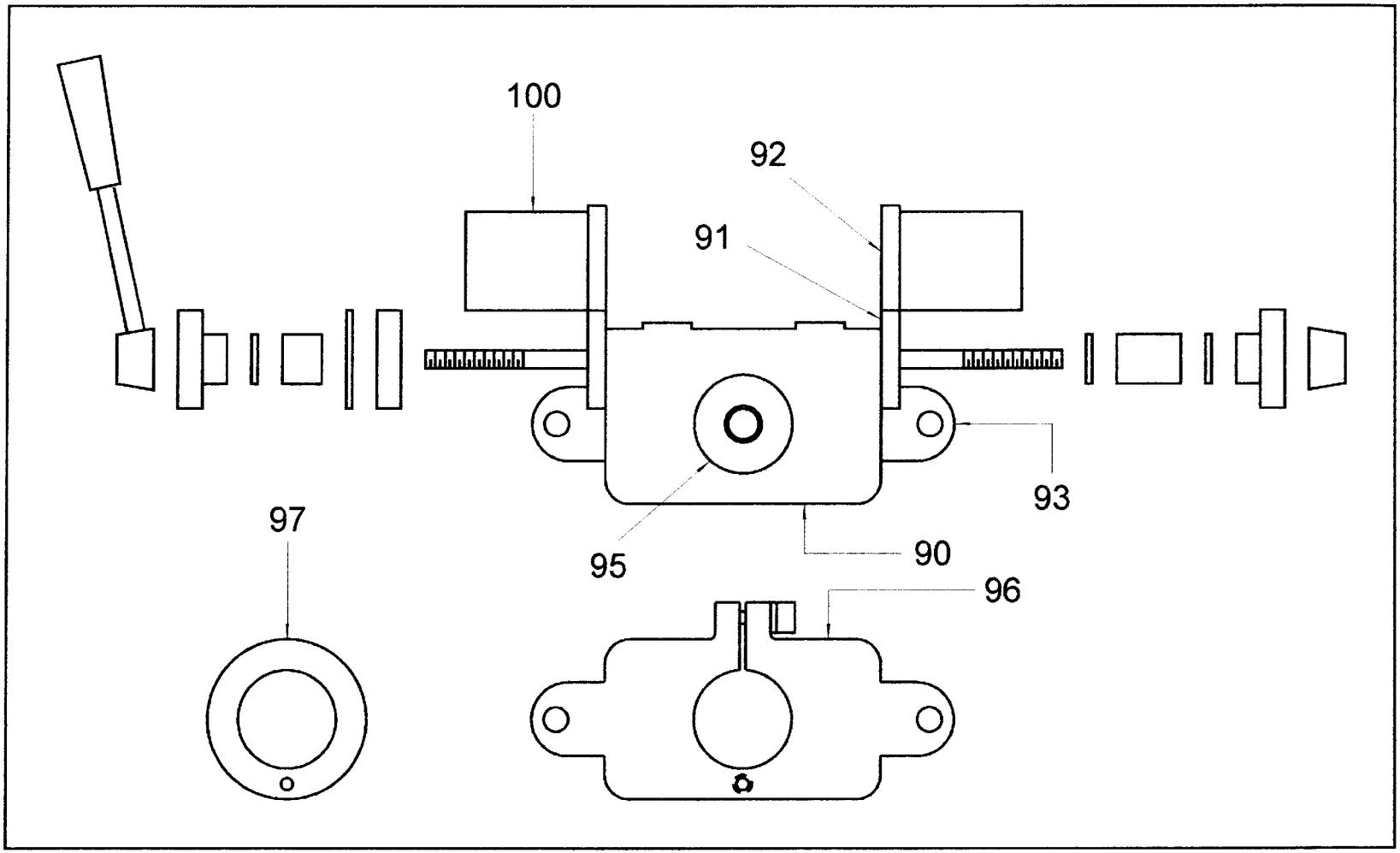
FIG. 30 is an exploded front elevation view of some of the parts shown in FIG. 29.
Figure 31:
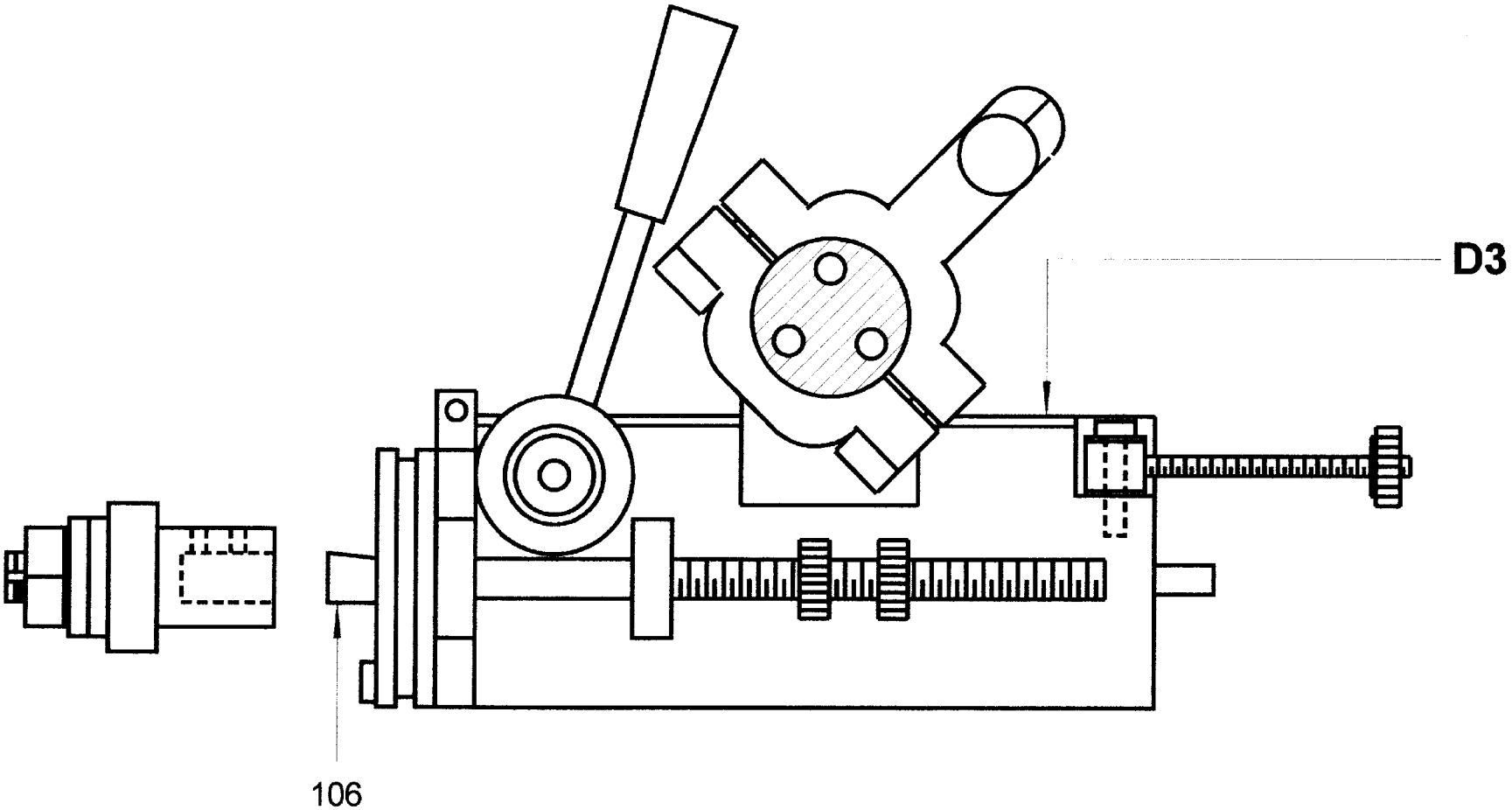
FIG. 31 is a side elevation view of the quill assembly showing also the tool arbor which attaches to its spindle.

As shown in FIGS. 28 and 29, the quill assembly D3 of the motor assembly D consists of a frame 90, cast with two identical disks 91, two identical arms 92 and two identical wings 93 thereon and two identical notches 94 therein. The frame 90 is bored to accommodate a quill 95, around one end of which are secured a collar 96 and a saw guard cradle 97 bolted together. Two identical threaded stop rods 98, with two nuts 99 on either but not both of the stop rods 98 are secured to the collar 96 and pass through the wings 93. The choice of which stop rod 98 bears the nuts 99 is governed by the left-hand or right-hand use of the present invention. Two identical trunnions 100 are secured to the arm 92 and two identical grommet bolts 101 with nuts are secured in the notches 94.

A bevel index pointer 102, which serves also to square the circular saw blade at 90° with the work table, slips over either trunnion 100 and is locked thereon, after the saw blade is squared with the table. The bevel index pointer 102 consists of an upper part "a" and a lower part "b", connected by two bolts "c". A typical radial arm saw plunger "d" is located in the upper part "a". The choice of which trunnion 100 on which to locate the bevel index point 102 is governed by the left-hand or right-hand use of the present invention.

To enable a long extendible spindle to be housed in limited space, the present invention reverses the mobility of two of the components which make spindle travel possible.

Figure 32:
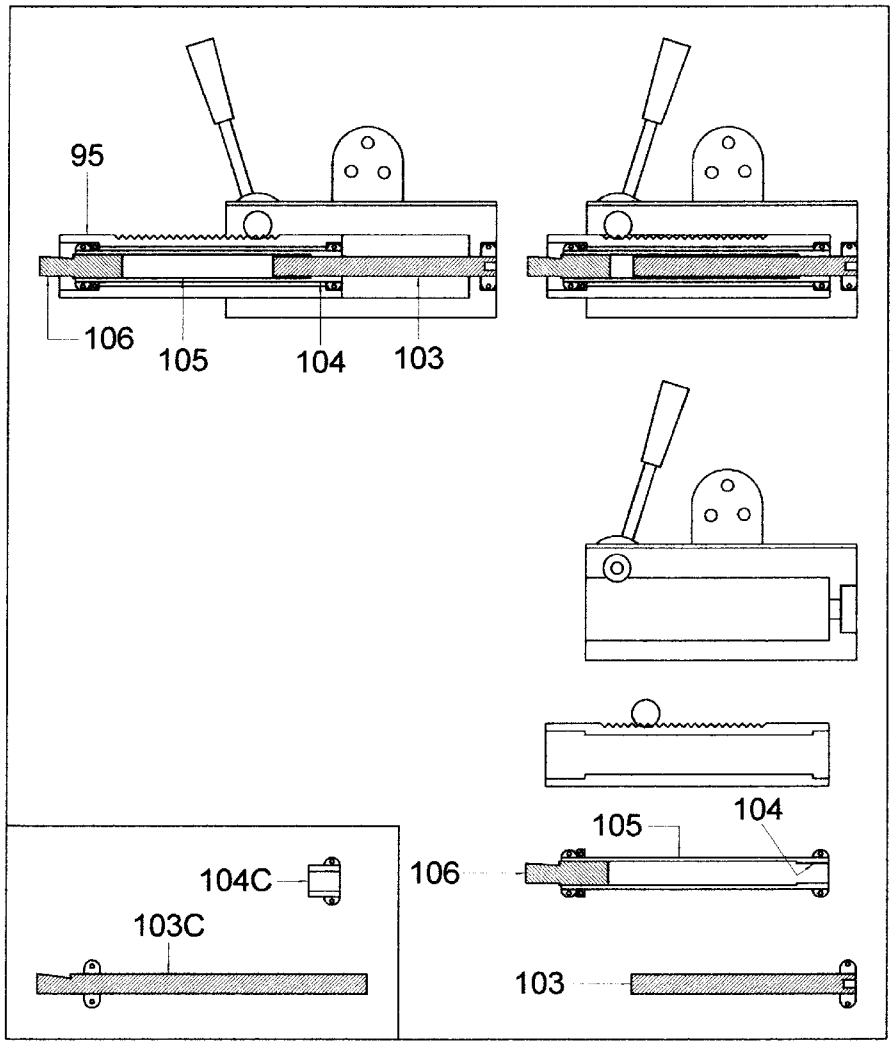
FIG. 32 is a cross section illustration showing the quill assembly with the quill extended and retracted, its components and how its extendible spindle mechanism differs from that of conventional drill presses.

As shown in the inset in FIG. 32, the conventional method uses a mobile keyed, splined or square shaft 103*c* which travels through a stationary mating socket 104*c*.

Reversing the principle of the conventional method is accomplished by the present invention by broaching a mating socket 104 in one end of a counterbored tube 105 and inserting a spindle tip 106 in the other end of the tube 105. In the conventional method, the tip 106 is part of the shaft 103*c*. The stationary shaft 103 used in the present invention is notched at the radial bearing end, to accommodate the tang of a gear box.

Figure 33:
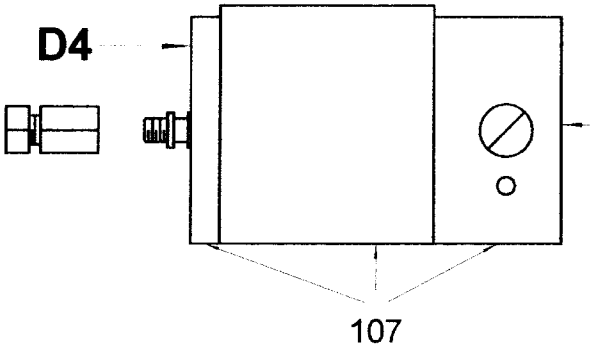
FIG. 33 is a side elevation view of the exterior of part of the motor assembly showing also the router chuck which attaches to the threaded end of the armature spindle.
Figure 34:
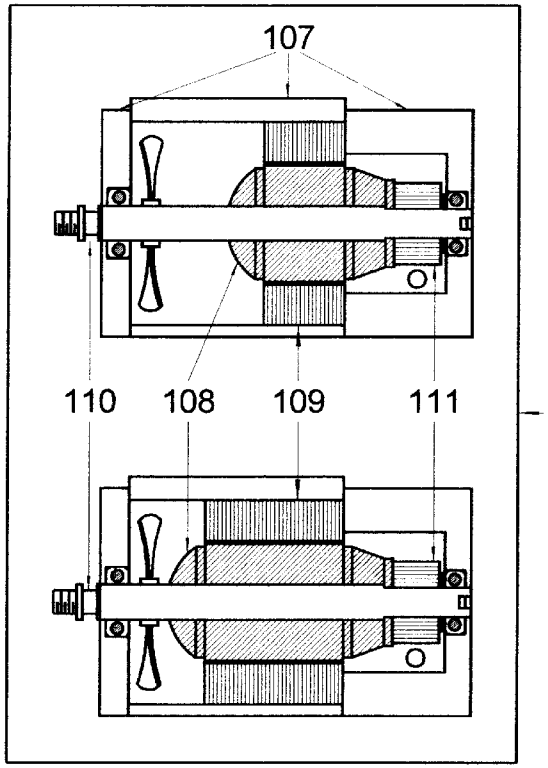
FIG. 34 is a cross section illustration showing a one-size motor frame fitted with armatures and fields of different horsepower.

As shown in FIGS. 33 and 34, the motor D4 of the motor assembly D consists of a 3-piece frame 107, an armature 108 and a field 109. The armature shaft 110 is threaded at one end, to accommodate a router chuck, and notched at the other end to accommodate the tang of a gear box.

By retaining a constant length armature shaft 110 and a constant size commutator 111, the present invention provides optional horsepower in a one-size frame through armatures and fields of different stack heights or lengths.

Figure 36:
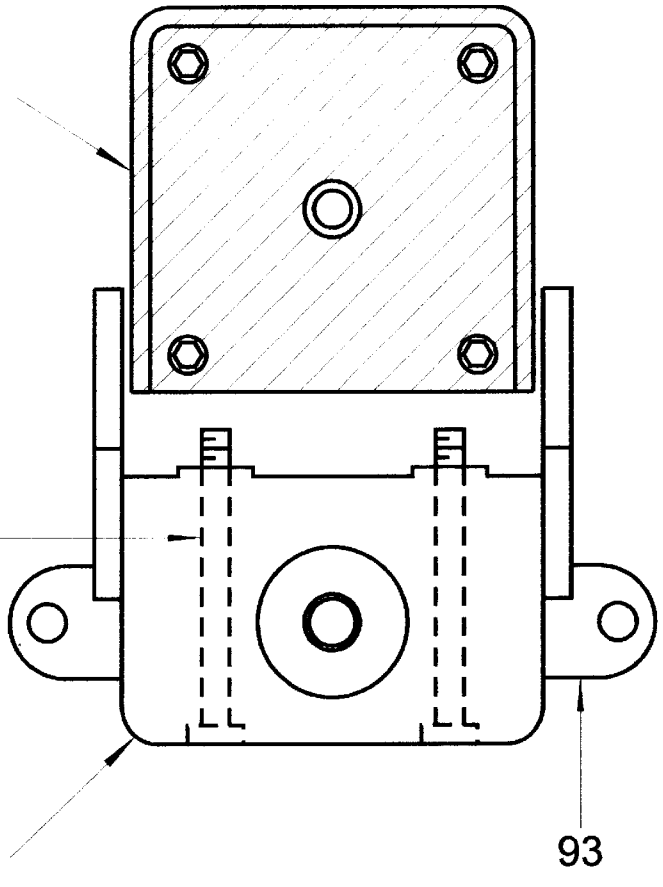
FIGS. 35 and 36 are side and front elevation views respectively showing how the motor and the quill assembly are aligned and connected.
Figure 35:
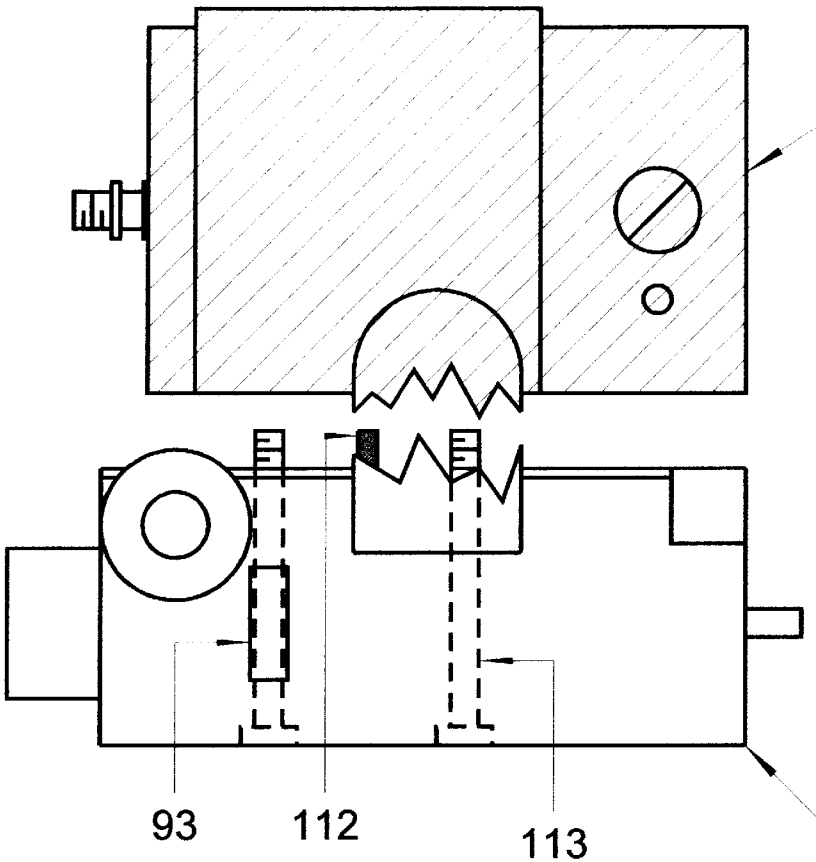
Figure 37:
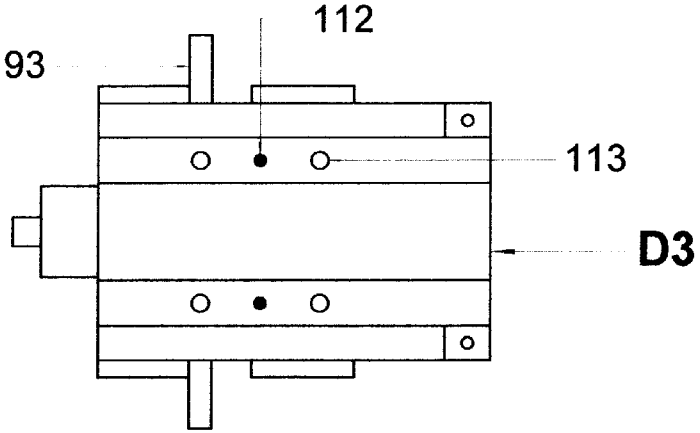
FIG. 37 is a top view of the quill assembly showing the position of the two dowels and four bolts which align it with and secure it to the motor.

As shown in FIGS. 35 and 36, the quill assembly D3 and the motor D4 are aligned and connected through the use of two alignment dowels 112 and four bolts 113, located as shown also in FIG. 37. That makes it possible for a failed motor to be replace quickly and easily with an inexpensive spare motor, without having to remove and transport or ship the entire motor assembly, complete with yoke and carriage, for servicing. The wing 93 is numbered in FIG. 35, to clarify what the solid line rectangle represents.

Figure 38:
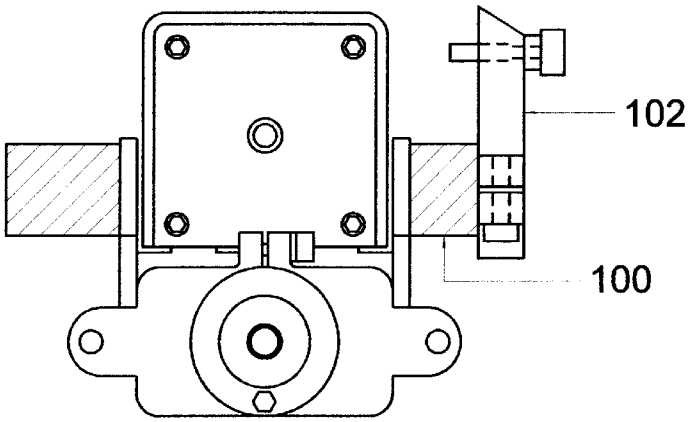
FIG. 38 is a front elevation view of the motor and the complete quill assembly connected.
Figure 39:
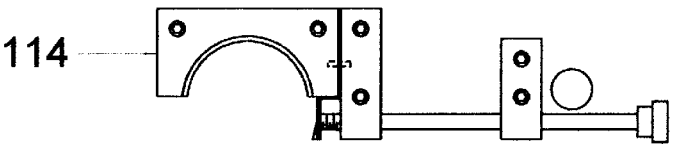
FIG. 39 is a side elevation view of the lock mechanism of the circular saw guard of the motor assembly.
Figure 40:
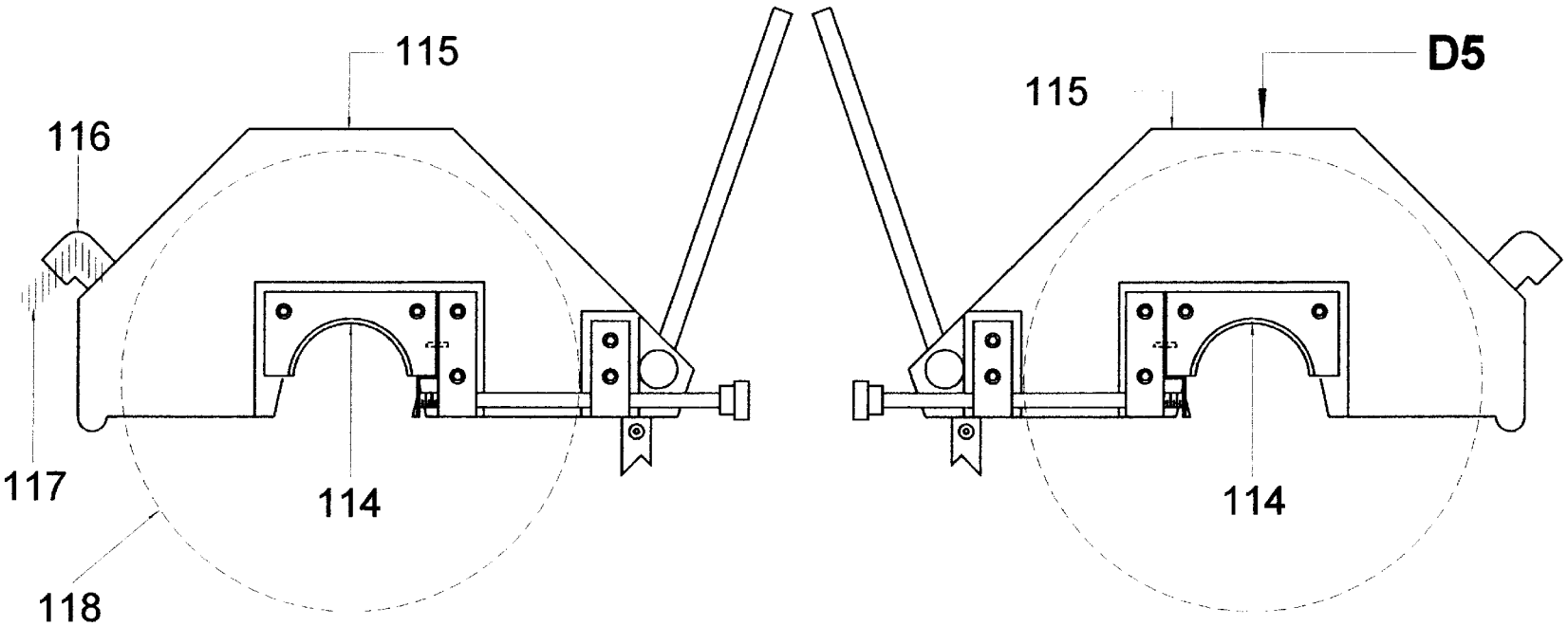
FIGS. 40, 41 and 42 are left-hand and right-hand pairs of side and front elevation views and bottom views respectively of the circular saw guard showing how the lock shown in FIG. 39 may be mounted on either side of the guard, to reverse it for left-hand or right-hand use.
Figure 42:
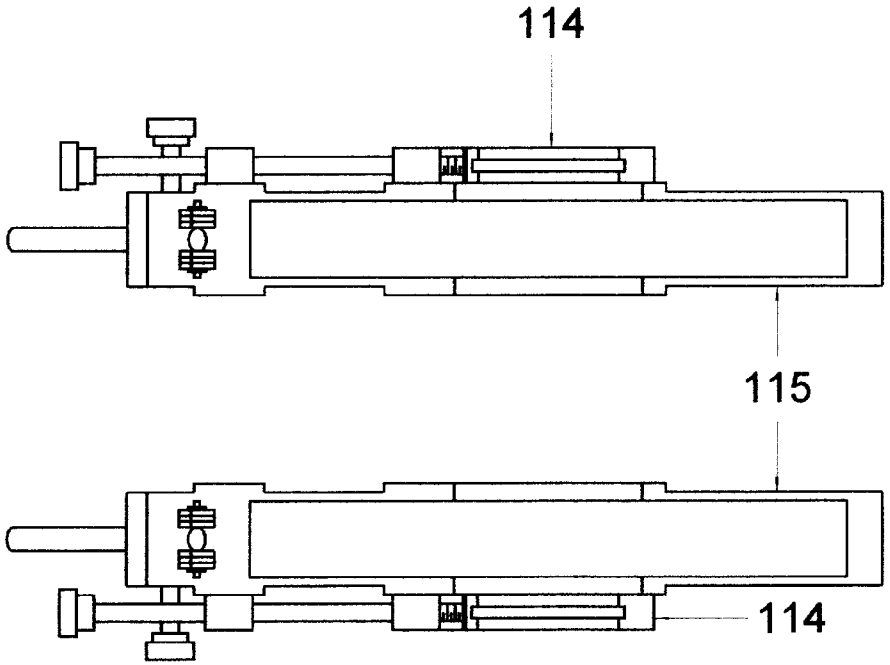
Figure 41:
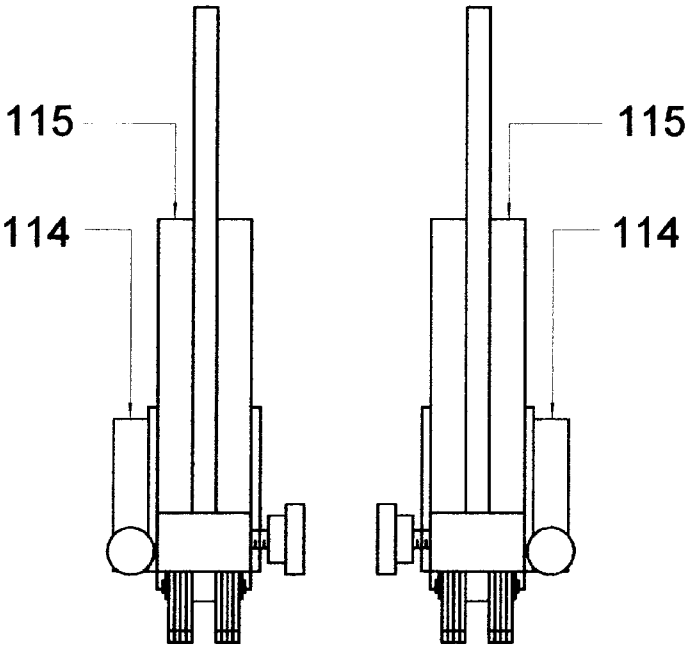

The front elevation of the motor and complete quill assembly connected, shown in FIG. 38, provides a side elevation of the bevel index pointer 102, attached to one trunnion 100.

As shown in FIGS. 39, 40, 41 and 42 the circular saw guard D5 of the motor assembly D differs from conventional radial arm saw guards in its shape and the transferability of its lock components 114 to either side of the circular guard 115, to provide for left-hand or right-hand use. The shape of the saw guard 115 places the sawdust exhaust elbow or chute 116 at a point close to where the sawdust 117 is created by the circular saw blade 118, rotating clockwise in right-hand use and counter-clockwise in left-hand use, thus reducing the amount of dust which may escape elimination through the elbow 116.

Figure 43:
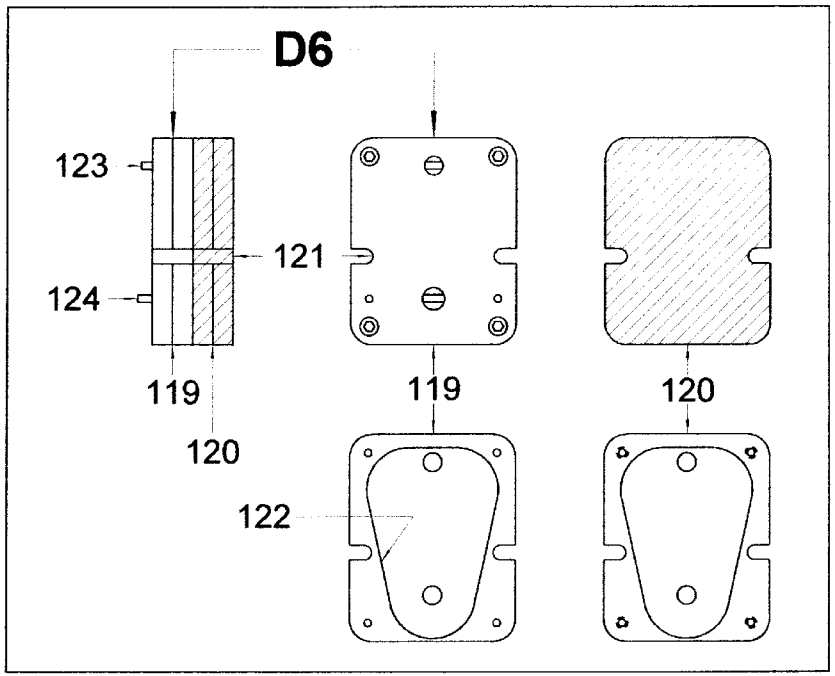
FIG. 43 is an illustration showing the gear box part of the motor assembly in side, front, rear and interior elevation views.
Figure 44:
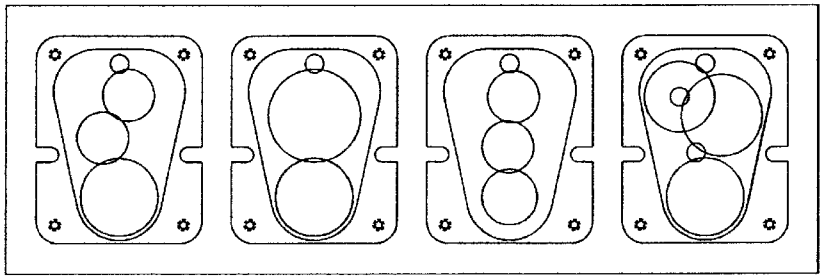
FIG. 44 is an illustration showing the interior of the gear box fitted with different gearing configurations.

As shown in FIG. 43, the gear box D6 of the motor assembly D consists of a front plate 119 and a rear plate 120 bolted together. Both plates have external grooves 121 located on either side and both plates are recessed to provide an enclosure for any desired configuration of gears which will fit within its confines. The recesses 122 are pear-shaped to induce grease splattered to the sides to move downward for upward re-circulation.

Figure 45:
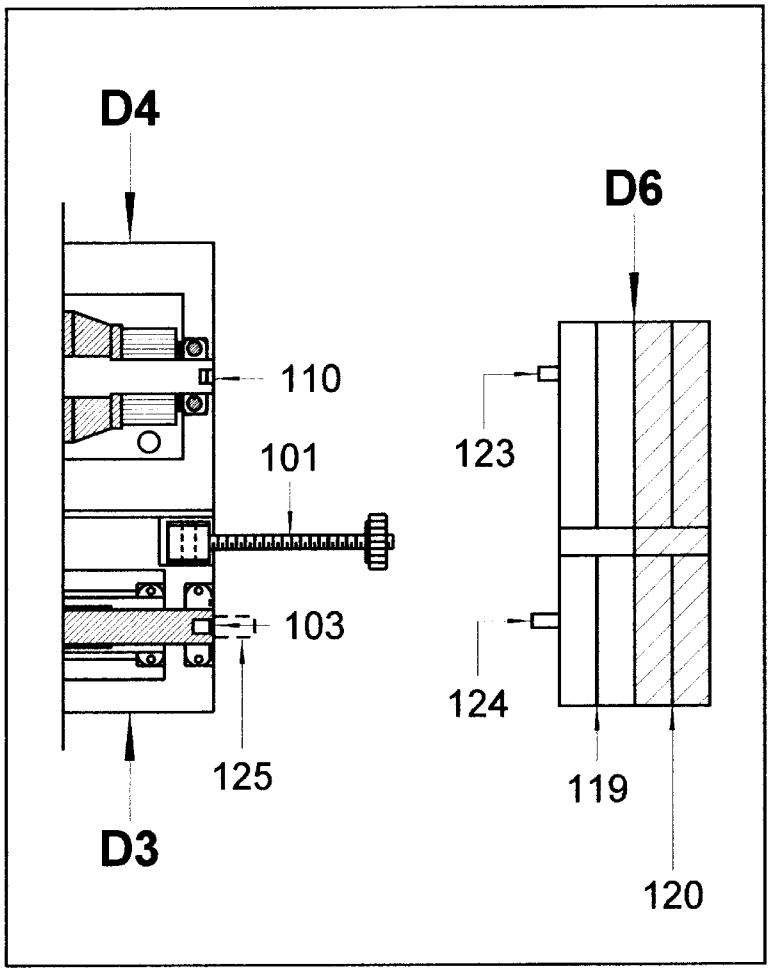
FIG. 45 is a cross section side elevation view of the rear of the motor and the quill assembly combined and a side elevation view of the gear box showing the tangs of the gear box positioned to mesh with the slots in the ends of the spindles in the quill assembly and the motor.

Regardless of the gearing configuration, the upper and lower gears are equipped with spindles which protrude through the front plate in the form of an input tang 123 and an output tang 124 which seat respectively in the notched ends of the motor D4 armature shaft 110 and the quill assembly D3 shaft 103 shown in FIG. 45. While the rotation and speed of the input tang 123 are constants governed by the rotation and speed of the armature shaft 110, the rotation and speed of the output tang 124 are governed by the gearing configuration.

Figure 46:
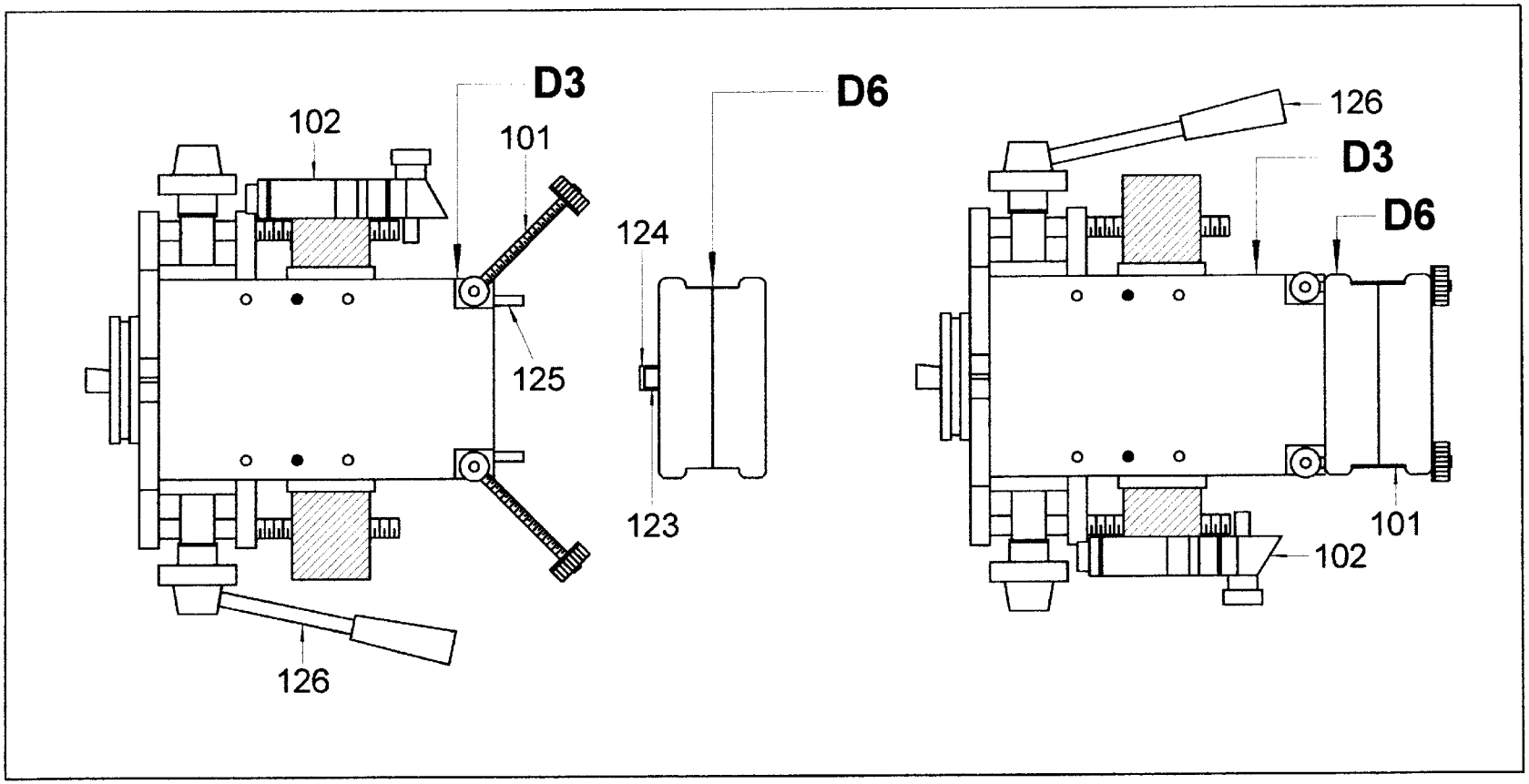
FIG. 46 is a top view of the quill assembly and the gear box showing them detached from and attached to one another.

The gear box D6 is aligned with the combined quill assembly D3 and the motor D4 through two dowels 125, located in the quill assembly D3, and secured thereto through the two grommet bolts 101 which are attached to the quill assembly D3. Once the gear box D6 has been engaged fully with the dowels 125 and its tangs 123 and 124 engaged fully with the notches in the ends of the quill assembly D3 shaft 103 and the D4 armature shaft 110, the splayed grommet bolts 101 are brought together, to lie in the grooves 121 of the gear box D6, as shown in FIG. 46, and the grommet nuts tightened. To facilitate coupling between the gear box D6 and the combined quill assembly D3 and the motor D4, the dowels 125 are longer than the tangs 123 and 124 which, themselves, are of different lengths. FIG. 46 shows also how the bevel index pointer 102 and the quill lever 126 are reversible for left-hand and right-hand use.

Figure 47:
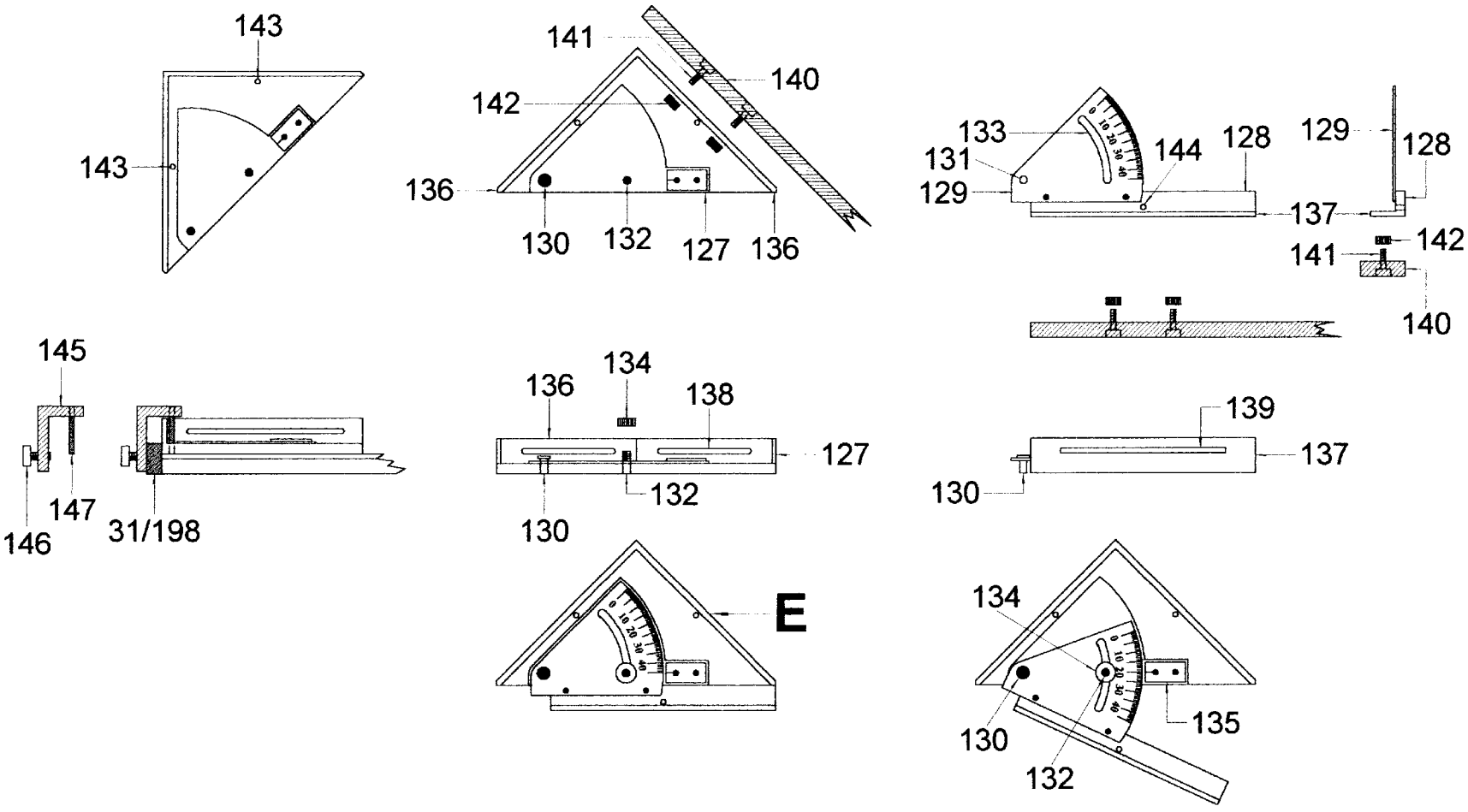
FIG. 47 is an illustration showing the miter gauge whole and partly exploded.

Mitering with the tool of the present invention is accomplished through the use of a triangular miter gauge which may be fitted with an extension for use with large materials or work pieces and a stop block for accurate, repetitive cuts. As shown in FIG. 47 the miter gauge E consists of a triangle 127 and an arm 128 which is attached to a 45° index plate 129. A pivot 130, located in the triangle 127, passes through a hole 131 in the index plate 129, enabling the arm 128 and the index plate 129 combined to swivel relative to the triangle 127. A screw 132 located in the triangle 127 passes through an arcuate slot 133 in the index plate 129, restricting the amount of swivel to the length of the arcuate slot 133. A hand wheel nut 134, threaded on the screw 132, locks the arm at any angle within the confines of the swivel, after the angle selected on the index plate 129 is positioned against an adjustable pointer 135 attached to the triangle 127. The triangle 127 has two raised sides 136 and the arm 128 has one raised side 137. The raised sides 136 and 137 contain slots 138 and 139 respectively, to accommodate a reversible, expendable and replaceable wooden extension 140, which is secured to any one of the raised sides 136 and 137 through two bolts 141, which pass through the slots 138 and 139 and thread into two nuts 142. The length of the slots 138 and 139 is greater than the distance between the two bolts 141, to permit the extension 140 to be adjusted laterally.

Figure 48:
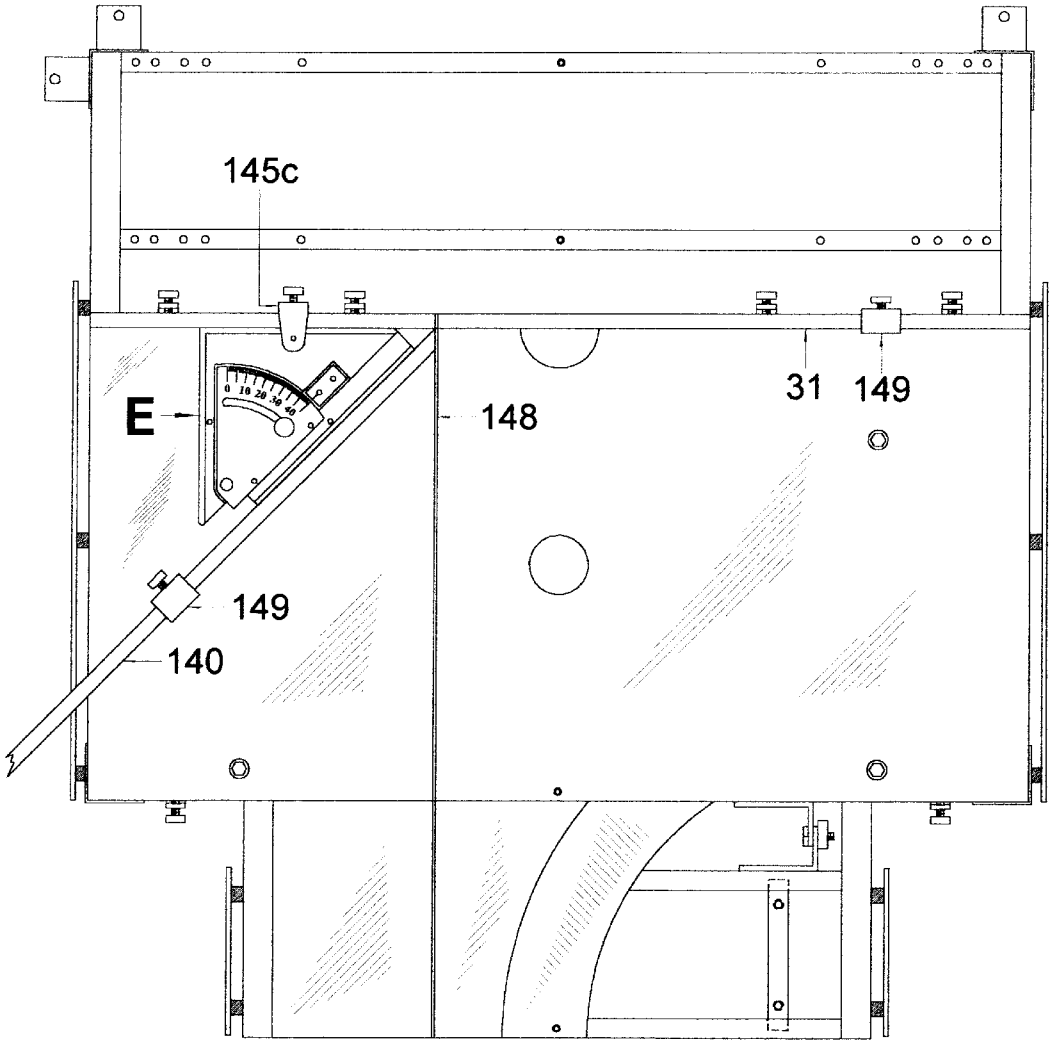
FIG. 48 is a top elevation view showing how the miter gauge is used on the table top of the stand.
Figure 49:
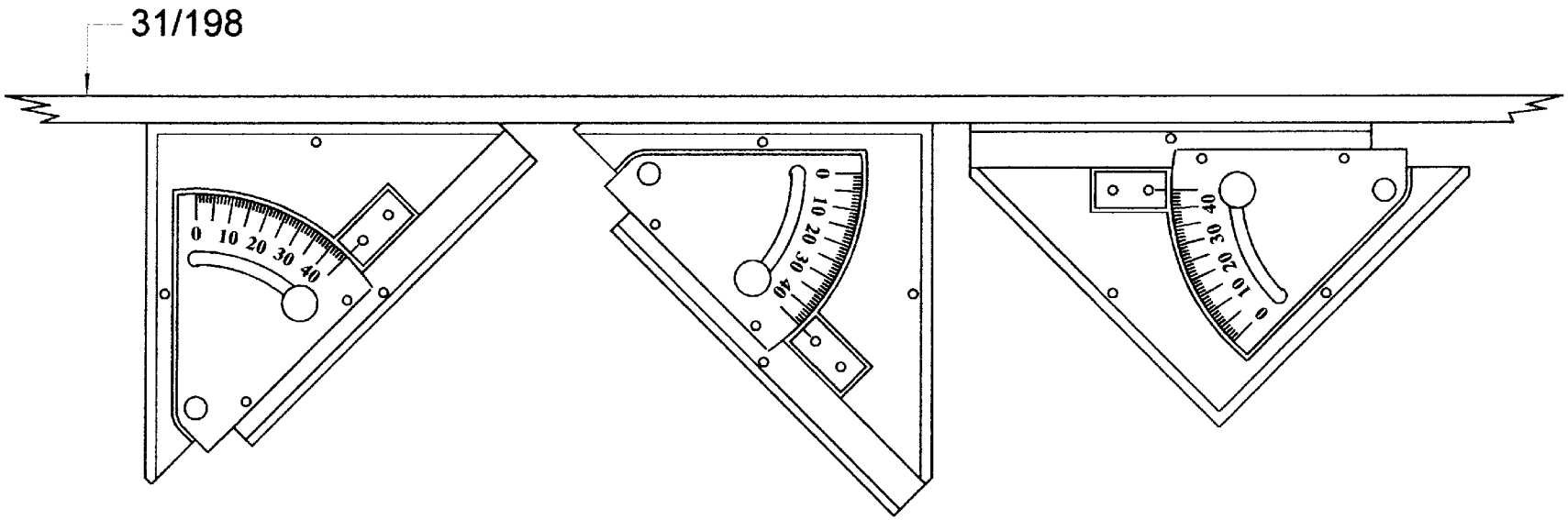
FIG. 49 is a top view showing the three different positions in which the miter gauge may be used relative to the fence or rip guide, to provide miter angles throughout 360 degrees.

The triangle 127 contains two holes 143 and the arm 128 contains one hole 144, to accommodate the dowel of a clamp designed to secure the miter gauge E to the standard fence 31 or the long fence 198, whichever is being used, whenever desired. As shown in FIG. 47, the clamp consists of an angle bracket 145, fitted with a hand wheel screw 146 and a dowel 147. As shown in FIG. 48, the miter gauge E, which may be used on either side of the saw blade kerf or cut line 148 is placed against the standard fence 31 or the long fence 198 for use. To secure the miter gauge E for repetitive length miters, the clamp 145*c* is placed astride the fence, with the dowel 147 engaging one of the holes 143 or 144 in the miter gauge E and the hand wheel screw 146 tightened against the fence. For repetitive length miters or 90° crosscuts, a stop block 149 is used, locked astride the miter gauge E extension 140, or the fences 31 or 198. As shown in FIG. 49 any one of the three sides of the miter gauge E may be placed against the fences 31 or 198, to permit mitering at any angle throughout 360°.

As shown in FIG. 50, the drop-leaf F consists of a frame constructed from two identical channel bars 150 and two identical channel bars 151, with the channels facing inward, and two identical shims 152. Both channel bars 151 have central holes 153 located in their upper and lower sides, with the lower holes being of a smaller diameter than the upper ones, to prevent the drop-in/lift-out shoulder pivot 14, usable with either the stand A or the drop-leaf F, from falling through. Only one hole, indicated as 153, serves a purpose. The hole in the other channel 151 is there only for manufacturing economy.

Three identical flat bars 154 are attached to the frame, one flat bar 154 to each channel bar 150 and one flat bar 154 to one channel bar 151, with two spacers 155 each between the channel bars and the flat bars. One channel bar 151 has two brackets 156 attached to its face, while the other channel bar 151 has two brackets 157 attached to its underside, as shown in FIG. 52. Each bracket 157 has a bolt 158 locked therein, to serve as anchors for arms 159, as shown in FIG. 53.

Figure 51:
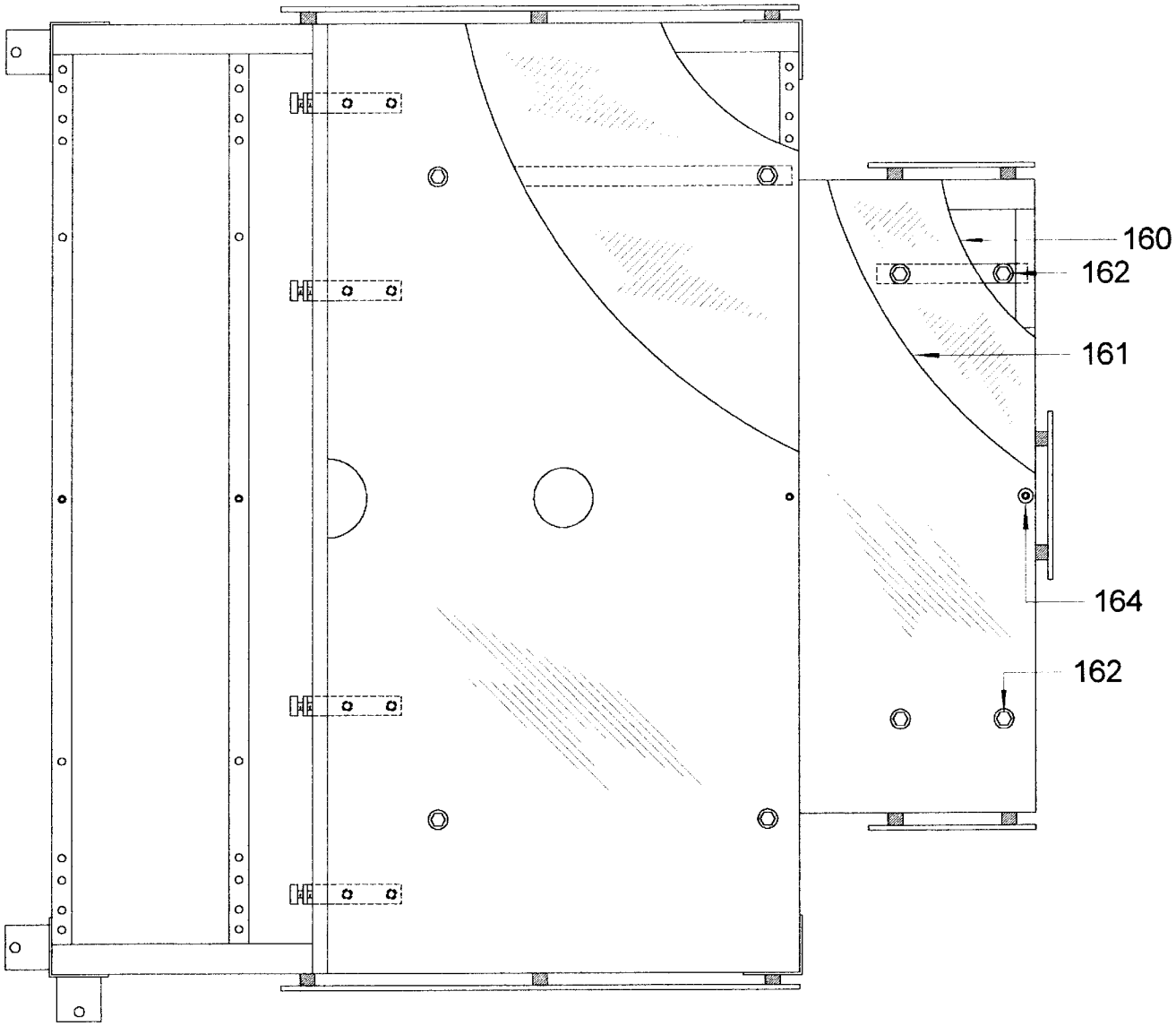
FIG. 51 is a top view of the stand and the drop-leaf showing the frame of the latter covered with a table top and a table top overlay.

The drop-leaf F is attached to and detached from the stand A quickly and easily, by sliding the brackets 156 laterally on to or off the bolts 19 and 20 of the stand A. The hand wheel nut 21, threaded on to the longer bolt 20, prevents any accidental detachment between the drop-leaf F and the stand A. The push-on, pull off arms 159 slide on to the drop-leaf F bolts 158 and the stand A bolts 38, as shown in FIG. 52, to secure the drop-leaf F in the horizontal position. As shown in FIG. 51, the drop-leaf F frame is covered by a table top 160 which, itself, is covered by an expendable and replaceable overlay 161, rubber cemented thereto. To permit full abutment between the combined table top 160 and overlay 161 of the drop-leaf F with the combined table top 22 and overlay 23 of the stand A, the combined table top 160 and overlay 161 are secured to the drop-leaf F frame through the use of four bolts 162, countersunk therein and threaded into two identical lock bars 163, which tighten against the inner face of the upper lip of both channel bars 151. Also to permit the aforesaid full abutment without obstructing the insertion of the drop-in/lift-out pivot 14, the hole 164 in the drop-leaf F the table top 160 and the overlay 161 combined is larger than the hole 153 in the channel bar 151.

Figure 54:
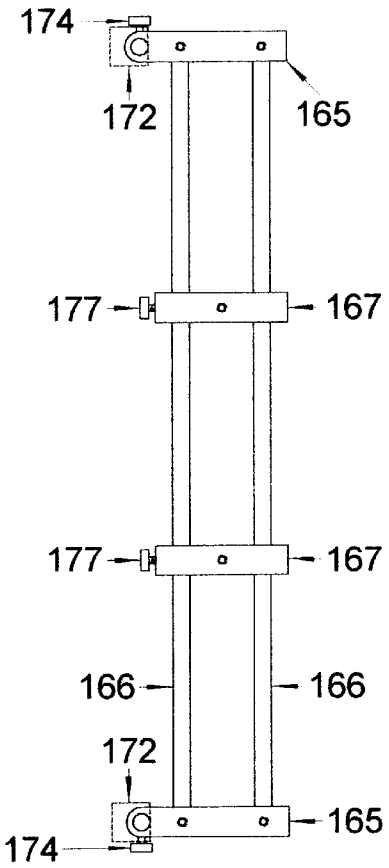
FIG. 54 is a top elevation view of the frame of the auxiliary rear table.
Figure 59:
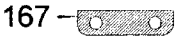
FIG. 59 is a front elevation view showing one of the two reinforcement plates used in the construction of the auxiliary rear table.

As shown in FIG. 54, the auxiliary rear table G consists of a frame composed of two sleeve arms 165, connected by two rods or tubes 166, which fit into the arms 165 and are reinforced by two plates 167, which slide over the rods or tubes 166. A front elevation of one plate 167 is shown in FIG. 59.

Figure 55:
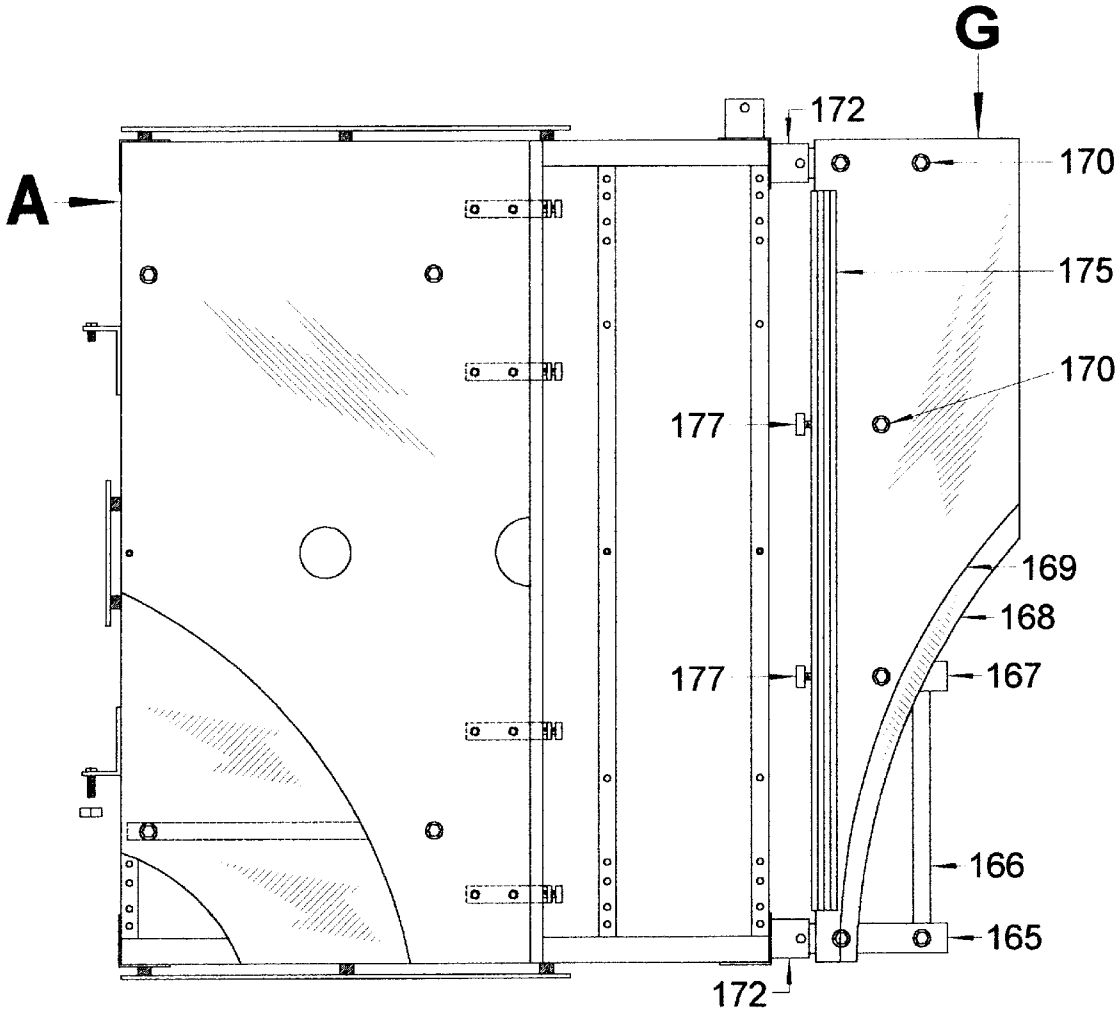
FIG. 55 is a top elevation view showing the auxiliary rear table frame covered with a table top and table top overlay and attached to the stand.
Figure 58:
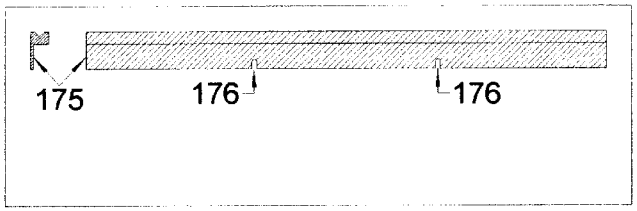
FIG. 58 is an illustration showing the side and front elevations of the fence of the auxiliary rear table.
Figure 57:
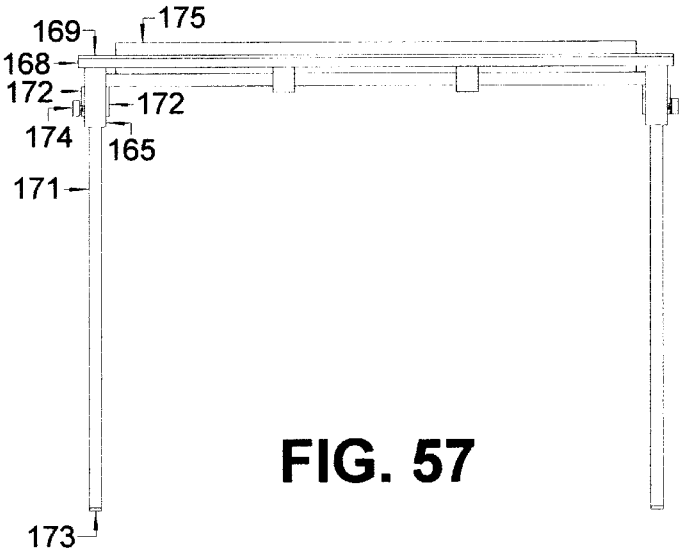
FIG. 57 is a front elevation view of the auxiliary rear table.
Figure 56:
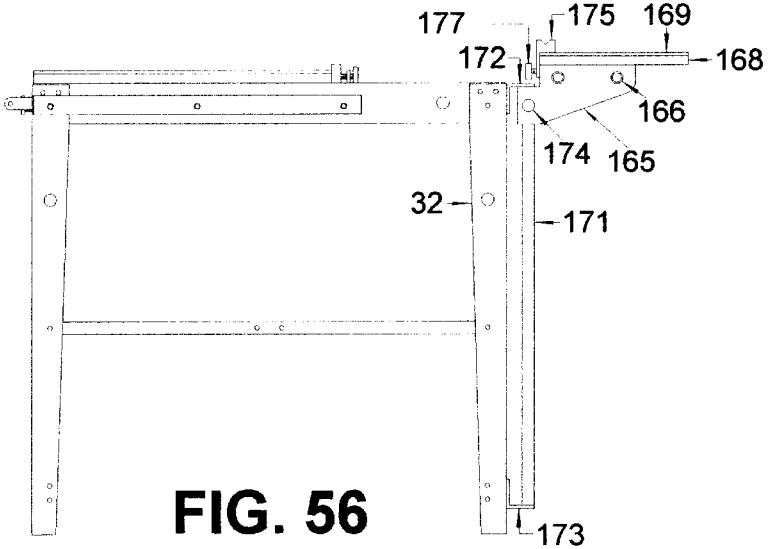
FIG. 56 is a side elevation, showing the auxiliary rear table attached to the stand.

As shown in FIG. 55, a table top 168 and an expendable and replaceable table top overlay 169, rubber cemented together as one unit, are attached on top of the frame through six bolts 170 countersunk therein. The bolts 170 thread into the sleeve arms 165 and plates 167. As shown in FIGS. 56 and 57, two rods or tubes 171 slide one each into the two sleeve arms 165, with the rods or tubes 171 then attached to the rear legs 32 of the stand A through two brackets 172 and two brackets 173. Two hand wheel screws 174, threaded one each in the two sleeve arms 165, serve to lock the vertically movable auxiliary rear table G at any selected position throughout the height or length of the rods or tubes 171. The top of an inverted L-shaped fence 175, shown in side and front elevations in FIG. 58, is Vee-grooved along its entire length for use in drilling round or tubular stock. The fence 175 rests on top of the table overlay 169, with the two slots 176 at the base of the fence 175 engaging two hand wheel screws 177, which thread into the plates 167 and secure the fence 175 to the auxiliary rear table G.

Figure 60:
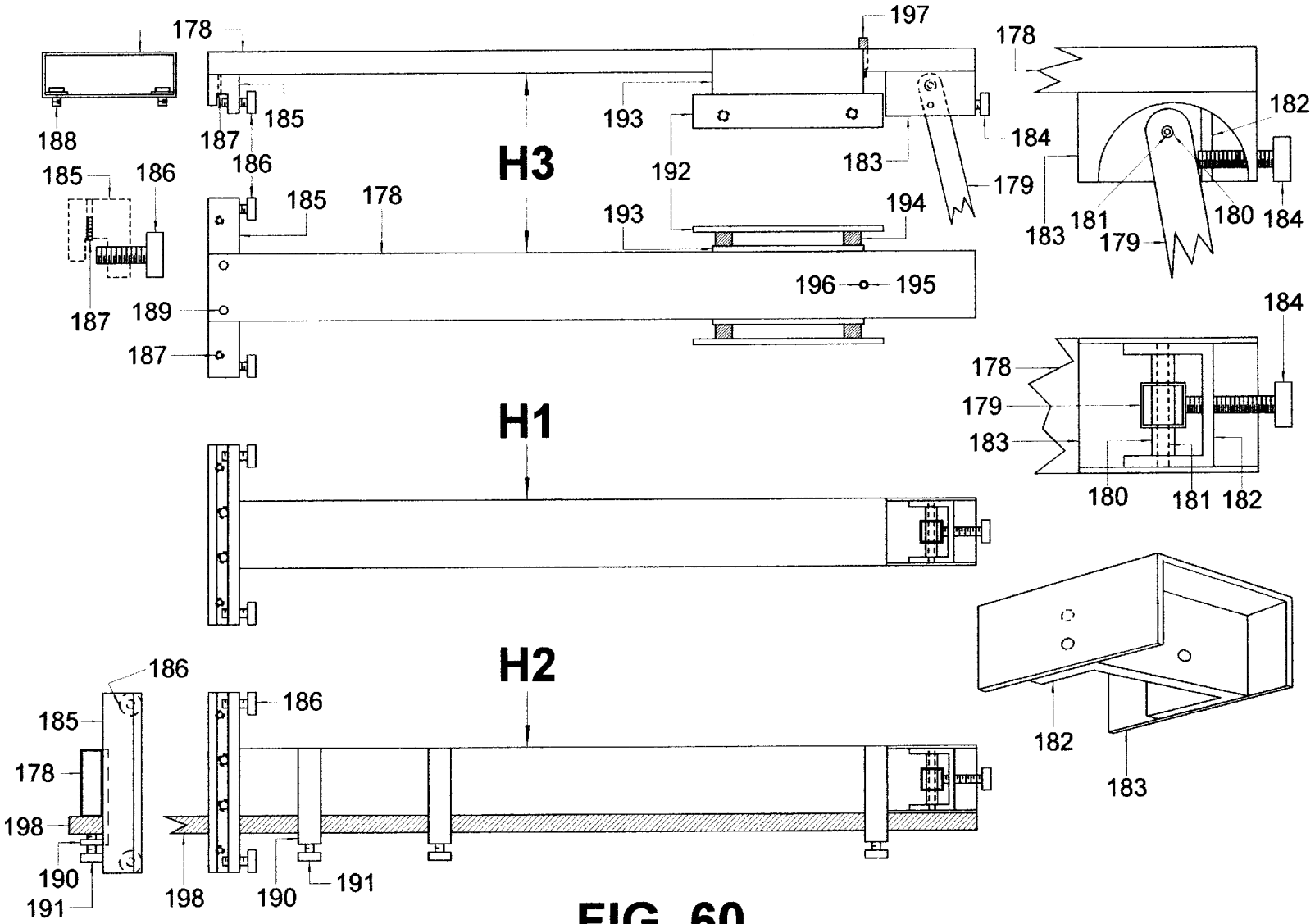
FIG. 60 is an illustration showing the construction of the outriggers.

As shown in FIG. 60, the outriggers H consist of two outriggers H1, two outriggers H2 and one outrigger H3 in a set. Each outrigger consists of a length of rectangular box beam 178 with a folding leg attached on the underside at one end and a saddle attached on the underside at the other end. The folding leg 179 is a length of square tubing with a round tube 180 fitted through it at one end. An axle 181, inserted through the round tube 180 is seated in a channel bracket 182, allowing the leg 179 to pivot inside the bracket 182. The bracket 182 is bolted inside another bracket 183 which is bolted or attached otherwise to one end of the box beam 178.

A hand wheel adjusting screw 184, threaded through the bracket 182 to bear against the upper part of the leg 179, is used to level the outrigger 178 horizontally from waist level, by altering the angle of the leg. The saddle consists of a channel bar 185, with two hand wheel lock screws 186 and two levelling set screws 187 threaded therein. The saddle is fastened to the box beam 178 through two socket bolts 188 which pass through the holes 189 in the upper and lower faces of the box beam 178. The holes 189 in the upper face of the box beam 178 are large enough to permit the heads of the socket bolts 188 to pass through, while the holes 189 in the lower face of the box beam 178 are only slightly larger than the threaded portion of the bolts 188 so as to prevent the bolts 188 from falling through the holes 189 and to permit the slight alignment adjustment between the box beam 178 and the saddle particularly for the two outriggers H2. Each outrigger H2 has three angle brackets 190 attached thereto. These angle brackets 190 serve as a rest for a long fence 198. A hand wheel lock screw 191 which is threaded through each bracket, serves to lock the long fence 198 against the outrigger 178. The two outriggers H2 are a left-hand and right-hand set and the brackets 190 are attached to each outrigger H2 accordingly.

To enable another outrigger to be attached to it, the outrigger H3 has two flat bars 192 fastened to the sides of the box beam 178, through the medium of two plates 193, with two spacers 194 between each bar 192 and each plate 193. The outrigger H3 has also two concentric holes 195 and 196 located in the top and bottom of the box beam 178, to accommodate a shoulder pivot 197, used for circle cutting and shaping. The lower hole 196 is smaller than the upper hole 195, to prevent the shoulder pivot 197 from falling through.

Figure 61:
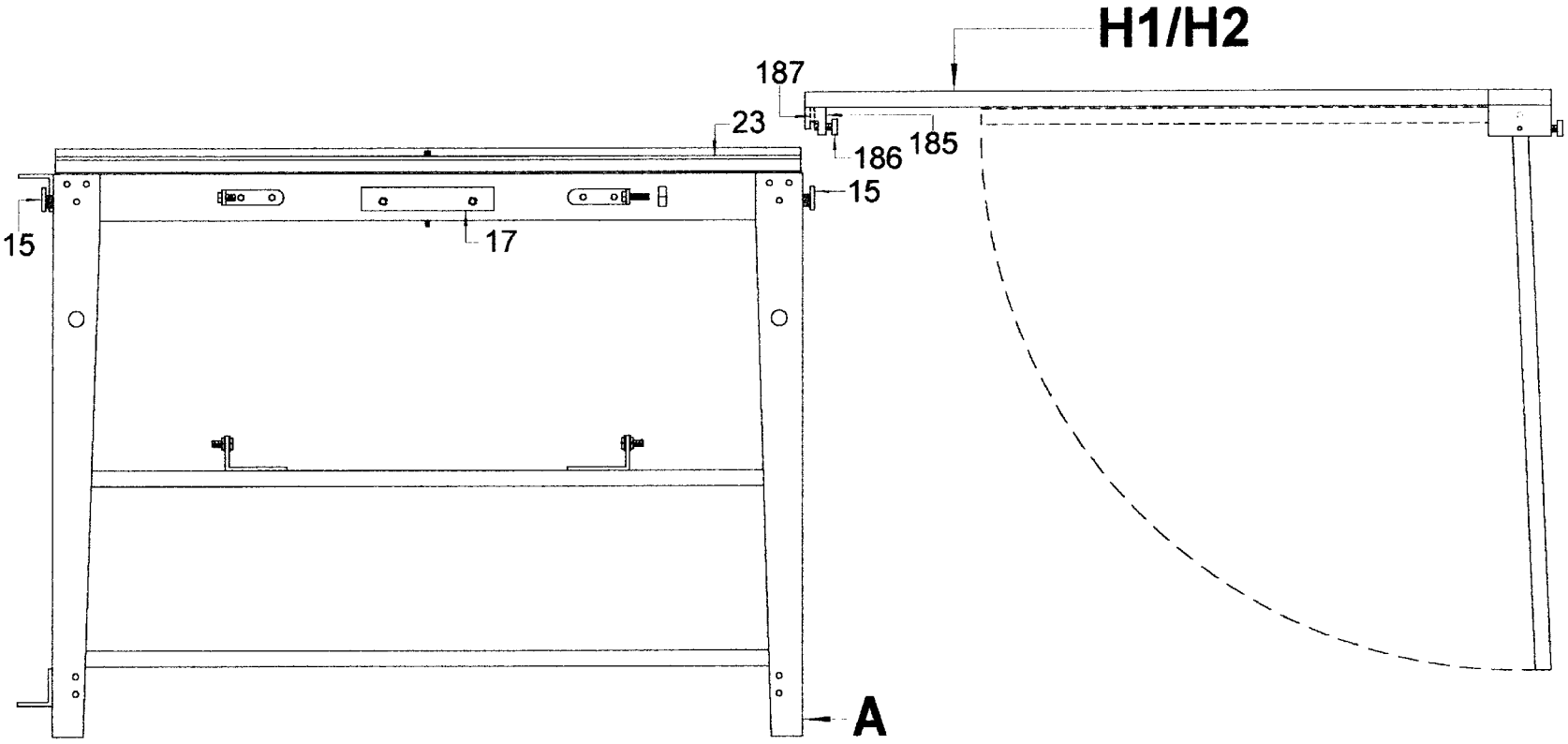
FIG. 61 is a side elevation view showing how the outrigger connects with the stand.

As shown in FIG. 61, the outriggers H1 and H2 are attached to the table A by placing the channel of the outrigger saddle astride the flat side bars 15 of the table A and tightening the hand wheel lock screws 186 of the saddles. Prior to tightening the lock screws 186, the outriggers are leveled flush with the overlay 23 of the table A by tightening or loosening the saddle leveling set screws 187 against the flat side bar 15. The leveling needs to be done once only.

Figure 7:
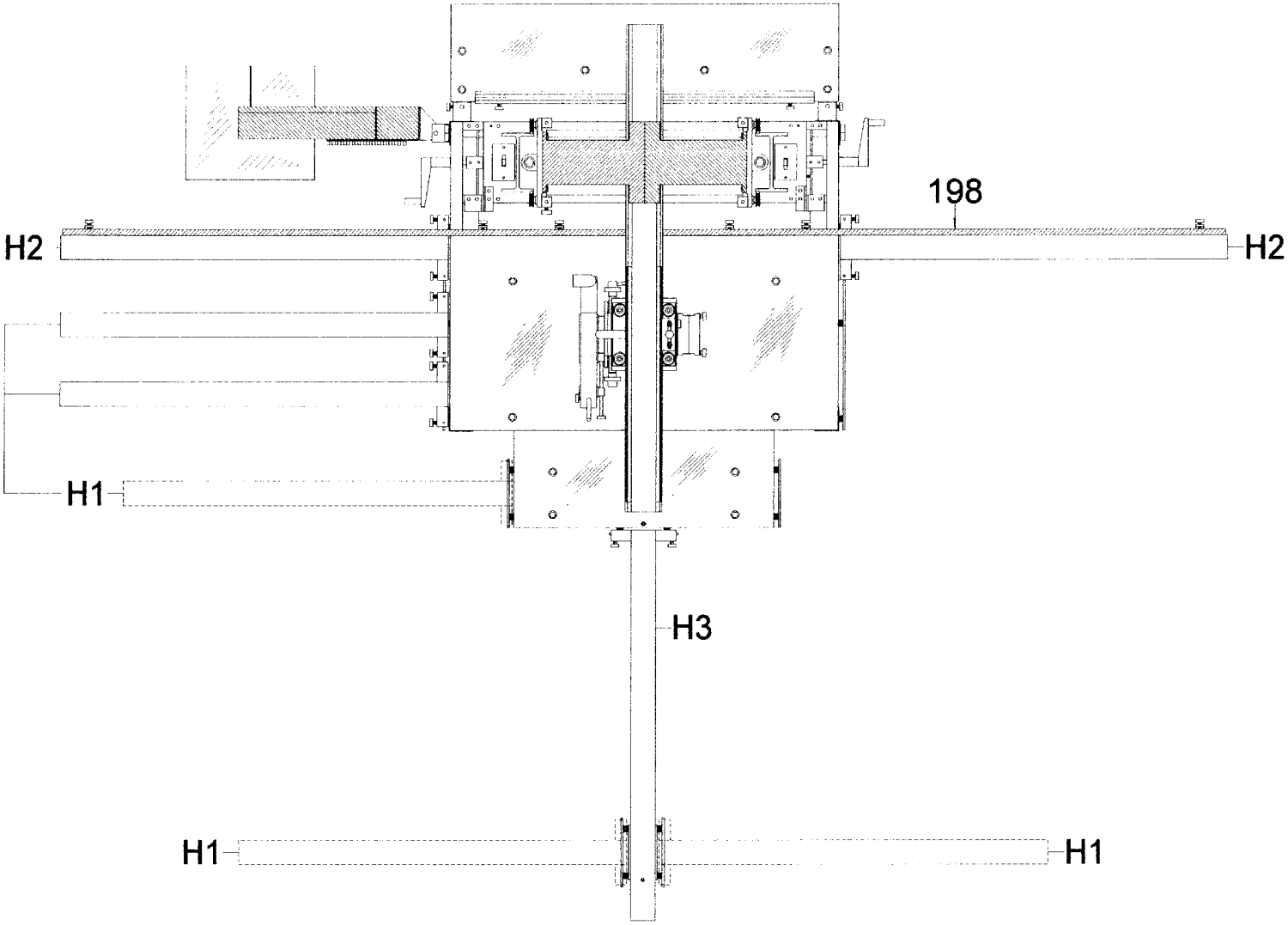
FIG. 7 is a top perspective elevation view, showing the outriggers attached in another of many possible configurations and the long fence which stretches the combined width of the stand and the length of two outriggers.

Similarly, the outriggers H1 are attachable to the flat front bar 17 of the table A. They are also attached to the flat side and front bars 154 of the drop-leaf F and to the flat side bars 192 of the outrigger H3. The outrigger H3 is attachable to any of the flat side or front bars aforementioned but, normally, would be attached to the flat front bar 17 of the table A or to the flat front bar 154 of the drop-leaf F. As seen in FIG. 61, the outriggers H become extremely compact when folded and, when not in use, the set of five fits into a box which requires insignificant storage space. Moreover, as shown in FIG. 7, they permit full access to all parts of the present invention, with no floor-level protrusions to trip over.

Figure 62:
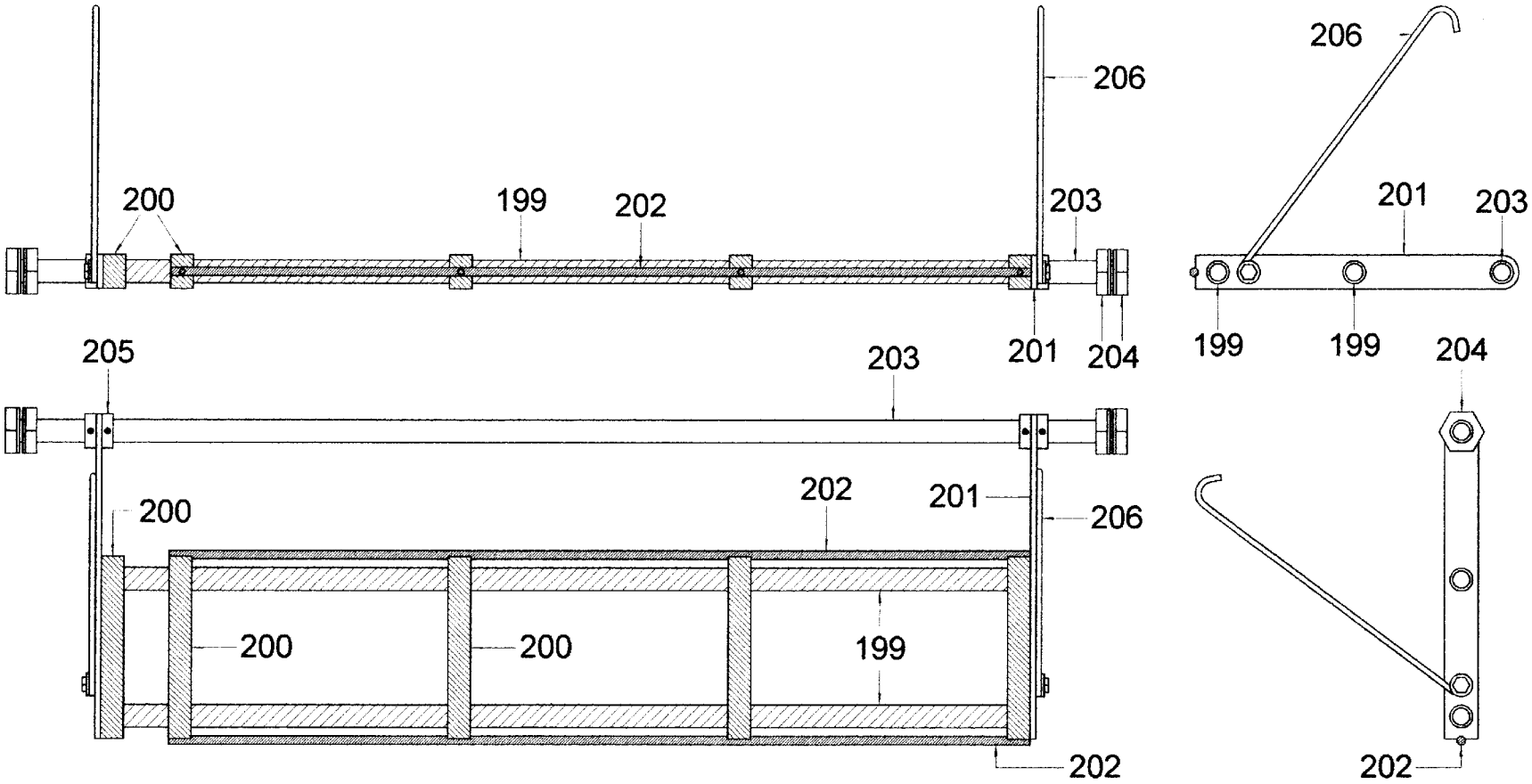
FIG. 62 is an illustration showing different views of the bed of the lathe.
Figure 63:
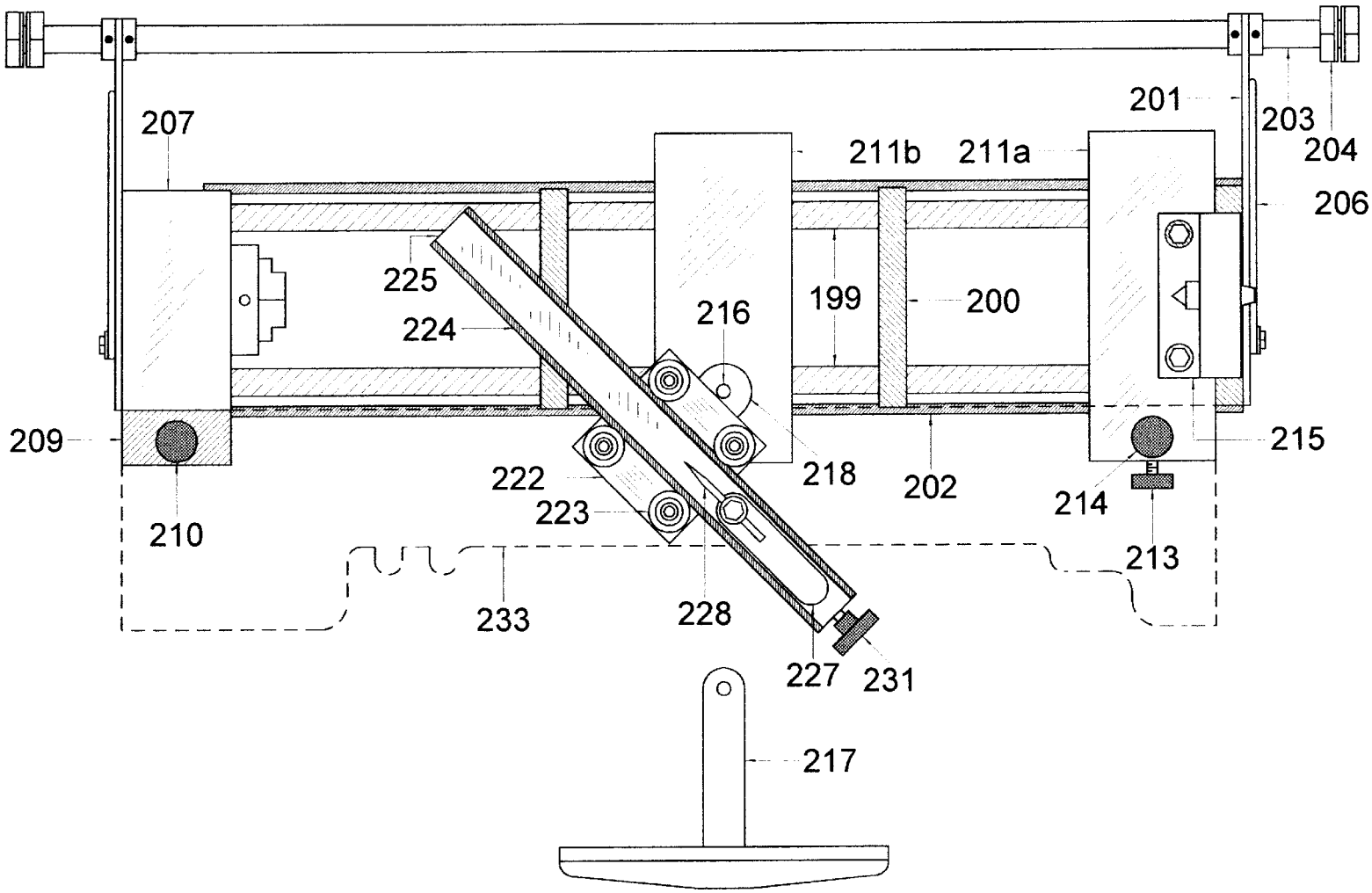
FIG. 63 is a top view of the lathe showing the tracer and the conventional hand-held chisels tool rest which are interchangeable.
Figure 64:
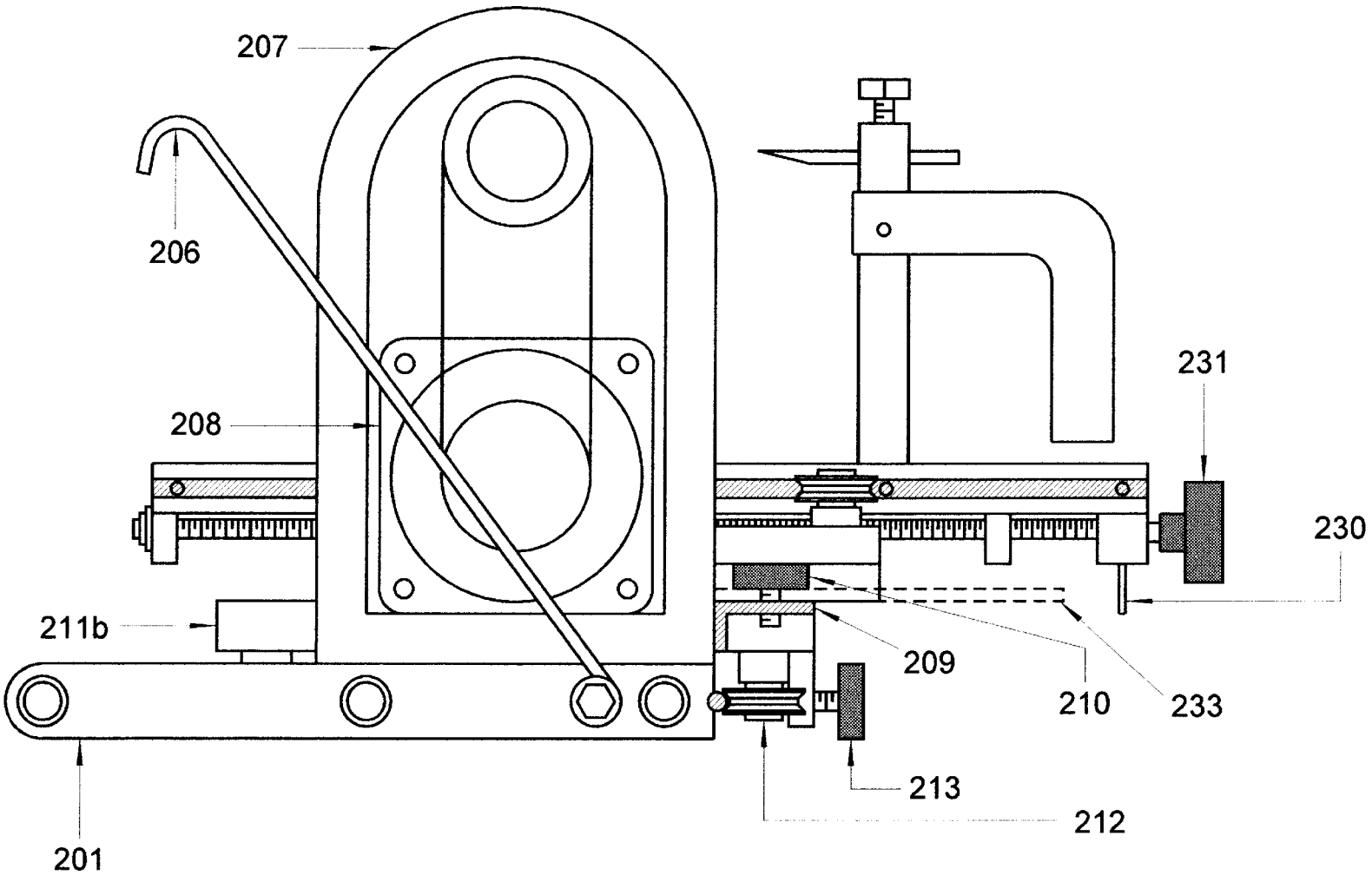
FIGS. 64 and 65 are side and front elevation views respectively of the lathe.

As shown in FIG. 62, the lathe J bed is composed of two rods or tubes 199, inserted through and locked to five plates 200 and two arms 201. Four of the five plates 200 are notched on both sides to seat two rod tracks 202, which are secured by screws to the four plates 200. A longer rod or tube 203, inserted through the two arms 201, acts as an axle on which the bed pivots. The rod or tube 203 is threaded at both ends to accommodate two nuts 204 at each end. Four collars 205, locked with set screws on the rod or tube 203, on either side of the two arms 201, prevent any lateral movement of the lathe J bed on the rod 203. Two swivel hooks are attached to the arms 201. As shown in FIG. 64, the lathe headstock is recessed to accommodate a variable speed motor 208. An angle bracket 209, equipped with a hand wheel screw 210, is attached to one side of the headstock 207, as a rest and lock for one end of a template, as described below.

Also mounted on the lathe J bed are two carriages 211*a* and 211*b* which are identical in construction but serve different purposes. Both carriages 211*a* and 211*b* are equipped with four Vee bearings 212 each, permitting them to roll laterally on the tracks 202 of the lathe J bed. Two hand wheel screws 213, threaded one each in carriages 211*a* and 211*b*, serve to lock the carriages at any selected positions along the track 202. The carriage 211*a* has a second hand wheel screw 214 threaded into it, for the purpose of securing the other end of a template, also as described below.

Figure 66:
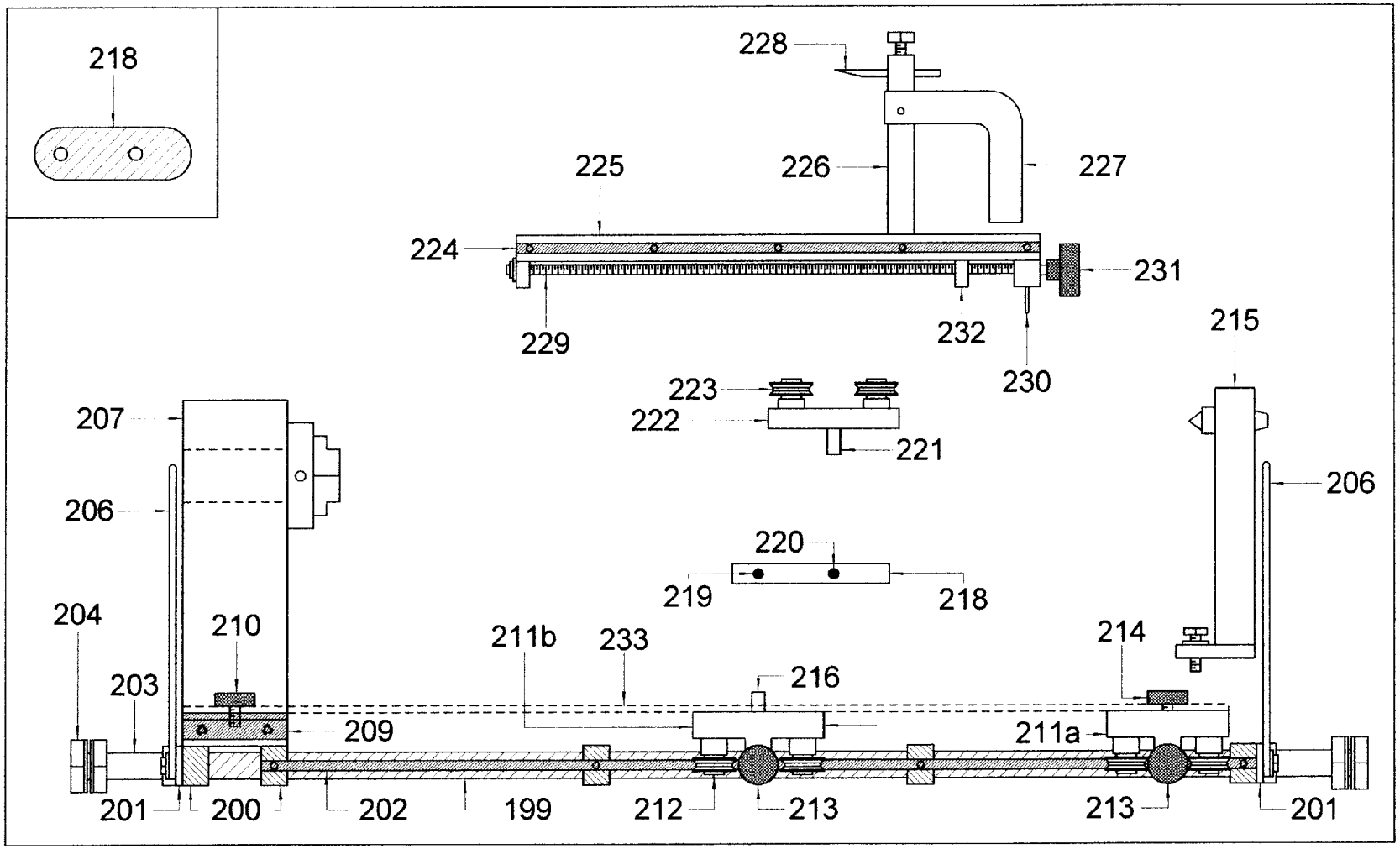
FIG. 66 is a partly exploded view of FIG. 65.

A typical lathe tailstock 215 is mounted on the carriage 211*a*. A dowel 216 in the carriage 211*b* serves as a pivot on which to locate, swivel and lock a tracer, which is interchangeable with a typical lathe tool rest 217. As seen in the exploded view of the tracer in FIG. 66, it is composed of an intermediate plate 218, equipped with two set screws 219 and 220. As shown in the top view inset in FIG. 66, the intermediate plate 218 contains two holes, which accommodate the dowel 216 and the dowel 221 of a plate 222. The set screw 220 locks the plate 222 to the intermediate plate 218 and the set screw 219 locks the intermediate plate 218 to the carriage 211*b*. The plate 222 is equipped with four Vee bearings 223 on which ride two rod track 224 attached to a flat bar slide 225. A post 226, equipped with a handle 227 and a cutting bit 228, is mounted on the upper surface of the slide 225. Attached to the lower surface of the slide 225 are a threaded rod 229 and a template contour follower pin 230. The upper surface of the plate 222 is grooved, to provide clearance for the threaded rod 229.

The threaded rod 229 is equipped with a hand wheel 231 and a square nut 232. Because one of the four sides of the square nut 232 is in full contact with the lower face of the slide 225, the square nut 232 cannot rotate. Consequently, rotating the threaded rod 229 by means of the hand wheel 231 causes the square nut 232 to move forward or back along the threaded rod 229. Held by the four Vee bearings 223, the slide 225 moves forward and back over the plate 222, with its forward movement stopped when the square nut 232 contacts the plate 222. In practice, a template 233 of the desired length and shape is made from a quarter inch thick piece of masonite or plywood and one end of it is secured on top of the headstock bracket 209 with the hand wheel screw 210 passing through a hole drilled at one end of the template 233. The other end of the template 233 is secured on top of the tailstock carriage 211*a* with the hand wheel screw 214, threaded into the carriage 211*a* and passing through a second hole drilled at the other end of the template 233. To facilitate attachment and detachment, the two holes in the template 233 may be slots instead.

Through the use of the hand wheel 231, the square nut 232 is advanced to draw the slide 225 back to the point where the cutting bit 228 clears the work piece to be turned. The tracer carriage 211*b* is moved to abut the headstock 207 or the tailstock carriage 211*a*, wherever the length of the template 233 requires the carriage 211*a* to be locked on the lathe J bed, and the hand wheel 231 turned to draw the square nut 232 back fractionally and permit the cutting bit 228 to engage the rotating work piece. The handle 227 is grasped and pushed forward, then moved laterally, causing the cutting bit 228 to shave the rotating work piece. The process is repeated until the template follower pin 230 contacts the contour of the template 233 and continued thereafter until the full contour of the template 233 has been transferred to the rotating work piece. Just shaving the rotating work piece with each lateral move provides clean turnings very swiftly. The template 233 cannot sag because it rests on top of the tracer carriage 211*b* throughout the lateral movements of the carriage.

Figure 65:
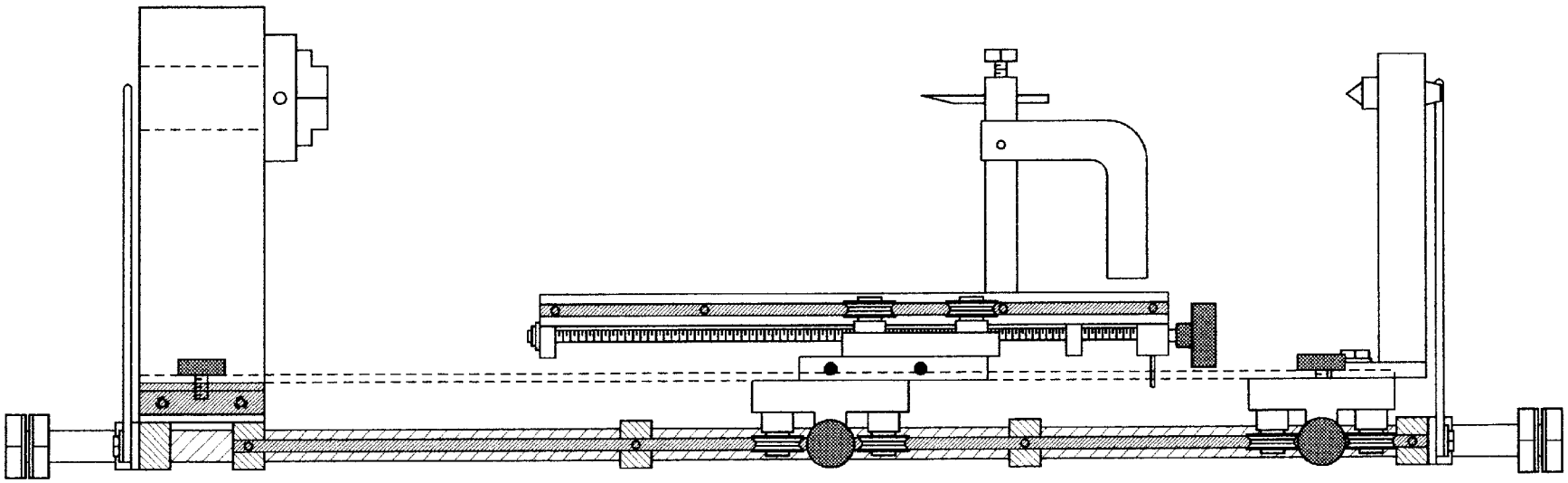
Figure 67:
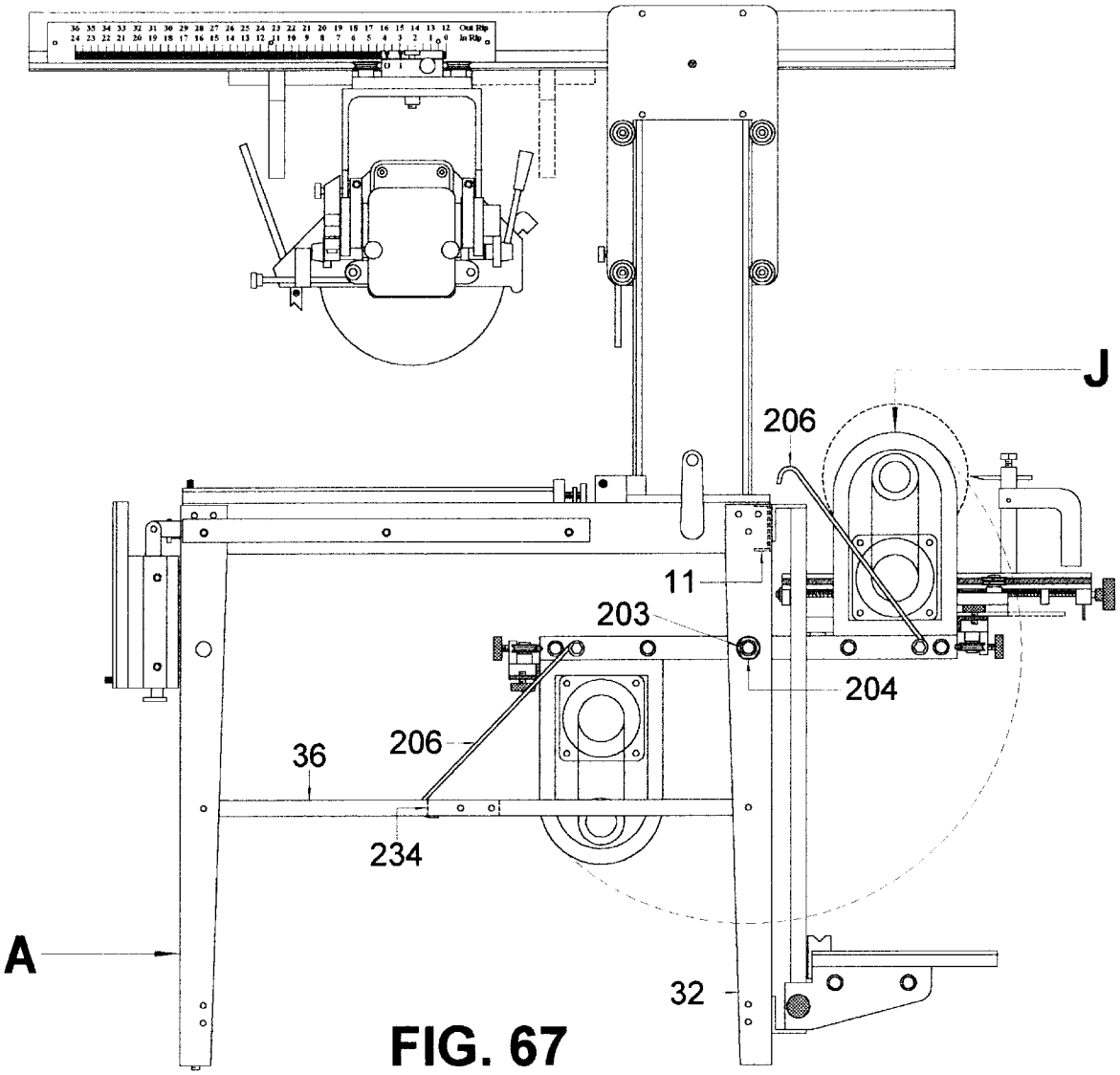
FIG. 67 is a side elevation view of the lathe shown attached to the stand, in the operative and stored positions.

The lathe J may be used with hand-held chisels if desired, by exchanging the tracer for the tool rest 217. As shown in FIG. 67, the lathe J is attached to the rear legs 32 of the stand A by means of the lathe tube 203 passing through the large holes located in the legs 32 and secured therein by the four nuts 204, two nuts 204 being on the inside of the rear legs 32 and two on the outside. The lathe J is secured in the operative position by latching the two lathe hooks 206 over the rear channel 11 of the stand A frame and secured in the stored position by latching the two hooks 206 over two angle brackets 234 bolted to the inside faces of the stand braces 36. To permit the lathe J to be swiveled into the stored position, the tracer has to swiveled into the position shown in FIG. 65.

Figure 69:
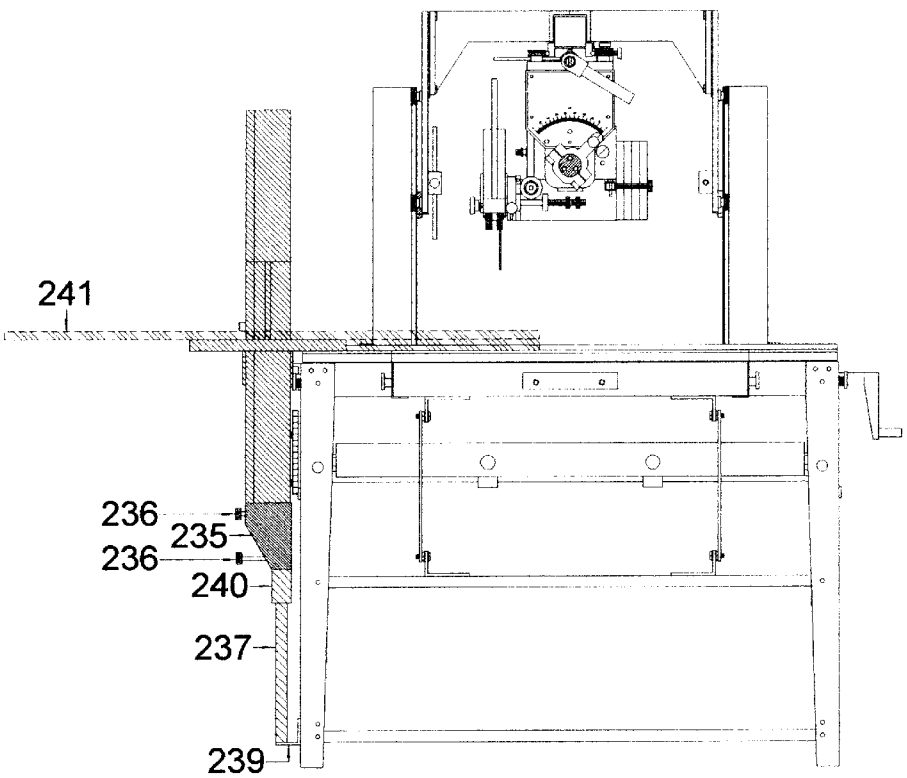
FIGS. 68 and 69 are side and front elevation views respectively showing the band saw attached and swiveled against the stand.
Figure 68:
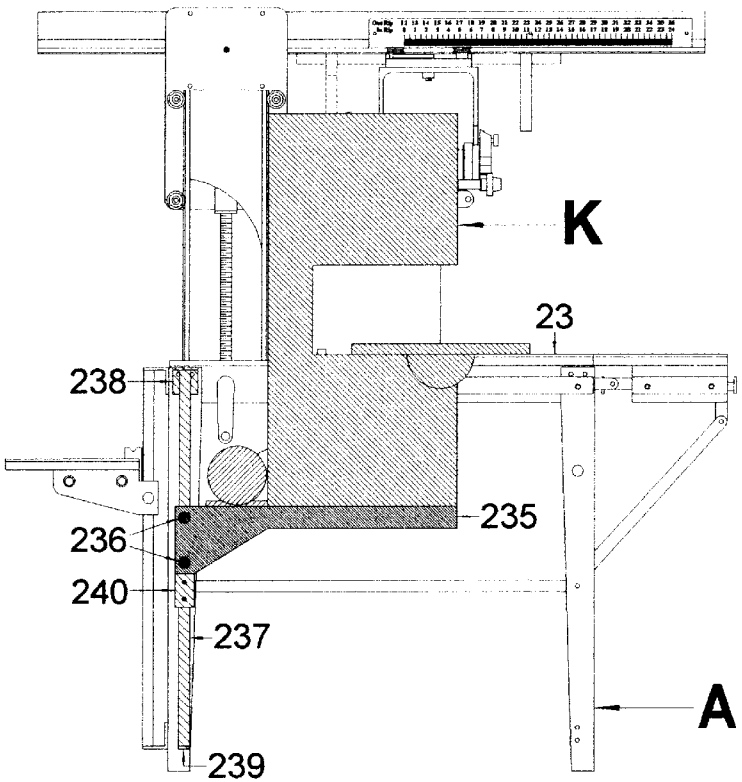

The present invention eliminates the need to manufacture a special band saw, by providing for the use of a variety of available two and three wheel band saws and enable them to handle work requiring tables substantially larger than those furnished with most conventional band saws. As shown in FIGS. 68 and 69, a swivel arm 235 is provided as a base on which to mount a band saw and its accompanying motor and permit the tool to be used throughout 180° along the horizontal plane, as indicated in FIG. 6. Two hand wheel screws, 236 threaded into the swivel arm 235, lock the arm in the selected position throughout the 180° positions. The swivel arm 235 is attached to the table A through a rod or tube 237, secured to the left rear leg 32 of the stand A, through the use of an upper angle bracket 238 and a lower angle bracket 239. A collar 240, equipped with two set screws, is used on the rod or tube 237, below the swivel arm 235, to set and maintain the upper surface of the band saw table above the upper surface of the stand table overlay 23. Whenever a table larger than that furnished with the band saw is required, the band saw is swiveled adjacent to the stand A. An auxiliary, table 241 may be placed over the band saw table and clamped on the stand table with the clamps located well back from the saw blade and out of the way of the work piece being sawn.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

I claim:

1. A woodworking power tool comprising, a stand having a frame including a plurality of horizontal channel bars, braced vertical support leg members, an overlay-covered table top disposed on said stand, a first opening formed in said table top, a second opening formed in one of said channel bars, said first opening and second opening being adapted to receive a drop-in/lift-out shoulder pin for aligning said table top on said stand, a first flat bar mounted in a horizontal spaced manner on a first side of said stand, a second flat bar mounted in a horizontal spaced manner on a second side of said stand, and a third flat bar mounted in a horizontal spaced manner on a front side of said stand, said first flat bar, second flat bar and third flat bar being operative to receive outriggers selectively attachable and detachable from said stand.

2. A woodworking power tool according to claim 1 including two vertical beams spaced from one another and foldably mounted at a rear portion of said frame and operatively disposed perpendicular to said table top, an elongated vertical worm screw disposed juxtaposed to each one of said vertical beams, said worm screw having a first bevel gear provided at its lower end, a horizontal elongated crank rod rotatably mounted on said stand, said crank rod having a second bevel gear provided at one end therein and engageable with said first bevel gear of one vertical worm screw, and a third bevel gear provided at the other end of said crank rod and engageable with said first bevel gear of the other vertical worm screw, a first short rod rotatably mounted on said stand and having a fourth bevel gear thereof engageable with said third bevel gear, a second short rod rotatably mounted on said stand and having a fifth bevel gear thereof engageable with said third bevel gear, a first crank handle mounted to said first short rod and a second crank handle mounted to said second short rod, said first short rod and second short rod being selectively operative for rotating said crank rod and both said one vertical worm screw and said the other vertical worm screw.

3. A woodworking power tool according to claim 2 including a vertically movable arm carriage disposed slidably between said two vertical beams and adapted to engage with said one vertical worm screw and said other worm screw whereby said arm carriage is movable slidably up and down said two vertical beams by operating a selected one of said first crank handle and second crank handle.

4. A woodworking power tool according to claim 3 including an elongated arm member mounted in a cantilever manner to said arm carriage and extending horizontally and forwardly therefrom to dispose in a spaced manner over said table top.

5. A woodworking power tool according to claim 4 including a motor assembly slidable mounted on said elongated arm member, said motor assembly having a motor with an optional horsepower and selectively attachable to and detachable from a quill assembly disposed on said elongated arm member.

6. A woodworking power tool according to claim 4 wherein said quill assembly includes an extendible spindle mechanism having a stationary drive shaft and a mobile mating socket.

7. A woodworking power tool according to claim 5 including interchangeable, different speed ratio gear boxes as rotational force transmission means between said motor and said spindle mechanism.

8. A woodworking power tool according to claim 1 including a miter gauge disposed on said table top and operative for circular saw miter cutting throughout 360 degrees, said miter gauge comprising a triangle and an arm attached to a 45 degrees index plate, a pivot located in said triangle extending through a hole located in said index plate, a screw located in said triangle passing through an arcuate slot formed in said index plate with a hand wheel nut threaded on said screw and adapted to lock said arm at a selected angle against an adjustable pointer attached to said triangle.

9. A woodworking power tool according to claim 8 wherein said triangle is provided with two clamp holes and said arm is provided with one clamp hole for clamping said miter gauge with a clamp to a rip fence disposed at the rear of said table top.

10. A multiple functions woodworking power tool according to claim 1 including a drop-leaf selectively attachable to and detachable from the front of said stand and operative to provide an extension surface for said table top.

11. A woodworking power tool according to claim 10 wherein said drop-leaf having a left-side bar, a right side bar and a front flat bar mounted thereon in a spaced manner and adapted to receive outriggers selectively attachable thereto and detachable therefrom.

12. A woodworking power tool according to claim 11 including a vertically movable auxiliary rear table mounted to said stand.

13. A woodworking power tool according to claim 12 including a plurality of outriggers removably attachable to selected side and front of said stand and said drop-leaf to provide full support for large work pieces.

14. A woodworking power tool according to claim 13 wherein each one of said outriggers comprises a rectangular box beam having a folding leg attached on the underside at one end and a saddle attached on the underside at the other end, a hand wheel adjusting screw mounted on said box beam and adapted to bear against the upper part of said leg for altering the angle position of said leg with respect to said box beam.

15. A woodworking power tool according to claim 14 including a lathe unit mounted on a cross brace on said stand and adapted to pivot selectively into operative and stored positions.

16. A multiple functions woodworking power tool according to claim 15 including a tracer attachment mounted on said stand and adapted to produce turnings equal in diameter to the swing of said lathe, said tracer attachment being interchangeable with a hand-held chisels tool rest.

17. A woodworking power tool according to claim 16 including a swivel arm mounted on said stand, said swivel arm being operative for mounting selectively a two-wheel band saw and three-wheel band saw having an integral operating motor therein.

18. A multiple functions woodworking power tool comprising, a stand having a plurality of horizontal channel bars and vertical support leg members, said horizontal channel bars including a right side bar mounted thereon in a spaced manner, a left side bar mounted thereon in a spaced manner, a front bar mounted thereon in a spaced manner, and a rear bar mounted thereon in a spaced manner, a first opening formed at the middle of said front bar, a table top disposed on a front portion of said stand, said table top having a central opening, a front opening formed at the middle front edge portion therein and a semi-circular cutout formed at the middle rear edge portion therein, said front opening being aligned with said first opening of said front bar, two vertical mounting column members extending upwardly from a rear portion of said stand, each one of said vertical mounting column members having an elongated worm screw disposed therein, an arm carriage disposed between said vertical mounting column members and movably engaged with said elongated worm screw of said vertical mounting column members, an elongated crank rod member mounted on said stand and adapted to operate said elongated worm screw of said vertical mounting column members for moving said arm carriage selectively up and down said vertical mounting column members, said crank rod member having a right crank handle disposed on one side of said stand and a left crank handle disposed on a second side of said stand whereby said crank rod member is operative selectively by any one of said right crank handle and left crank handle, an elongated arm member mounted in a cantilever manner to said arm carriage and extending horizontally and forwardly therefrom to position in a spaced manner over said table top, a motor carriage slidably mounted on said elongated arm member, a motor mounted on said motor carriage, said elongated arm member having rip scales mounted on the left side and right side therein and adapted to indicate a selected position of said carriage on said elongated arm member, a drive gear box mounted to said motor carriage and adapted to engage with said motor, said drive gear box having an output tang adapted to provide rotational force for a selected power tool mounted on said stand.

* * * * *